US012171306B2

(12) United States Patent
Redon et al.

(10) Patent No.: US 12,171,306 B2
(45) Date of Patent: Dec. 24, 2024

(54) ARTICLE OF FOOTWEAR HAVING AN AUTOMATIC LACING SYSTEM

(71) Applicant: PUMA SE, Herzogenaurach (DE)

(72) Inventors: Arnaud Redon, Nuremberg (DE); Markus Bock, Herzogenaurach (DE); Romain Girard, Lauf an der Pegnitz (DE)

(73) Assignee: PUMA SE, Herzogenaurach (DE)

( * ) Notice: Subject to any disclaimer, the term of this patent is extended or adjusted under 35 U.S.C. 154(b) by 269 days.

(21) Appl. No.: 17/527,501

(22) Filed: Nov. 16, 2021

(65) Prior Publication Data

US 2023/0148710 A1 May 18, 2023

(51) Int. Cl.

| | |
|---|---|
| ***A43C 1/00*** | (2006.01) |
| ***A43B 23/26*** | (2006.01) |
| ***A43C 11/16*** | (2006.01) |
| ***A43C 11/20*** | (2006.01) |

(52) U.S. Cl.
CPC ..... *A43C 1/003* (2013.01); *A43C 11/165* (2013.01); *A43C 11/20* (2013.01); *A43B 23/26* (2013.01)

(58) Field of Classification Search
CPC ..... A43C 1/003; A43C 11/165; A43C 11/20; A43C 1/00; A43B 23/26; A43B 3/06
See application file for complete search history.

(56) References Cited

U.S. PATENT DOCUMENTS

| | | | |
|---|---|---|---|
| 4,442,613 | A | 4/1984 | Dobbin |
| 4,724,626 | A | 2/1988 | Baggio |
| 4,741,115 | A | 5/1988 | Pozzobon |
| 4,748,726 | A | 6/1988 | Schoch |
| 4,787,124 | A | 11/1988 | Pozzobon et al. |
| 4,922,634 | A | 5/1990 | Seidel |
| 4,961,544 | A | 10/1990 | Bidoia |
| 5,051,095 | A | 9/1991 | Slenker |

(Continued)

FOREIGN PATENT DOCUMENTS

| | | |
|---|---|---|
| CA | 2500150 A1 | 9/2006 |
| CN | 2540805 Y | 3/2003 |

(Continued)

OTHER PUBLICATIONS

Liszewski, Andrew "A Self-Adjusting Smart Belt: Yes, It's Come to This" Jan. 4, 2015, XP055386586 Retrieved from the Internet: URL: https://gizmodo.com/the-only-gadget-1677432880 [retrieved on May 13, 2019].

(Continued)

*Primary Examiner* — Aiying Zhao
(74) *Attorney, Agent, or Firm* — Quarles & Brady LLP

(57) ABSTRACT

An article of footwear includes a sole structure, an upper attached to the sole structure, and a lacing system. The lacing system includes a housing disposed on a tongue of the upper, a lateral side flap and a medial side flap that extend from the sole structure along lateral and medial sides of the upper, respectively, toward the tongue, a plurality of lateral lace retainers disposed along an upper end of the lateral side flap, a plurality of medial lace retainers disposed along an upper end of the medial side flap, and a lace that extends from the housing through the pluralities of lateral and medial lace retainers in a crisscrossing manner across the tongue.

17 Claims, 24 Drawing Sheets

(56) References Cited

U.S. PATENT DOCUMENTS 5,177,882 A * 1/1993 Berger ..... A43C 11/165 36/50.1
5,206,804 A 4/1993 Thies et al.
5,325,613 A 7/1994 Sussmann
5,355,596 A * 10/1994 Sussmann ..... A43C 11/00 36/50.1
5,724,265 A 3/1998 Hutchings
5,839,210 A 11/1998 Bernier et al.
5,955,667 A 9/1999 Fyfe
5,983,530 A 11/1999 Chou
6,018,705 A 1/2000 Gaudet et al.
6,032,387 A 3/2000 Johnson
6,052,654 A 4/2000 Gaudet et al.
6,202,953 B1 3/2001 Hammerslag
6,289,558 B1 9/2001 Hammerslag
6,427,361 B1 8/2002 Chou
6,430,843 B1 8/2002 Potter et al.
6,691,433 B2 2/2004 Liu
6,865,825 B2 3/2005 Bailey, Sr. et al.
6,876,947 B1 4/2005 Darley et al.
6,882,955 B1 4/2005 Ohlenbusch et al.
6,892,477 B2 5/2005 Potter et al.
6,978,684 B2 12/2005 Nurse
7,082,701 B2 8/2006 Dalgaard et al.
7,096,559 B2 8/2006 Johnson
7,188,439 B2 3/2007 DiBenedetto et al.
7,310,895 B2 12/2007 Whittlesey et al.
7,503,131 B2 3/2009 Nadel et al.
7,607,243 B2 10/2009 Berner, Jr. et al.
7,721,468 B1 5/2010 Johnson et al.
7,752,774 B2 7/2010 Ussher
7,794,101 B2 9/2010 Galica et al.
D648,110 S 11/2011 Rasmussen
8,046,937 B2 11/2011 Beers et al.
8,056,269 B2 11/2011 Beers et al.
8,058,837 B2 11/2011 Beers et al.
8,061,061 B1 11/2011 Rivas
8,074,379 B2 12/2011 Robinson, Jr. et al.
8,277,401 B2 10/2012 Hammerslag et al.
8,387,282 B2 3/2013 Baker et al.
8,424,168 B2 4/2013 Soderberg et al.
8,468,657 B2 6/2013 Soderberg et al.
8,474,146 B2 7/2013 Hartford et al.
8,516,662 B2 8/2013 Goodman et al.
D689,684 S 9/2013 McMillan
8,522,456 B2 9/2013 Beers et al.
8,528,235 B2 9/2013 Beers et al.
8,676,541 B2 3/2014 Schrock et al.
8,678,541 B2 3/2014 Uchiyama
8,713,820 B2 5/2014 Kerns et al.
8,739,639 B2 6/2014 Owings et al.
8,769,844 B2 7/2014 Beers et al.
D718,036 S 11/2014 McMillan
8,904,672 B1 12/2014 Johnson
8,904,673 B2 12/2014 Johnson et al.
8,935,860 B2 1/2015 Torres
9,072,341 B2 7/2015 Jungkind
D740,538 S 10/2015 Roulo
9,149,089 B2 10/2015 Cotterman et al.
9,204,690 B1 12/2015 Alt et al.
D746,558 S 1/2016 Campbell et al.
9,241,539 B1 1/2016 Keswin
9,248,040 B2 2/2016 Soderberg et al.
D750,879 S 3/2016 Klein et al.
9,301,573 B2 4/2016 Jasmine
9,307,804 B2 4/2016 Beers et al.
D756,621 S 5/2016 Weddle
9,326,566 B2 5/2016 Beers et al.
9,365,387 B2 6/2016 Beers et al.
9,380,834 B2 7/2016 Rushbrook et al.
D768,977 S 10/2016 Seamarks et al.
9,462,844 B2 10/2016 Schrock et al.
9,532,893 B2 1/2017 Beers et al.
9,578,926 B2 2/2017 Alt et al.
9,609,918 B2 4/2017 Beers
9,610,185 B2 4/2017 Capra et al.
9,629,418 B2 4/2017 Rushbrook et al.
9,693,605 B2 7/2017 Beers
9,706,814 B2 7/2017 Converse et al.
9,756,895 B2 9/2017 Rice et al.
9,763,489 B2 9/2017 Amos et al.
9,848,674 B2 12/2017 Smith et al.
9,861,164 B2 1/2018 Beers et al.
9,861,165 B2 1/2018 Schneider et al.
9,867,417 B2 1/2018 Beers et al.
9,872,539 B2 1/2018 Beers
9,907,359 B2 3/2018 Beers
9,918,516 B1 3/2018 Hall
9,918,865 B2 3/2018 Nickel et al.
D814,776 S 4/2018 Odinot
D815,413 S 4/2018 Weddle
9,943,139 B2 4/2018 Beers et al.
9,961,963 B2 5/2018 Schneider et al.
9,993,046 B2 6/2018 Bock
10,004,295 B2 6/2018 Gerber
10,010,129 B2 7/2018 Beers et al.
10,034,512 B2 7/2018 Rushbrook et al.
10,046,942 B2 8/2018 Beers et al.
10,070,681 B2 9/2018 Beers et al.
10,070,683 B2 9/2018 Rushbrook et al.
10,076,462 B2 9/2018 Johnson et al.
D829,425 S 10/2018 Albrecht et al.
10,085,517 B2 10/2018 Beers et al.
10,092,065 B2 10/2018 Rushbrook et al.
10,102,722 B2 10/2018 Levesque et al.
10,104,937 B2 10/2018 Beers et al.
10,111,496 B2 10/2018 Schneider et al.
10,201,212 B2 2/2019 Beers et al.
10,231,505 B2 3/2019 Beers et al.
10,238,180 B2 3/2019 Beers et al.
10,441,020 B1 10/2019 Andon et al.
11,000,099 B2 5/2021 Beers et al.
11,044,968 B2 6/2021 Beers
2003/0009913 A1 1/2003 Potter et al.
2003/0150135 A1 8/2003 Liu
2004/0177531 A1 9/2004 DiBenedetto et al.
2005/0081403 A1 4/2005 Mathieu
2005/0183292 A1 8/2005 DiBenedetto et al.
2005/0198867 A1 9/2005 Labbe
2006/0000116 A1 1/2006 Brewer
2006/0103538 A1 5/2006 Daniel
2007/0000154 A1 1/2007 DiBenedetto et al.
2007/0006489 A1 1/2007 Case et al.
2007/0129907 A1 6/2007 Demon
2007/0164521 A1 7/2007 Robinson
2007/0260421 A1 11/2007 Berner et al.
2007/0271817 A1 11/2007 Ellis
2008/0066272 A1 3/2008 Hammerslag et al.
2008/0196224 A1* 8/2008 Hu ..... A43C 11/16 24/68 SK
2008/0301919 A1 12/2008 Ussher
2009/0184189 A1* 7/2009 Soderberg ..... A43B 3/0042 242/395
2009/0193689 A1 8/2009 Galica et al.
2009/0272007 A1 11/2009 Beers et al.
2009/0272013 A1 11/2009 Beers et al.
2010/0063778 A1 3/2010 Schrock et al.
2010/0063779 A1 3/2010 Schrock et al.
2010/0139057 A1 6/2010 Soderberg et al.
2010/0289971 A1 11/2010 Odland et al.
2011/0025704 A1 2/2011 Odland et al.
2011/0175744 A1 7/2011 Englert et al.
2011/0225843 A1 9/2011 Kerns et al.
2011/0232134 A1 9/2011 Radl et al.
2011/0266384 A1* 11/2011 Goodman ..... B65H 75/4431 29/434
2012/0000091 A1 1/2012 Cotterman et al.
2012/0004587 A1 1/2012 Nickel et al.
2012/0067665 A1 3/2012 Chae et al.
2012/0124500 A1 5/2012 Hunter
2012/0185801 A1 7/2012 Madonna et al.
2013/0092780 A1 4/2013 Soderberg et al.
2013/0104429 A1 5/2013 Torres
2013/0213147 A1 8/2013 Rice et al.

(56) References Cited

U.S. PATENT DOCUMENTS

| | | | | |
|---|---|---|---|---|
| 2013/0312293 | A1 | 11/2013 | Gerber | |
| 2014/0068838 | A1 | 3/2014 | Beers et al. | |
| 2014/0070042 | A1 | 3/2014 | Beers et al. | |
| 2014/0082963 | A1 | 3/2014 | Beers | |
| 2014/0257156 | A1 | 9/2014 | Capra et al. | |
| 2014/0292396 | A1 | 10/2014 | Bruwer et al. | |
| 2015/0007422 | A1 | 1/2015 | Cavanagh et al. | |
| 2015/0185764 | A1 | 7/2015 | Magi | |
| 2015/0250268 | A1 | 9/2015 | Alt et al. | |
| 2015/0289594 | A1 | 10/2015 | Rushbrook et al. | |
| 2015/0289609 | A1* | 10/2015 | Gittens | A43C 1/06 24/714.6 |
| 2015/0312660 | A1 | 10/2015 | Lembacher et al. | |
| 2016/0027297 | A1 | 1/2016 | Wu et al. | |
| 2016/0157561 | A1 | 6/2016 | Schum et al. | |
| 2016/0213099 | A1* | 7/2016 | Ha | A43C 11/20 |
| 2016/0256349 | A1 | 9/2016 | Mayer et al. | |
| 2016/0262485 | A1 | 9/2016 | Walker | |
| 2016/0345654 | A1 | 12/2016 | Beers et al. | |
| 2016/0345679 | A1 | 12/2016 | Beers et al. | |
| 2016/0345681 | A1 | 12/2016 | Pheil et al. | |
| 2016/0360828 | A1 | 12/2016 | Guyan | |
| 2017/0035151 | A1 | 2/2017 | Peyton et al. | |
| 2017/0150773 | A1 | 6/2017 | Beers | |
| 2017/0215524 | A1 | 8/2017 | Rushbrook et al. | |
| 2017/0265559 | A1 | 9/2017 | Beers | |
| 2017/0265572 | A1 | 9/2017 | Beers et al. | |
| 2017/0265573 | A1 | 9/2017 | Beers et al. | |
| 2017/0265574 | A1 | 9/2017 | Beers et al. | |
| 2017/0265575 | A1 | 9/2017 | Beers et al. | |
| 2017/0265576 | A1 | 9/2017 | Beers et al. | |
| 2017/0265577 | A1 | 9/2017 | Schneider | |
| 2017/0265578 | A1 | 9/2017 | Schneider | |
| 2017/0265579 | A1 | 9/2017 | Schneider et al. | |
| 2017/0265580 | A1 | 9/2017 | Schneider et al. | |
| 2017/0265581 | A1 | 9/2017 | Chang | |
| 2017/0265582 | A1 | 9/2017 | Walker et al. | |
| 2017/0265583 | A1 | 9/2017 | Schneider et al. | |
| 2017/0265584 | A1 | 9/2017 | Walker et al. | |
| 2017/0265585 | A1 | 9/2017 | Orand | |
| 2017/0265586 | A1 | 9/2017 | Schneider et al. | |
| 2017/0265587 | A1 | 9/2017 | Walker et al. | |
| 2017/0265588 | A1 | 9/2017 | Walker et al. | |
| 2017/0265589 | A1 | 9/2017 | Walker et al. | |
| 2017/0265591 | A1 | 9/2017 | Schneider | |
| 2017/0265594 | A1 | 9/2017 | Walker et al. | |
| 2017/0267485 | A1 | 9/2017 | Schneider et al. | |
| 2017/0272008 | A1 | 9/2017 | Schneider | |
| 2017/0295889 | A1 | 10/2017 | Beers | |
| 2017/0303643 | A1 | 10/2017 | Converse et al. | |
| 2017/0312161 | A1 | 11/2017 | Johnson et al. | |
| 2017/0318908 | A1 | 11/2017 | Wyatt et al. | |
| 2017/0325548 | A1* | 11/2017 | Ha | A43C 11/165 |
| 2017/0332734 | A1 | 11/2017 | Orand | |
| 2017/0332735 | A1 | 11/2017 | Orand et al. | |
| 2017/0340049 | A1 | 11/2017 | Rice et al. | |
| 2018/0020764 | A1 | 1/2018 | Walker | |
| 2018/0035760 | A1 | 2/2018 | Bock | |
| 2018/0110288 | A1 | 4/2018 | Hatfield et al. | |
| 2018/0110294 | A1 | 4/2018 | Schneider et al. | |
| 2018/0110298 | A1 | 4/2018 | Schneider et al. | |
| 2018/0116326 | A1 | 5/2018 | Beers et al. | |
| 2018/0125168 | A1 | 5/2018 | Beers et al. | |
| 2018/0153260 | A1 | 6/2018 | Beers | |
| 2018/0153263 | A1 | 6/2018 | Beers et al. | |
| 2018/0199674 | A1 | 7/2018 | Walker et al. | |
| 2018/0219403 | A1 | 8/2018 | Schneider | |
| 2018/0228250 | A1 | 8/2018 | Beers et al. | |
| 2018/0263340 | A1 | 9/2018 | Schneider et al. | |
| 2018/0289110 | A1 | 10/2018 | Bock et al. | |
| 2018/0310644 | A1 | 11/2018 | Poupyrev et al. | |
| 2018/0310659 | A1 | 11/2018 | Poupyrev et al. | |
| 2018/0310670 | A1 | 11/2018 | Rovekamp, Jr. et al. | |
| 2018/0317609 | A1 | 11/2018 | Beers et al. | |
| 2018/0343977 | A1 | 12/2018 | Riccomini et al. | |
| 2018/0343978 | A1 | 12/2018 | Stillman et al. | |
| 2018/0368526 | A1 | 12/2018 | Bock et al. | |
| 2018/0368528 | A1 | 12/2018 | Beers et al. | |
| 2019/0246745 | A1 | 8/2019 | Bock et al. | |
| 2019/0246746 | A1* | 8/2019 | Bock | A43B 3/34 |
| 2019/0246747 | A1 | 8/2019 | Bock et al. | |
| 2021/0162120 | A1 | 6/2021 | Prudden et al. | |
| 2021/0235819 | A1 | 8/2021 | Andreasen | |
| 2021/0383784 | A1 | 12/2021 | Leatherdale et al. | |

FOREIGN PATENT DOCUMENTS

| | | | | |
|---|---|---|---|---|
| CN | 201222723 | Y | 4/2009 | |
| CN | 102058197 | A | 5/2011 | |
| CN | 202907266 | U | 4/2013 | |
| CN | 104585975 | A | 5/2015 | |
| CN | 104822284 | A | 8/2015 | |
| CN | 105278768 | A | 1/2016 | |
| DE | 3932023 | A1 * | 4/1991 | A43C 11/16 |
| DE | 29701491 | U1 | 5/1998 | |
| DE | 29817003 | U1 | 3/1999 | |
| DE | 19833801 | A1 | 2/2000 | |
| DE | 102005014709 | A1 | 10/2006 | |
| DE | 102005036013 | A1 | 2/2007 | |
| DE | 102005052903 | A1 | 5/2007 | |
| EP | 0255869 | A2 * | 2/1988 | A43C 11/16 |
| EP | 0614624 | A1 | 9/1994 | |
| EP | 2871994 | A1 | 5/2015 | |
| EP | 3046434 | A1 | 7/2016 | |
| FR | 2770379 | A1 | 5/1999 | |
| FR | 2924577 | A1 | 6/2009 | |
| GB | 2449722 | A | 12/2008 | |
| JP | 3005659 | U | 1/1995 | |
| JP | 3195320 | B2 | 8/2001 | |
| JP | 2004267784 | A | 9/2004 | |
| JP | 2004275201 | A | 10/2004 | |
| JP | 2009011460 | A | 1/2009 | |
| JP | 2011519611 | A | 7/2011 | |
| JP | 5486203 | B2 | 5/2014 | |
| JP | 2016530058 | A | 9/2016 | |
| JP | 2018529479 | A | 10/2018 | |
| KR | 100398822 | B1 | 9/2003 | |
| KR | 20050122149 | A | 12/2005 | |
| WO | 9811797 | A1 | 3/1998 | |
| WO | 2007081822 | A2 | 7/2007 | |
| WO | 2008033963 | A2 | 3/2008 | |
| WO | 2009134858 | A1 | 11/2009 | |
| WO | 2012109244 | A1 | 8/2012 | |
| WO | 2014036374 | A1 | 3/2014 | |
| WO | 2014082652 | A1 | 6/2014 | |
| WO | 2015014374 | A1 | 2/2015 | |
| WO | 2015042216 | A1 | 3/2015 | |
| WO | 2015045598 | A1 | 4/2015 | |
| WO | 2015056633 | A1 | 4/2015 | |
| WO | 2015160406 | A1 | 10/2015 | |
| WO | 2015160768 | A1 | 10/2015 | |
| WO | 2015160790 | A1 | 10/2015 | |
| WO | 2015163982 | A1 | 10/2015 | |
| WO | 2016057697 | A1 | 4/2016 | |
| WO | 2016191115 | A1 | 12/2016 | |
| WO | 2016191117 | A1 | 12/2016 | |
| WO | 2016191123 | A1 | 12/2016 | |
| WO | 2016195957 | A1 | 12/2016 | |
| WO | 2016195965 | A1 | 12/2016 | |
| WO | 2017059876 | A1 | 4/2017 | |
| WO | 2017091769 | A1 | 6/2017 | |
| WO | 2017092775 | A1 | 6/2017 | |
| WO | 2017095945 | A1 | 6/2017 | |
| WO | 2017158410 | A1 | 9/2017 | |
| WO | 2017160534 | A2 | 9/2017 | |
| WO | 2017160536 | A2 | 9/2017 | |
| WO | 2017160558 | A2 | 9/2017 | |
| WO | 2017160561 | A2 | 9/2017 | |
| WO | 2017160563 | A2 | 9/2017 | |
| WO | 2017160657 | A2 | 9/2017 | |
| WO | 2017160708 | A2 | 9/2017 | |
| WO | 2017160865 | A1 | 9/2017 | |
| WO | 2017160866 | A1 | 9/2017 | |
| WO | 2017160881 | A1 | 9/2017 | |

(56) References Cited

FOREIGN PATENT DOCUMENTS

| | | | |
|---|---|---|---|
| WO | 2017160969 | A1 | 9/2017 |
| WO | 2017161000 | A2 | 9/2017 |
| WO | 2017161014 | A1 | 9/2017 |
| WO | 2017161037 | A1 | 9/2017 |
| WO | 2017161044 | A1 | 9/2017 |
| WO | 2017164612 | A1 | 9/2017 |
| WO | 2017185160 | A1 | 11/2017 |
| WO | 2017189926 | A1 | 11/2017 |
| WO | 2017197627 | A1 | 11/2017 |
| WO | 2017091769 | A8 | 1/2018 |
| WO | 2018028380 | A1 | 2/2018 |
| WO | 2018028381 | A1 | 2/2018 |
| WO | 2018081260 | A1 | 5/2018 |
| WO | 2018094156 | A1 | 5/2018 |
| WO | 2018095500 | A1 | 5/2018 |
| WO | 2018095501 | A1 | 5/2018 |
| WO | 2018120085 | A1 | 7/2018 |
| WO | 2017161000 | A3 | 8/2018 |
| WO | 2018170148 | A2 | 9/2018 |
| WO | 2018170148 | A3 | 11/2018 |
| WO | 2018222805 | A2 | 12/2018 |
| WO | 2018222807 | A2 | 12/2018 |
| WO | 2018222836 | A2 | 12/2018 |

OTHER PUBLICATIONS

International search report issued in corresponding International Application No. PCT/EP2015/001963, dated Aug. 9, 2016, 5 pages.

International search report issued in corresponding International Application No. PCT/EP2016/001967, dated Jul. 26, 2017, 7 pages.

International search report issued in corresponding International Application No. PCT/EP2016/001968, dated Jul. 31, 2017, 6 pages.

Invitation to Pay Additional Fees and Communication Relating to Results of Partial International Search Report from corresponding PCT Application No. PCT/IB2020/058424 dated Dec. 8, 2020 (12 pages).

Office Action from corresponding Japanese Application No. 2021-562055 dated Mar. 26, 2023 (9 pages) with English translation.

Notice of Reasons for Refusal issued in Japanese Application No. 2018-524270, dated Dec. 3, 2019, 9 pages.

International Search Report and Written Opinion of International Application No. PCT/IB2020/053777, dated Jun. 18, 2020, 12 pages.

International Search Report and Written Opinion of International Application No. PCT/IB2020/053778, dated Jun. 18, 2020, 14 pages.

The First Office Action issued in corresponding Chinese Application No. 201680091000.4, dated Jun. 5, 2020, 19 pages.

First Office Action from corresponding Chinese Patent Application No. 201680091016.5, dated Oct. 22, 2020 (15 pages).

The First Office Action issued in corresponding Chinese Application No. 201580084987.2, dated May 6, 2020, 17 pages.

Extended European Search Report of European Patent Application 20721799.3 mailed Aug. 4, 2022 (8 pages).

Japanese Office Action from corresponding Japanese Patent Application No. 2019-525884, dated Aug. 25, 2020 (English translation included) (8 pages).

* cited by examiner

ARTICLE OF FOOTWEAR HAVING AN AUTOMATIC LACING SYSTEM

CROSS REFERENCE TO RELATED APPLICATIONS

Not applicable.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including an automatic lacing system for tightening or loosening a lace.

2. Description of the Background

Many conventional shoes or articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface of the upper and is positioned between the upper and the ground. As a result, the sole typically provides stability and cushioning to the user when the shoe is being worn and/or is in use. In some instances, the sole may include multiple components, such as an outsole, a midsole, and an insole. The outsole may provide traction to a bottom surface of the sole, and the midsole may be attached to an inner surface of the outsole, and may provide cushioning and/or added stability to the sole. For example, a sole may include a particular foam material that may increase stability at one or more desired locations along the sole, or a foam material that may reduce stress or impact energy on the foot and/or leg when a user is running, walking, or engaged in another activity.

The upper generally extends upward from the sole and defines an interior cavity that completely or partially encases a foot. In most cases, an upper extends over instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, the tongue being provided to allow for adjustment of shoe tightness. The tongue may further be manipulable by a user to permit entry and/or exit of a foot from the internal space or cavity. In addition, the lacing system may allow a user to adjust certain dimensions of the upper and/or the sole, thereby allowing the upper to accommodate a wide variety of foot types having varying sizes and shapes.

The upper may comprise a wide variety of materials, which may be chosen based on one or more intended uses of the shoe. The upper may also include portions comprising varying materials specific to a particular area of the upper.

For example, added stability may be desirable at a front of the upper or next to a heel region so as to provide a higher degree of resistance or rigidity. In contrast, other portions of a shoe may include a soft woven textile to provide an area with stretch-resistance, flexibility, air-permeability, or moisture-wicking properties.

Further, lacing systems associated with typical shoes historically have included a single lace that is drawn through a plurality of eyelets in a crisscrossing or parallel manner. Many shoes have historically included laces that extend from one side of the upper to another side, i.e., from the medial side to the lateral side of the upper. The lace for each shoe is laced through the eyelets and the two ends of the lace extend out of the eyelets such that a user can grasp the ends and tie the shoe in a manner that the user sees fit. Some shoes utilize ghillies rather than eyelets, the ghillies being disposed near the tongue on the medial and lateral sides of the upper. The lace for each shoe is laced through the plurality of ghillies in a crisscrossing or parallel manner. Some shoes do not require a user to tie the laces, but rather include laces that are stretchable such that the laces can be stretched when a user puts the shoe on, and can return to an original tightness once the user has taken the shoe off.

Still further, some shoes do not include laces, such as slip on shoes, and some shoes include straps that can be adjusted to vary the tightness of the shoe. With respect to shoes that do include laces, it may be desirable to utilize a system that can automatically lace the shoes, for example, in situations where a user may desire adjustability of laces in differing circumstances. It also may be desirable to have an automatic lacing system for users who have difficulty tying shoes, such as the elderly or the infirm. It may also be desirable to include a lacing system where the laces apply forces along a top of the foot and along the medial and lateral sides of the foot. Still further, it may be desirable to include a system by which the shoes can be automatically laced via a graphical user interface displayed on a portable electronic device.

Therefore, articles of footwear having uppers with automatic lacing systems may be desired.

SUMMARY

An article of footwear, as described herein, may have various configurations. In some embodiments, the present disclosure provides a lacing system for an article of footwear including a sole structure, an upper that is attached to the sole structure and having a lateral side, a medial side, and a tongue, and a housing that is disposed on the tongue. A lateral side flap extends from the sole structure and along the lateral side of the upper toward the tongue, such that an upper end of the lateral side flap is next to a lateral side of the tongue. A medial side flap extends from the sole structure and along the medial side of the upper toward the tongue, such that an upper end of the medial side flap is next to a medial side of the tongue. A plurality of lateral lace retainers is disposed along the upper end of the lateral side flap, and a plurality of medial lace retainers is disposed along the upper end of the medial side flap. A lace extends from the housing through the plurality of lateral lace retainers and the plurality of medial lace retainers in a crisscrossing manner across the tongue. A plurality of lace channels defined by the tongue are configured to receive portions of the lace extending though the plurality of lateral and medial lace retainers.

In some embodiments, the housing may define a lateral aperture and a medial aperture, and the lace may extend through the lateral aperture, the medial aperture, and the plurality of lateral and medial lace retainers. In some embodiments, the plurality of lateral lace retainers includes a first, a second, and a third lateral lace retainer and the plurality of medial lace retainers includes a first, a second, and a third medial lace retainer. The lace may extend from the housing in a first direction through the lateral aperture of the housing, through the first lateral lace retainer, across the tongue in a second direction, opposite the first direction, and through the second medial lace retainer, across the tongue in the first direction and through the third lateral lace retainer, across the tongue in the second direction and through the third medial lace retainer, across the tongue in the first direction and through the second lateral lace retainer, across the tongue in the second direction and through the first medial lace retainer, and in the first direction through the medial aperture of the housing. In some embodiments, the tongue may define a housing recess configured to receive the housing, and the plurality of lace channels of the tongue can be configured to receive portions of the lace extending through the lateral and medial apertures of the housing and the plurality of lateral and medial lace retainers.

In some embodiments, the housing is configured to draw the lace into the housing. When the lace is drawn into the housing, the lateral side flap is pulled inward toward the lateral side of the upper, the medial side flap is pulled inward toward the medial side of the upper, and the tongue is pulled downward toward the sole structure. In some embodiments, the plurality of lateral and medial lace retainers include an elongated lace aperture configured to retain portions of the lace extending through the lateral and medial lace retainers at an angle relative to portions of the lace extending from the lateral and medial lace retainers across the tongue. In some embodiments the housing may include a motor and a gear train having a wheel gear disposed within a base of the housing, and an upper extension of the wheel gear disposed on a base cover of the housing. The upper extension of the wheel gear can be configured to receive a portion of the lace received through the lateral and medial apertures defined by a top cover of the housing, and when the motor drives the gear train, the lace is drawn into the housing. In some embodiments, the lacing system may include a controller disposed within the sole structure of the article of footwear. The controller can include a battery, and the controller can be electrically connected to the housing and power the motor. In some embodiments, the housing can include a swipe sensor disposed on the base cover of the housing and along a panel of the top cover of the housing. The swipe panel can be powered by the battery of the controller and be operable to receive user inputs. In some embodiments the controller is removable from the sole structure via an opening in the upper of the article of footwear.

In some embodiments, the lacing system for an article of footwear includes a sole structure, an upper attached to the sole structure including a tongue, a housing disposed on the tongue and next to an instep region of the upper, a plurality of lateral lace retainers disposed on the upper next to a lateral side of the tongue, and a plurality of medial lace retainers disposed on the upper next to a medial side of the tongue. A lace extends from the housing and through the plurality of lateral lace retainers and the plurality of medial lace retainers in a crisscrossing manner across the tongue. A plurality of lace channels is defined by the tongue and is configured to receive portions of the lace extending though the plurality of lateral lace retainers and the plurality of medial lace retainers. The housing disposed on the tongue is configured to draw the lace into the housing. In some embodiments, the tongue is pulled downward, toward the sole structure when the lace is drawn into the housing. In some embodiments, a lace channel is defined in the housing and is configured to receive two or more portions of the lace extending through the plurality of lateral and medial lace retainers, and a housing recess is defined in the tongue that is configured to receive the housing. The plurality of lace channels of the tongue can be configured to receive portions of the lace extending through the plurality of lateral and medial lace retainers and the lace channel of the housing. In some embodiments, the lace is a closed loop lace.

In some embodiments, the lacing system for an article of footwear includes a sole structure having an insole, a midsole, and an outsole, an upper attached to the sole structure, a housing disposed along the upper next to an instep region of the upper, a lateral side flap extending from the sole structure along a lateral side of the upper toward the housing and having an upper end being next to a lateral side of the instep region, and a medial side flap extending from the sole structure along a medial side of the upper toward the housing and having an upper end being next to a lateral side of the instep region. A plurality of lateral lace retainers is disposed along the upper end of the lateral side flap, and a plurality of medial lace retainers is disposed along the upper end of the medial side flap. A lace extends from the housing through the plurality of lateral and medial lace retainers. The lateral and medial lace retainers include an elongated lace aperture configured to retain portions of the lace extending through the lateral and medial lace retainers at an angle relative to the portions of the lace extending from the lateral and medial lace retainers. A plurality of lace channels is defined by a portion of the upper and are configured to receive portions of the lace extending through the plurality of lateral and medial lace retainers. The housing includes a motor and a gear train having a wheel gear with an aperture configured to receive a portion of the lace. The lace is drawn into the housing when the motor drives the gear train.

Other aspects of the articles of footwear described herein, including features and advantages thereof, will become apparent to one of ordinary skill in the art upon examination of the figures and detailed description herein. Therefore, all such aspects of the articles of footwear are intended to be included in the detailed description and this summary.

DETAILED DESCRIPTION OF THE DRAWINGS

Figure 1:
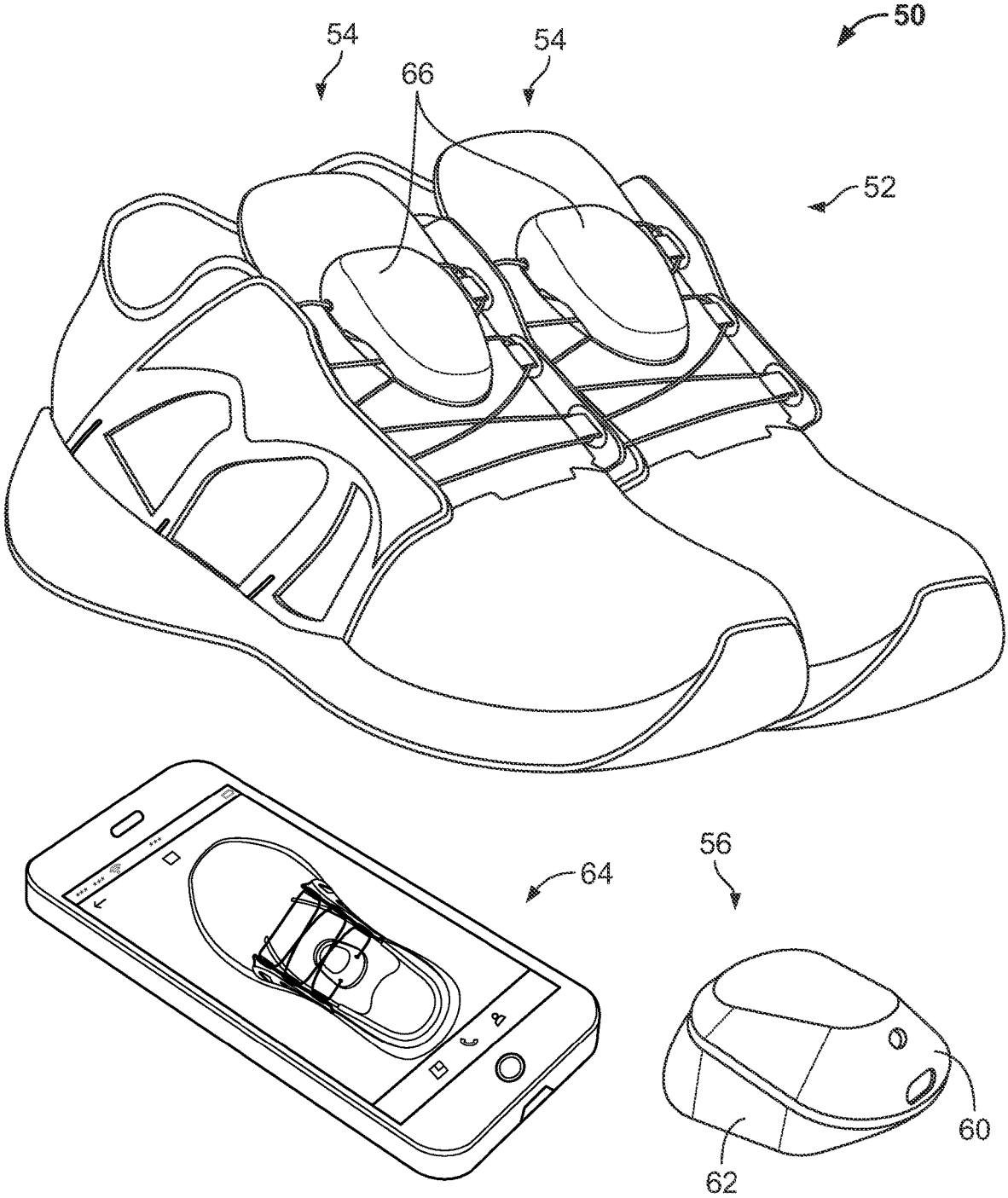
FIG. 1 is a perspective view of an automatic lacing footwear assembly, in accordance with the present disclosure.

The following discussion and accompanying figures disclose various embodiments or configurations of a shoe and an automatic lacing system for the shoe. Although embodiments are disclosed with reference to a sports shoe, such as a running shoe, tennis shoe, basketball shoe, etc., concepts associated with embodiments of the shoe may be applied to a wide range of footwear and footwear styles, including basketball shoes, cross-training shoes, football shoes, golf shoes, hiking shoes, hiking boots, ski and snowboard boots, soccer shoes and cleats, walking shoes, and track cleats, for example. Concepts of the shoe or the automatic lacing system may also be applied to articles of footwear that are considered non-athletic, including dress shoes, sandals, loafers, slippers, and heels. In addition to footwear, particular concepts described herein, such as the automatic lacing concept, may also be applied and incorporated in other types of articles, including apparel or other athletic equipment, such as helmets, padding or protective pads, shin guards, and gloves. Even further, particular concepts described herein may be incorporated in cushions, backpacks, suitcases, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes. The term "swipe" or variations thereof used herein refers to an act or instance of moving one's finger(s) across a panel or touchscreen to activate a function. A "swipe" involves touching a panel or touchscreen, moving one's finger along the panel or touchscreen in a first direction, and subsequently removing contact of one's finger with the panel or touchscreen. The term "tap" or variations thereof used herein refers to an act or instance of pressing one's finger on a panel or touchscreen to activate a function. A "tap" involves pressing a panel or touchscreen, holding one's finger on the panel or touchscreen for a brief period of time, and subsequently removing contact of one's finger with the panel or touchscreen.

The present disclosure is directed to an article of footwear and/or specific components of the article of footwear, such as an upper and/or a sole or sole structure, and an automatic lacing system. The upper may comprise a knitted component, a woven textile, a non-woven textile, leather, mesh, suede, and/or a combination of one or more of the aforementioned materials. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Referring now to the figures, FIG. 1 depicts a footwear assembly 50 that includes a pair of shoes 52, each of which includes an automatic lacing system 54, a pair of charging pucks 56, including a first charging puck 60 and a second charging puck 62 for charging one or more batteries (not shown) that are disposed within each of the shoes 52, and an electronic device 64. The electronic device 64 may be a cellular phone or tablet, which can be used to send one or more signals to the automatic lacing system 54 based on one or more inputs from a user. The footwear assembly 50 may include additional components not specifically addressed herein.

As discussed in greater detail hereinafter below, the footwear assembly 50 is intended to allow a user to tighten or loosen each of the shoes 52 by swiping, tapping, pressing, or applying a pressure to a control or swipe panel 66 (see FIG. 2) of the automatic lacing system 54. As non-limiting examples, a user can swipe down along the panel 66 of the automatic lacing system 54 to close or tighten shoes 52 of the automatic lacing system 54, swipe up to open or loosen the shoes 52, tap an upper end of the panel 66 to incrementally loosen the shoes 52, or tap a lower end of the panel 66 to incrementally tighten the shoes 52. These and other features will be described in greater detail below.

Figure 2:
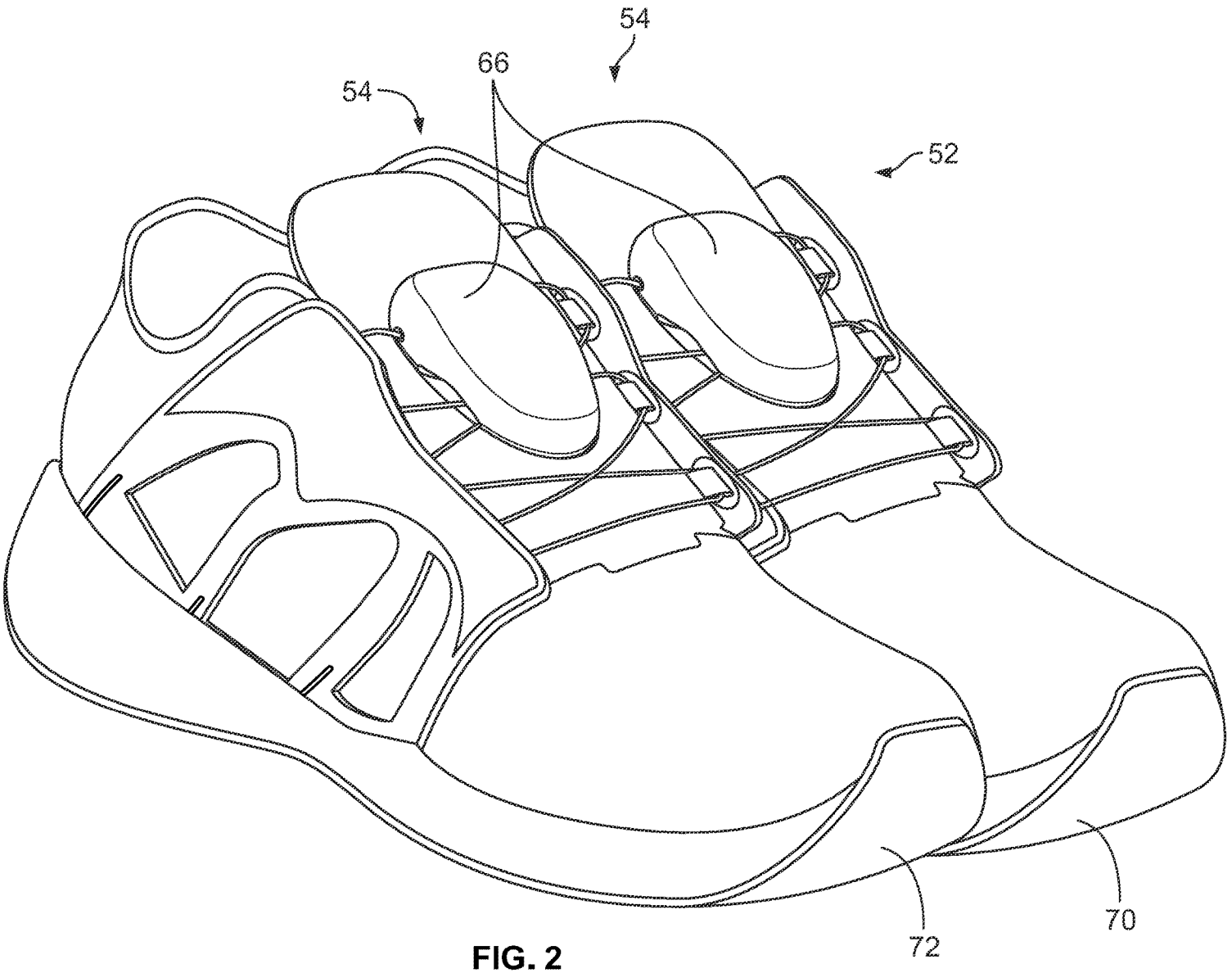
FIG. 2 is a perspective view of the pair of shoes of FIG. 1.
Figure 3:
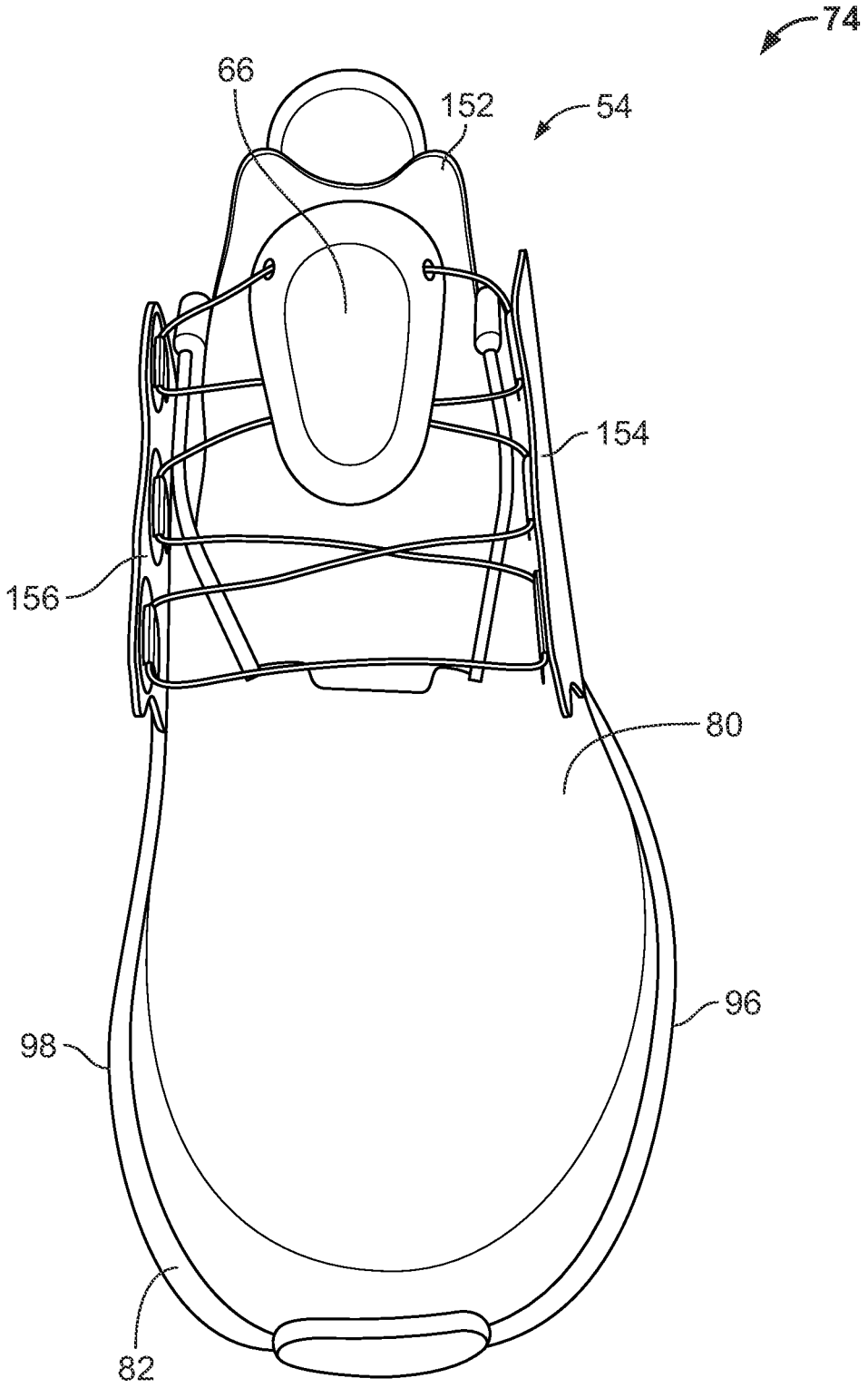
FIG. 3 is a front elevation view of one of the shoes of FIG. 2.

Referring to FIG. 2, the shoes 52 are shown in greater detail. The shoes 52 comprise a first or left shoe 70 and a second or right shoe 72. The left shoe 70 and the right shoe 72 may be similar in all material aspects, except that the left shoe 70 and the right shoe 72 are sized and shaped to receive a left foot and a right foot of a user, respectively. For ease of disclosure, a single shoe or article of footwear 74 (see FIG. 3) will be referenced to describe aspects of the disclosure. In some figures, the article of footwear 74 is depicted as a right shoe, and in some figures the article of footwear is depicted as a left shoe. The disclosure below with reference to the article of footwear 74 is applicable to both the left shoe 70 and the right shoe 72. In some embodiments, there may be differences between the left shoe 70 and the right shoe 72 other than the left/right configuration. For example, in some embodiments, the left shoe 70 may include the automatic lacing system 54, while the right shoe 72 may not include the automatic lacing system 54, or vice versa. Further, in some embodiments, the left shoe 70 may include one or more additional elements that the right shoe 72 does not include, or vice versa. As discussed hereinafter below, the article of footwear 74 need not include the automatic lacing system 54, but rather may be manually laced according to the lacing system disclosed herein.

FIGS. 3-7 depict an exemplary embodiment of the article of footwear 74 including an upper 80 and a sole structure 82. As will be further discussed herein, the upper 80 is attached to the sole structure 82 and together define an interior cavity 84 (see FIGS. 4 and 5) into which a foot of a user may be inserted. For reference, the article of footwear 74 defines a forefoot region 86, a midfoot region 88, and a heel region 90 (see FIGS. 6 and 7). The forefoot region 86 generally corresponds with portions of the article of footwear 74 that encase portions of the foot that include the toes, the ball of the foot, and joints connecting the metatarsals with the toes or phalanges. The midfoot region 88 is proximate and adjoining the forefoot region 86, and generally corresponds with portions of the article of footwear 74 that encase the arch of a foot, along with the bridge of a foot. The heel region 90 is proximate and adjoining the midfoot region 88 and generally corresponds with portions of the article of footwear 74 that encase rear portions of the foot, including the heel or calcaneus bone, the ankle, and/or the Achilles tendon.

Many conventional footwear uppers are formed from multiple elements, e.g., textiles, polymer foam, polymer sheets, leather, and/or synthetic leather, which are joined through bonding or stitching at a seam. In some embodiments, the upper 80 of the article of footwear 74 is formed from a knitted structure or knitted components. In various embodiments, a knitted component may incorporate various types of yarn that may provide different properties to an upper. For example, one area of the upper 80 may be formed from a first type of yarn that imparts a first set of properties, and another area of the upper 80 may be formed from a second type of yarn that imparts a second set of properties. Using this configuration, properties of the upper 80 may vary throughout the upper 80 by selecting specific yarns for different areas of the upper 80.

With reference to the material(s) that comprise the upper 80, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 80.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 80 may also include additional structural elements. For example, in some embodiments, a heel plate or cover (not shown) may be provided on the heel region 90 to provide added support to a heel of a user. In some instances, other elements, e.g., plastic material, logos, trademarks, etc., may also be applied and fixed to an exterior surface using glue or a thermoforming process. In some embodiments, the properties associated with the upper 80, e.g., a stitch type, a yarn type, or characteristics associated with different stitch types or yarn types, such as elasticity, aesthetic appearance, thickness, air permeability, or scuff-resistance, may be varied.

Figure 4:
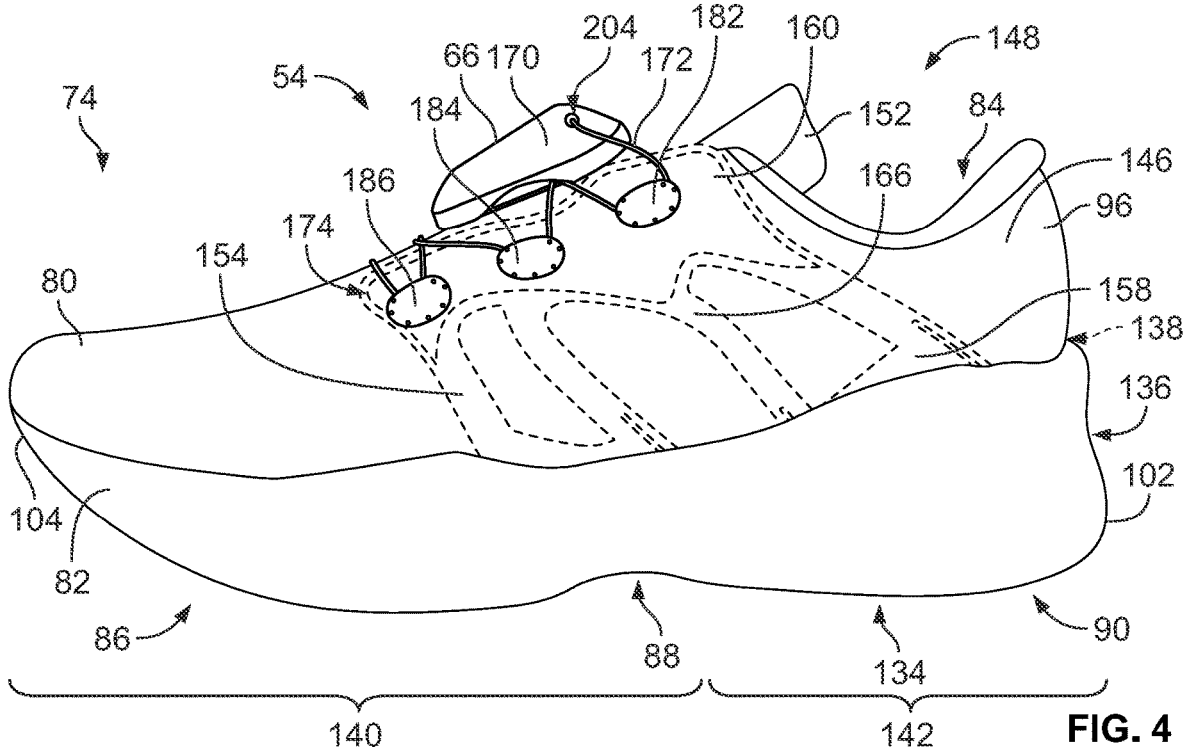
FIG. 4 is a right or lateral side view of the shoe of FIG. 3 with a lateral side flap shown in broken lines.
Figure 5:
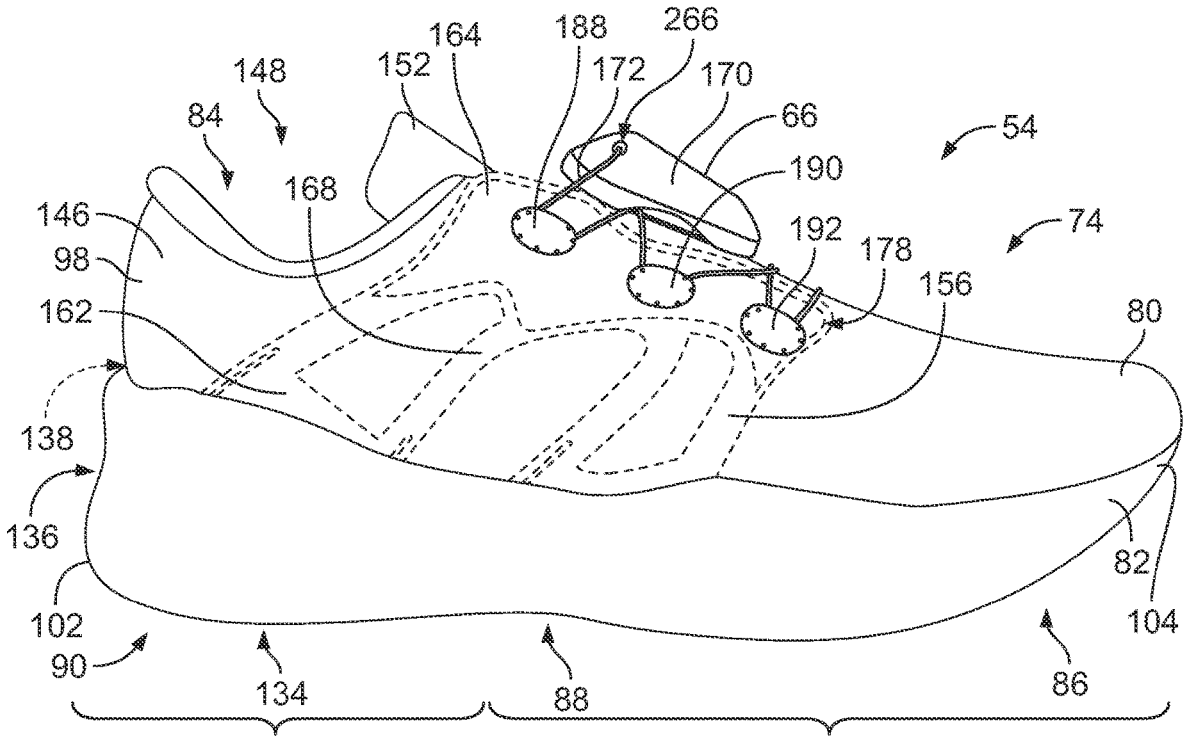
FIG. 5 is a left or medial side view of the shoe of FIG. 3 with a lateral side flap shown in broken lines.

Referring to FIGS. 4 and 5, the article of footwear 74 also defines a lateral side 96 and a medial side 98, the lateral side 96 being shown in FIG. 4 and the medial side 98 being shown in FIG. 5. When a user is wearing the shoes, the lateral side 96 corresponds with an outside-facing portion of the article of footwear 74 while the medial side 98 corresponds with an inside-facing portion of the article of footwear 74. As such, the left shoe 70 and the right shoe 72 have opposing lateral sides 96 and medial sides 98, such that the medial sides 98 are closest to one another when a user is wearing the shoes 52, while the lateral sides 96 are defined as the sides that are farthest from one another while the shoes 52 are being worn. As will be discussed in greater detail below, the medial side 98 and the lateral side 96 adjoin one another at opposing, distal ends of the article of footwear 74.

Figure 6:
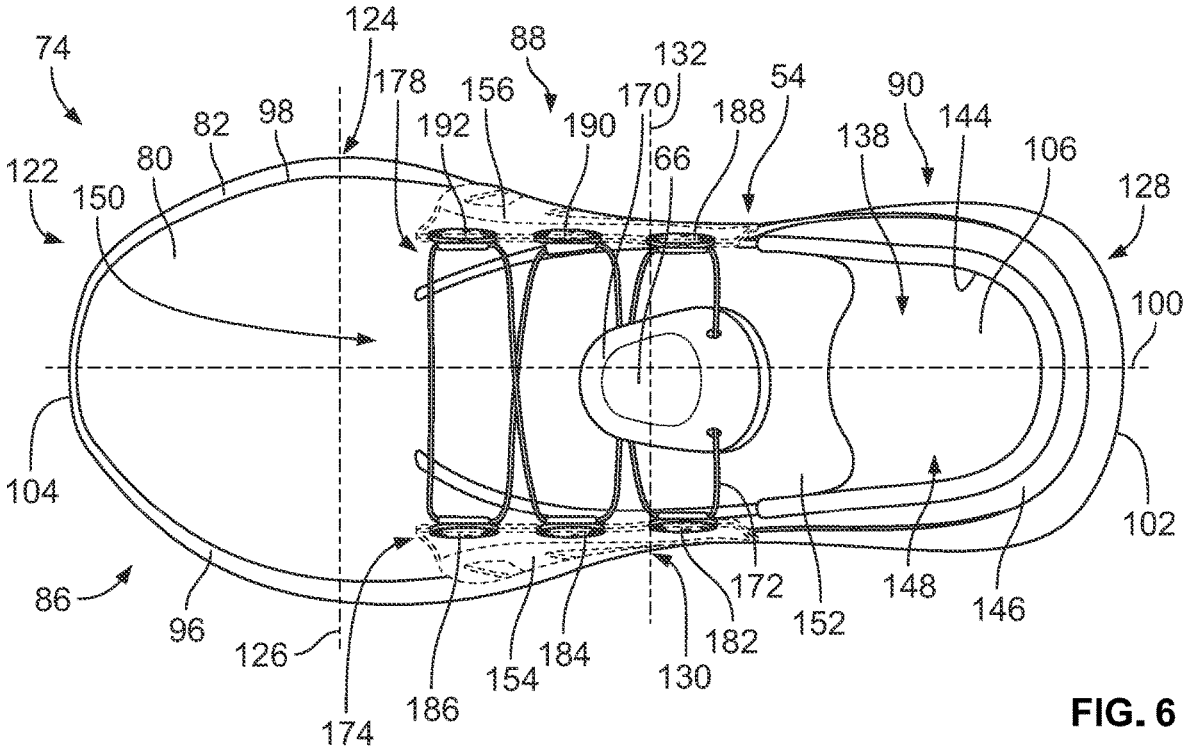
FIG. 6 is a top view of the shoe of FIG. 3.
Figure 7:
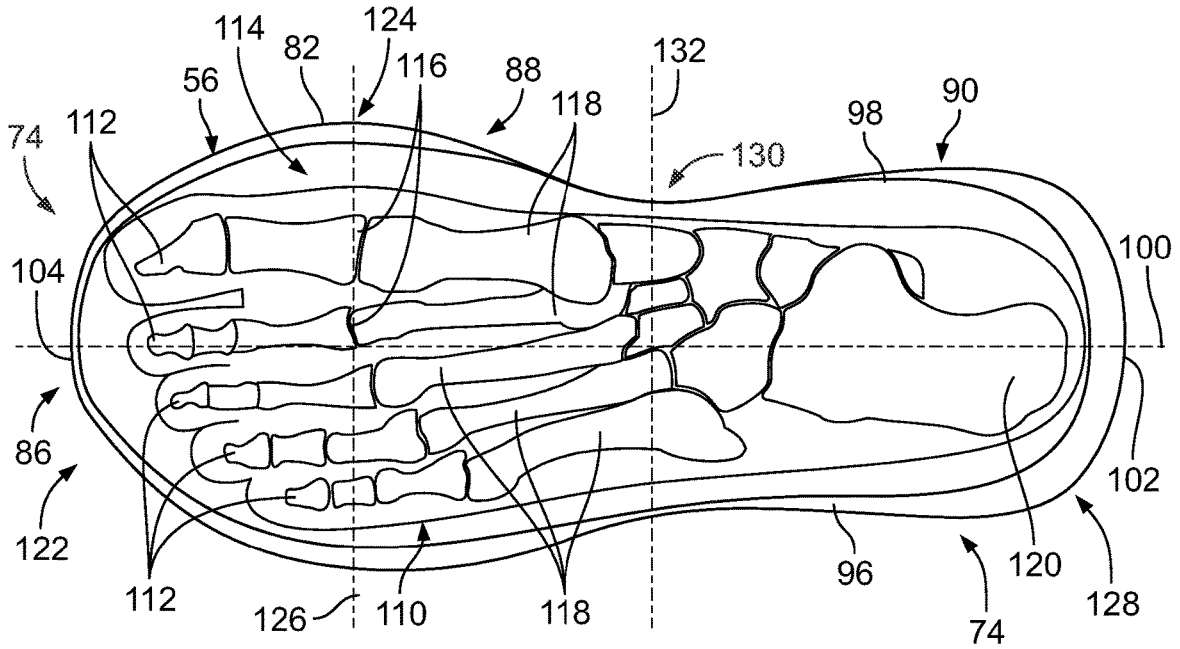
FIG. 7 is a top plan view of the article of footwear of FIG. 3, with an upper removed and a user's skeletal foot structure overlaid thereon.

Referring to FIGS. 6 and 7, the medial side 98 and the lateral side 96 adjoin one another along a longitudinal central plane or axis 100 of the article of footwear 74. As will be further discussed herein, the longitudinal central plane or axis 100 may demarcate a central, intermediate axis between the medial side 98 and the lateral side 96 of the article of footwear 74. Put differently, the longitudinal plane or axis 100 may extend between a rear, proximal end 102 of the article of footwear 74 and a front, distal end 104 of the article of footwear 74 and may continuously define a middle of an insole 106, the sole structure 82, and/or the upper 80 of the article of footwear 74, i.e., the longitudinal plane or axis 100 is a straight axis extending through the rear, proximal end 102 of the heel region 90 to the front, distal end 104 of the forefoot region 86.

Unless otherwise specified, and referring to FIGS. 6 and 7, the article of footwear 74 may be defined by the forefoot region 86, the midfoot region 88, and the heel region 90. The forefoot region 86 may generally correspond with portions of the article of footwear 74 that encase portions of a foot 110 that include the toes or phalanges 112, the ball of the foot 114, and one or more of the joints 116 that connect the metatarsals 118 of the foot 110 with the toes or phalanges 112. The midfoot region 88 is proximate and adjoins the forefoot region 86. The midfoot region 88 generally corresponds with portions of the article of footwear 74 that encase an arch (not shown) of a foot 110, along with a bridge (not shown) of the foot 110. The heel region 90 is proximate to the midfoot region 88 and adjoins the midfoot region 88. The heel region 90 generally corresponds with portions of the article of footwear 74 that encase rear portions of the foot 110, including the heel or calcaneus bone 120, the ankle (not shown), and/or the Achilles tendon (not shown).

Still referring to FIGS. 6 and 7, the forefoot region 86, the midfoot region 88, the heel region 90, the medial side 98, and the lateral side 96 are intended to define boundaries or areas of the article of footwear 74. To that end, the forefoot region 86, the midfoot region 88, the heel region 90, the medial side 98, and the lateral side 96 generally characterize sections of the article of footwear 74. Certain aspects of the disclosure may refer to portions or elements that are coextensive with one or more of the forefoot region 86, the midfoot region 88, the heel region 90, the medial side 98, and/or the lateral side 96. Further, both the upper 80 and the sole structure 82 may be characterized as having portions within the forefoot region 86, the midfoot region 88, the heel region 90, and/or along the medial side 98 and/or the lateral side 96. Therefore, the upper 80 and the sole structure 82, and/or individual portions of the upper 80 and the sole structure 82, may include portions thereof that are disposed within the forefoot region 86, the midfoot region 88, the heel region 90, and/or along the medial side 98 and/or the lateral side 96.

Still referring to FIGS. 6 and 7, the forefoot region 86, the midfoot region 88, the heel region 90, the medial side 98, and the lateral side 96 are shown in detail. The forefoot region 86 extends from a toe end 122 to a widest portion 124 of the article of footwear 74. The widest portion 124 is defined or measured along a first line 126 that is perpendicular with respect to the longitudinal axis 100 that extends from a distal portion of the toe end 122 to a distal portion of a heel end 128, which is opposite the toe end 122. The midfoot region 88 extends from the widest portion 124 to a thinnest portion 130 of the article of footwear 74. The thinnest portion 130 of the article of footwear 74 is defined as the thinnest portion of the article of footwear 74 measured across a second line 132 that is perpendicular with respect to the longitudinal axis 100. The heel region 90 extends from the thinnest portion 130 to the heel end 128 of the article of footwear 74.

It should be understood that numerous modifications may be apparent to those skilled in the art in view of the foregoing description, and individual components thereof, may be incorporated into numerous articles of footwear. Accordingly, aspects of the article of footwear 74 and components thereof, may be described with reference to general areas or portions of the article of footwear 74, with an understanding the boundaries of the forefoot region 86, the midfoot region 88, the heel region 90, the medial side 98, and/or the lateral side 96 as described herein may vary between articles of footwear. However, aspects of the article of footwear 74 and individual components thereof, may also be described with reference to exact areas or portions of the article of footwear 74 and the scope of the appended claims herein may incorporate the limitations associated with these boundaries of the forefoot region 86, the midfoot region 88, the heel region 90, the medial side 98, and/or the lateral side 96 discussed herein.

Still referring to FIGS. 6 and 7, the medial side 98 begins at the distal, toe end 122 and bows outward along an inner side of the article of footwear 74 along the forefoot region 86 toward the midfoot region 88. The medial side 98 reaches the first line 126, at which point the medial side 98 bows inward, toward the central, longitudinal axis 100. The medial side 98 extends from the first line 126, i.e., the widest portion 124, toward the second line 132, i.e., the thinnest portion 130, at which point the medial side 98 enters into the midfoot region 88, i.e., upon crossing the first line 126. Once reaching the second line 132, the medial side 98 bows outward, away from the longitudinal, central axis 100, at which point the medial side 98 extends into the heel region 90, i.e., upon crossing the second line 132. The medial side 98 then bows outward and then inward toward the heel end 128, and terminates at a point where the medial side 98 meets the longitudinal, central axis 100.

Still referring to FIGS. 6 and 7, the lateral side 96 also begins at the distal, toe end 122 and bows outward along an outer side of the article of footwear 74 along the forefoot region 86 toward the midfoot region 88. The lateral side 96 reaches the first line 126, at which point the lateral side 96 bows inward, toward the longitudinal, central axis 100. The lateral side 96 extends from the first line 126, i.e., the widest portion 124, toward the second line 132, i.e., the thinnest portion 130, at which point the lateral side 96 enters into the midfoot region 88, i.e., upon crossing the first line 126. Once reaching the second line 132, the lateral side 96 bows outward, away from the longitudinal, central axis 100, at which point the lateral side 96 extends into the heel region 90, i.e., upon crossing the second line 132. The lateral side 96 then bows outward and then inward toward the heel end 128, and terminates at a point where the lateral side 96 meets the longitudinal, central axis 100.

Referring again to FIGS. 3-5, the sole structure 82 is connected or secured to the upper 80 and extends between a foot of a user and the ground when the article of footwear 74 is worn by the user. The sole structure 82 may also include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user.

The sole structure 82 of the present embodiment may be characterized by an outsole region 134, a midsole region 136, and an insole region 138 (see FIGS. 4 and 5). The outsole region 134, the midsole region 136, and the insole region 138, and/or any components thereof, may include portions within the forefoot region 86, the midfoot region 88, and/or the heel region 90. Further, the outsole region 134, the midsole region 136, and the insole region 138, and/or any components thereof, may include portions on the lateral side 96 and/or the medial side 98.

The outsole region 134, the midsole region 136, and the insole region 138 are not intended to define precise or exact areas of the sole structure 82. Rather, the outsole region 134, the midsole region 136, and the insole region 138 are generally defined herein to aid in discussion of the sole structure 82 and components thereof. In other instances, the outsole region 134 may be defined as a portion of the sole structure 82 that at least partially contacts an exterior surface, e.g., the ground, when the article of footwear 74 is worn. The insole region 138 may be defined as a portion of the sole structure 82 that at least partially contacts a user's foot when the article of footwear is worn. Finally, the midsole region 136 may be defined as at least a portion of the sole structure 82 that extends between and connects the outsole region 134 with the insole region 138.

The upper 80, as shown in FIGS. 4 and 5, extends upwardly from the sole structure 82 and defines the interior cavity 84 that receives and secures a foot of a user. The upper 80 may be defined by a foot region 140 and an ankle region 142. In general, the foot region 140 extends upwardly from the sole structure 82 and through the forefoot region 86, the midfoot region 88, and the heel region 90. The ankle region 142 is primarily located in the heel region 90; however, in some embodiments, the ankle region 142 may partially extend into the midfoot region 88.

Referring again to FIGS. 6 and 7, the upper 80 extends along the lateral side 96 and the medial side 98, and across the forefoot region 86, the midfoot region 88, and the heel region 90 to house and enclose a foot of a user. When fully assembled, the upper 80 also includes an interior surface 144 and an exterior surface 146. The interior surface 144 faces inward and generally defines the interior cavity 84, and the exterior surface 146 of the upper 80 faces outward and generally defines an outer perimeter or boundary of the upper 80. The upper 80 also includes an opening 148 (see FIGS. 4-6) that is at least partially located in the heel region 90 of the article of footwear 74, which provides access to the interior cavity 84 and through which a foot may be inserted and removed. In some embodiments, the upper 80 may also include an instep region 150 (see FIG. 6) that extends from the opening 148 in the heel region 90 over an area corresponding to an instep of a foot to an area proximate the forefoot region 86. The instep region 150 may comprise an area similar to where a tongue 152 of the present embodiment is disposed. In some embodiments, the upper 80 does not include the tongue 152, i.e., the upper 80 is tongueless.

Referring again to FIGS. 4 and 5, the sole structure 82 includes a lateral side wing or flap 154 and a medial side wing or flap 156, which are each shown in phantom or dashed lines. A lower end 158 of the lateral side flap 154 extends from the lateral side 96 of the sole structure 82 next to the exterior surface 146 of the upper 80. The lateral side flap 154 extends along the lateral side 96 of the upper 80, and a top or upper end 160 of the lateral side flap 154 is next to the tongue 152. Likewise, a lower end 162 of the medial side flap 156 extends from the medial side 98 of the sole structure 82 next to the exterior surface 146 of the upper 80. The medial side flap 156 extends along the medial side 98 of the upper 80, and a top or upper end 164 of the medial side flap 156 is next to the tongue 152. In some embodiments, the side flaps 154, 156 may be attached to the sole structure 82 and extend from the sole structure 82 next to the interior surface 144 (see FIG. 6) of the upper 80. In some embodiments, the side flaps 154, 156 may be attached to the sole structure 82 and extend from the sole structure 82 between the interior and exterior surfaces 144, 146 of the upper 80.

Still referring to FIGS. 4 and 5, the side flaps 154, 156 are disposed within both the heel region 90 and the midfoot region 88 of the sole structure 82. In some embodiments, the side flaps 154, 156 are disposed within the heel region 90, the midfoot region 88, and/or the forefoot region 86 of the sole structure 82. The side flaps 154, 156, as illustrated in FIGS. 4 and 5, include openings disposed on a body 166 of the lateral side flap 154 and on a body 168 of the medial side flap 156 that may provide air flow through the side flaps 154, 156. In some embodiments, the side flaps 154, 156 have continuous bodies 166, 168. The side flaps 154, 156 may be comprised of a material similar to the material comprising the upper 80 or a different material, such as plastic or rubber.

Referring to FIGS. 4-6, portions of the lacing of the automatic lacing system 54 are shown in greater detail. The automatic lacing system 54 includes a housing 170 defining the panel 66, and a lace 172. The automatic lacing system 54 also includes a number of electronic components that are disposed within the housing 170, as discussed hereinafter below. The lace 172 extends through a plurality of lateral ghillies or lace retainers 174, disposed on an inner surface 176 (see FIG. 8) of the lateral side flap 154 and along the top end 160 of the lateral side flap 154, and a plurality of medial ghillies or lace retainers 178, disposed on an inner surface 180 (see FIG. 8) of the medial side flap 156 and along the top end 164 of the medial side flap 156. The lateral lace retainers 174 include a first lateral lace retainer 182 disposed nearest the opening 148 of the upper 80 of the article of footwear 74, a second lateral lace retainer 184 disposed next to the first lateral lace retainer 182 and toward the toe end 122 of the article of footwear 74, and a third lateral lace retainer 186 disposed next to the second lateral lace retainer 184 and nearest the toe end 122 of the article of footwear 74.

The medial lace retainers 178 include a first medial lace retainer 188 disposed nearest the opening 148 of the upper 80 of the article of footwear 74, a second medial lace retainer 190 disposed next to the first medial lace retainer 188 and toward the toe end 122 of the article of footwear 74, and a third medial lace retainer 192 disposed next to the second medial lace retainer 190 and nearest the toe end 122 of the article of footwear 74. In the illustrated embodiment, the lateral and medial lace retainers 174, 178 are disposed within the midfoot region 88 and the heel region 90. In some embodiments, the lace retainers 174, 178 are disposed entirely within the midfoot region 88. In some embodiments, the lace retainers 174, 178 are disposed within the forefoot region 86, the midfoot region 88, and the heel region 90. In some embodiments, the plurality of lateral and medial lace retainers 174, 178 are disposed on outer surfaces 194, 196 (see FIG. 8) of the side flaps 154, 156, respectively. In some embodiments, the plurality of lateral and medial lace retainers 174, 178 are disposed on the exterior surface 146 of the upper 80, next to the instep region 150.

Still referring to FIGS. 4-6, a portion of the lace 172 (see FIGS. 18 and 19) is disposed within the housing 170, which allows the automatic lacing system 54 to draw in the lace 172, or let out the lace 172, depending on a particular input of the user. In the illustrated embodiment, the lace 172 is a closed loop, such that a section of the lace 172 is disposed within the housing 170 while the remainder of the lace 172 extends through the lace retainers 174, 178. In some embodiments, a section of the closed loop lace 172 is fixed within the housing 170, i.e., the same section of lace 172 is disposed within the housing when the lace is fully let out. In some embodiments, the lace 172 may not comprise a closed loop, and may instead have ends that are fixedly attached to portions of the article of footwear 74. In some embodiments, ends of the lace 172 are fixedly attached to one or more lace retainers 174, 178. In some embodiments, ends of the lace 172 are fixedly attached to the side flaps 154, 156. In some embodiments, the ends of the lace 172 may not be fixedly attached to the article of footwear 74, and may instead have free ends that are tied together by the user.

Figure 8:
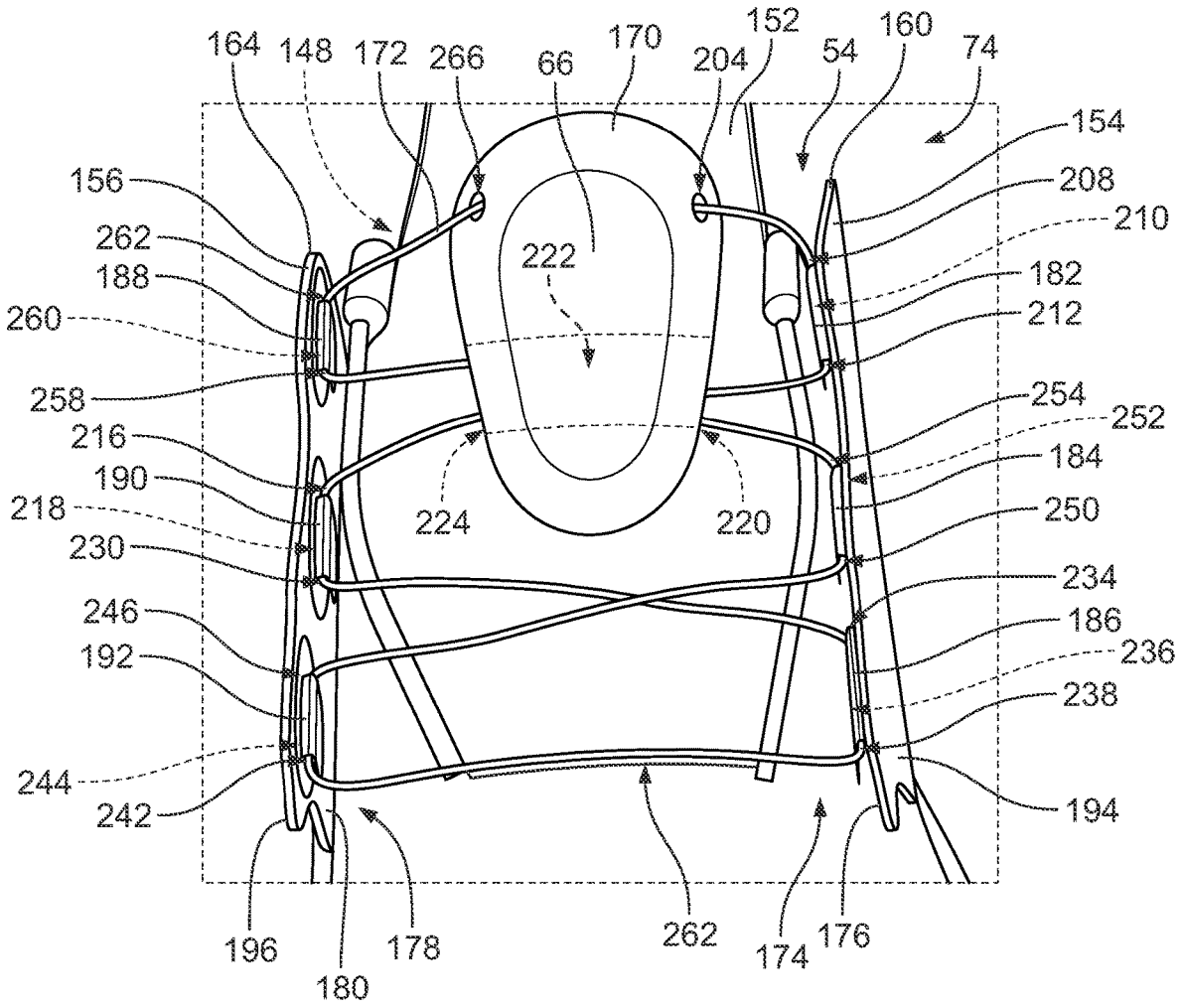
FIG. 8 is a detail view of the automatic lacing system of the shoe of FIG. 3.

Referring to FIG. 8, the housing 170 is centrally disposed along the tongue 152, which is located between the lateral side 96 and the medial side 98 of the upper 80 and within the instep region 150 of the upper 80. The lateral lace retainers 174 are disposed along the top end 160 of the lateral side flap 154, next to the tongue 152 and the lateral side 96 of the upper. The medial lace retainers 178 are disposed along the top end 164 of the medial side flap 156, next to the tongue 152 and the medial side 98 of the upper 80. In the illustrated embodiment, each of the lateral and medial lace retainers 174, 178 are identical in structure (see FIGS. 9-11), with the lateral lace retainers 174 being mirrored relative to the medial lace retainers 178, and vice versa.

Still referring to FIG. 8, the lace 172 extends from a lateral aperture 204 of the housing 170 toward a proximal opening 208 of an aperture 210 of the first lateral lace retainer 182. Depending on the amount of lace 172 disposed in the housing 170, the lace 172 may slightly bend or angle as it extends from the housing 170 and through the proximal opening 208 of the first lateral lace retainer 182. The lace 172 extends parallel to the top end 160 of the lateral side flap 154 through the aperture 210 and out of a distal opening 212 of the aperture 210 of the first lateral lace retainer 182. From the distal opening 212 of the first lateral lace retainer 182, the lace 172 extends to a proximal opening 216 of an aperture 218 of the second medial lace retainer 190 and across the tongue 152 through a lateral opening 220 of a lace channel 222 (see FIGS. 18 and 19) in the housing 170 and out of the lace channel 222 through a medial opening 224 of the housing 170.

The lace 172 may slightly bend or angle as it extends across the tongue 152 and through the proximal opening 216 of the second medial lace retainer 190, depending on the amount of lace 172 disposed in the housing 170. The lace 172 extends parallel to the top end 164 of the medial side flap 156 through the aperture 218 and extends through a distal opening 230 of the aperture 218 of the second medial lace retainer 190. From the distal opening 230 of the second medial lace retainer 190, the lace 172 extends across the tongue 152 to a proximal opening 234 of an aperture 236 in the third lateral lace retainer 186. Depending on the amount of lace 172 disposed in the housing 170, the lace 172 may slightly bend or angle as it extends across the tongue 152 and through the proximal opening 234 of the third lateral lace retainer 186. The lace 172 extends parallel to the top end 160 of the lateral side flap 154 through the aperture 236 and out a distal opening 238 of the aperture 236 of the third lateral lace retainer 186.

Still referring to FIG. 8, from the distal opening 238 of the third lateral lace retainer 186, the lace 172 extends across the tongue 152 to a distal opening 242 of an aperture 244 of the third medial lace retainer 192. The lace 172 may slightly bend or angle as it extends across the tongue 152 and through the distal opening 242 of the third medial lace retainer 192, depending on the amount of lace 172 disposed within the housing 170. The lace 172 extends parallel to the top end 164 of the medial side flap 156 through the aperture 244 and out a proximal opening 246 of the aperture 244 of the third medial lace retainer 192. From the proximal opening 246 of the third medial lace retainer 192, the lace 172 extends across the tongue 152 to a distal opening 250 of an aperture 252 of the second lateral lace retainer 184 and crosses over itself along the tongue 152.

Depending on the amount of lace 172 disposed within the housing 170, the lace 172 may slightly bend or angle as it extends across the tongue 152 and through the distal opening 250 of the second lateral lace retainer 184. The lace 172 extends parallel to the top end 160 of the lateral side flap 154 through the aperture 252 and out a proximal opening 254 of the aperture 252 of the second lateral lace retainer 184. From the proximal opening 254 of the second lateral lace retainer 184, the lace 172 extends across the tongue through the medial opening 224 and out the lateral opening 220 of the lace channel 222 in the housing 170 to a distal opening 258 of an aperture 260 of the first medial lace retainer 188, crossing over itself within the lace channel 222 of the housing 170.

The lace 172 may slightly bend or angle as it extends through the lace channel 222 of the housing 170 and through the distal opening 258 of the first medial lace retainer 188, depending on the amount of lace 172 disposed within the housing 170. The lace 172 extends parallel to the top end 164 of the medial side flap 156 through the aperture 260 and out a proximal opening 262 of the aperture 260 of the first medial lace retainer 188. From the proximal opening 262 of the medial lace retainer 188, the lace 172 extends to a medial aperture 266 of the housing 170.

Alternative configurations of the lacing structure as outlined above are contemplated, such as more or fewer lace retainers 174, 178 that would result in more or fewer intersections of the lace 172 crossing over itself. For example, some embodiments may not include any intersections of the lace 172 crossing over itself. As noted above, in the illustrated embodiment the lace 172 crosses over itself two times. In some embodiments, the lace 172 may cross over itself three, four, five, six, or seven times. In other embodiments, the lace 172 may extend from the housing 170 through the lateral lace retainers 174 in series toward the distal end 104 of the article of footwear 74, across the tongue 152, and through the medial lace retainers 178 in series back toward the housing 170, such that the lace 172 does not cross over itself. However, in the illustrated embodiment, the specific orientation of the housing 170, the lace retainers 174, 178, and the side flaps 154, 156, allows the article of footwear 74 to be adequately and securely tightened around a user's foot, and forces applied by the lace 172 are spread over a user's foot in an efficient and retentive manner while the article of footwear 74 is being worn. In that sense, a preferable orientation of the lace 172 is to extend from the housing 170 and through the lace retainers 174, 178 in a crisscrossing manner across the tongue 152, as noted above.

The lacing system 54 as described above may allow a user to modify the tightness of the side flaps 154, 156 along the lateral side 96 and the medial side 98 of the upper 80, e.g., to tighten or loosen the side flaps 154, 156 that extend along the upper 80 relative to the housing 170 via the lace 172 extending through the lace retainers 174, 178 disposed on the side flaps 154, 156, around a foot as desired by the user. As will also be discussed in further detail herein, the lacing system 54 may allow a user to modify tightness, as desired by the user. With reference to the material(s) comprising the lace 172, the material may be conventional cotton, polyester, or nylon having a circular cross-section to prevent twisting and improve the operation of the automatic lacing system 54. In some embodiments, the lace 172 is a cable having a diameter in a range from 0.5 to 1.5 millimeters. In some embodiments, the lace 172 comprises a high modulus polyethylene fiber cable having increased strength and abrasion resistance compared to conventional shoelaces.

Figure 9:
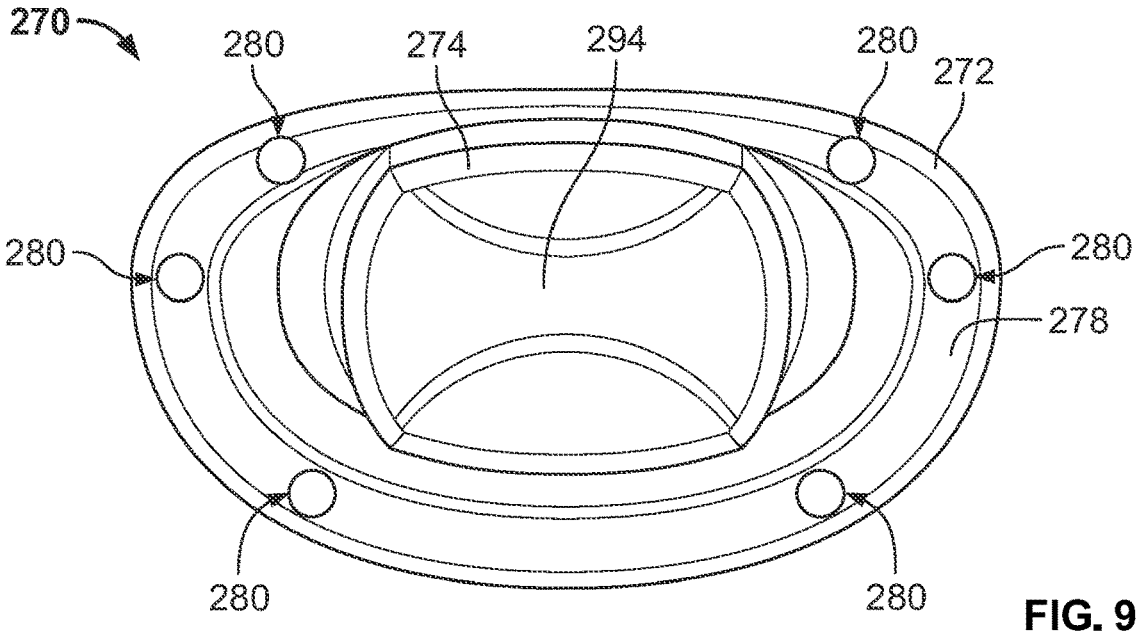
FIG. 9 is a front view of one of the lace retainers of the shoe of FIG. 3.
Figure 10:
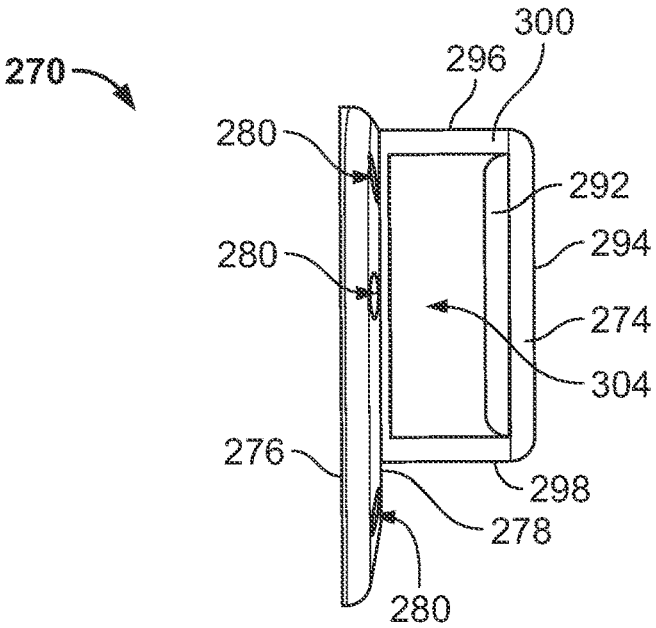
FIG. 10 is a first or left side view of the lace retainer of FIG. 9.
Figure 11:
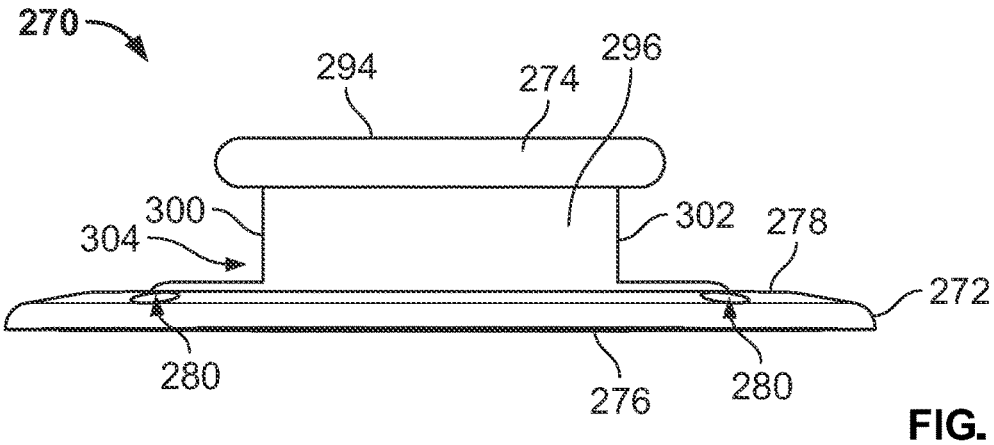
FIG. 11 is a top view of the lace retainer of FIG. 9.

Referring now to FIGS. 9-11, an embodiment of one of the lace retainers 174, 178 is shown in greater detail. As noted above, in the embodiment illustrated in FIG. 8, each of the lateral and medial lace retainers 174, 178 are identical. For ease of disclosure, a single lace retainer 270 is referenced in FIGS. 9-11 to describe aspects of the lace retainers 174, 178. In some embodiments, there may be differences between the lateral lace retainers 174 and the medial lace retainers 178. For example, the lateral lace retainers 174 can have different features in different locations of the lace retainer 270 than the medial lace retainers 178, and vice versa. In some embodiments, there may be differences between the first, second, and third lateral lace retainers 182, 184, 186 and the first, second, and third medial lace retainers 188, 190, 192. For example, the first lateral lace retainer 182 and the first medial lace retainer 174 may have different features in different locations of the lace retainer 270 than the second lateral and second medial lace retainers 184, 190 and/or the third medial and third lateral lace retainers 186, 192.

Still referring to FIGS. 9-11, the lace retainer 270 includes a base portion 272 and a body portion 274. The base portion 272 includes a first surface 276 (see FIGS. 10 and 11) that contacts the inner surfaces 176, 180 of the side flaps 154, 156 (see FIG. 8), and a second surface 278 from which the body portion 274 extends. In the illustrated embodiment, the base portion 272 includes a plurality of fastener holes 280, which are each configured to receive a fastener to fixedly attach the lace retainer 270 to the inner surfaces 176, 180 of the side flaps 154, 156. The plurality of fastener holes 280 are aligned to counteract forces, such as a force perpendicular or parallel to the base portion 272, imposed by the tightened lace 172 passing through and retained by the lace retainer 270. In other embodiments, the lace retainer 270 can be fixedly attached to the inner surfaces 176, 180 of the side flaps 154, 156 by any attachment means known in the art, such as by glue or ultrasonic welding.

Referring to FIGS. 10 and 11, the body portion 274 of the lace retainer 270 includes a front surface 294, a top surface 296, a bottom surface 298, a first side surface 300, and a second side surface 302 that define a lace aperture 304. The lace aperture 304 extends through the first and second side surfaces 300, 302. The first and second side surfaces 300, 302 can include features other than those illustrated, such as angled surfaces and rounded corners that reduce friction to the lace 172 passing through the lace aperture 304. Similarly, the front, top, and bottom surfaces 294, 296, 298 can include angled surfaces and/or rounded corners that reduce irritation to a user's foot when the lace 172 is tightened and the lace retainer 270 contacts the upper 80 of the footwear 74. An inner portion of the front surface 294 includes a rounded pad 292 configured to provide a smooth surface for the lace 172 to contact when the lace 172 is tightened. In some embodiments, the pad 292 includes a lace channel configured to receive the lace 172. In some embodiments, the pad 292 is comprised of a different material than the lace retainer 270. In the illustrated embodiment, the lace aperture 304 extends parallel to the first surface 276 of the base portion 272. In some embodiments, the lace aperture 304 extends at an angle to the first surface 276 of the base portion 272. In some embodiments the lace aperture 304 is configured to be a cylindrical shaped aperture having a diameter that is the same or larger than a diameter of the lace 172.

The lace retainer 270 may be formed through additive manufacturing techniques, such as by one or more of the various 3D printing techniques mentioned above. In some embodiments, the lace retainers 174, 178, or components thereof, may be 3D printed directly onto the side flaps 154, 156, or along another region of the upper 80, such as the midfoot region 88. In some embodiments, the lace retainers 174, 178, or components thereof, may be 3D printed and then separately fastened to a portion of the article of footwear 74.

Figure 12:
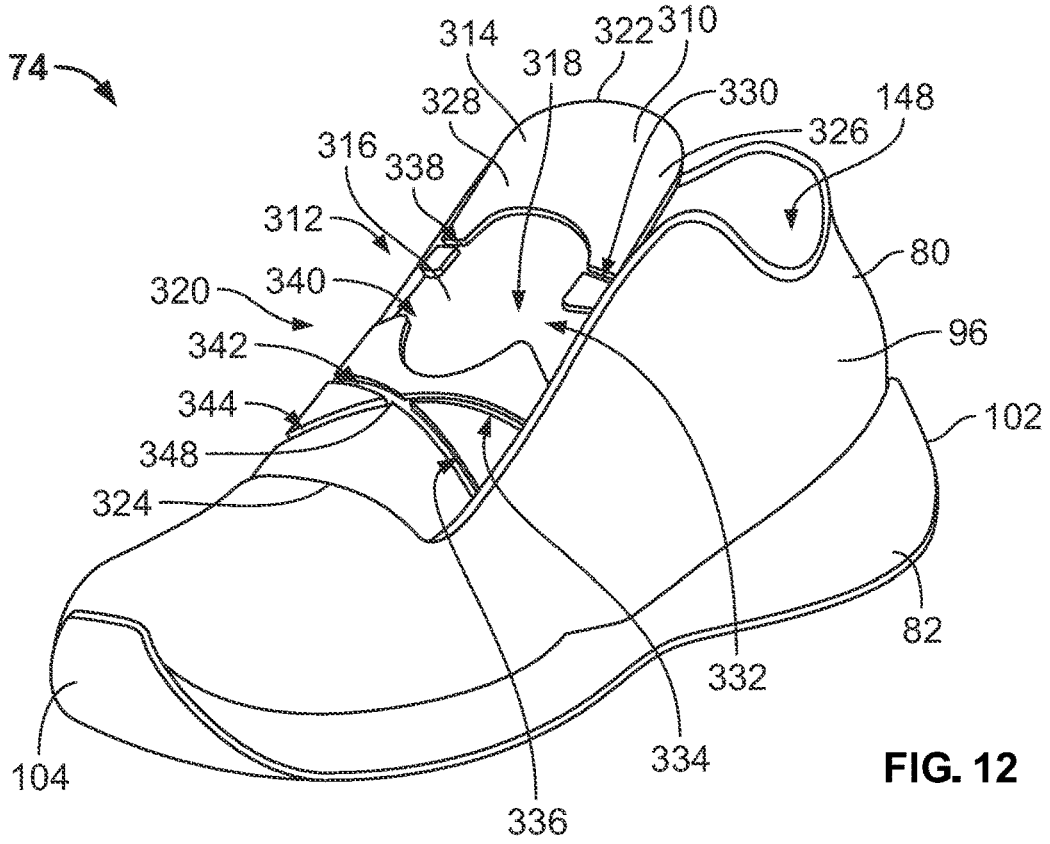
FIG. 12 is a perspective view of the shoe of FIG. 3 with the housing, lateral and medial side flaps, lateral and medial lace retainers, and lace removed and with an alternative embodiment of the tongue.
Figure 13:
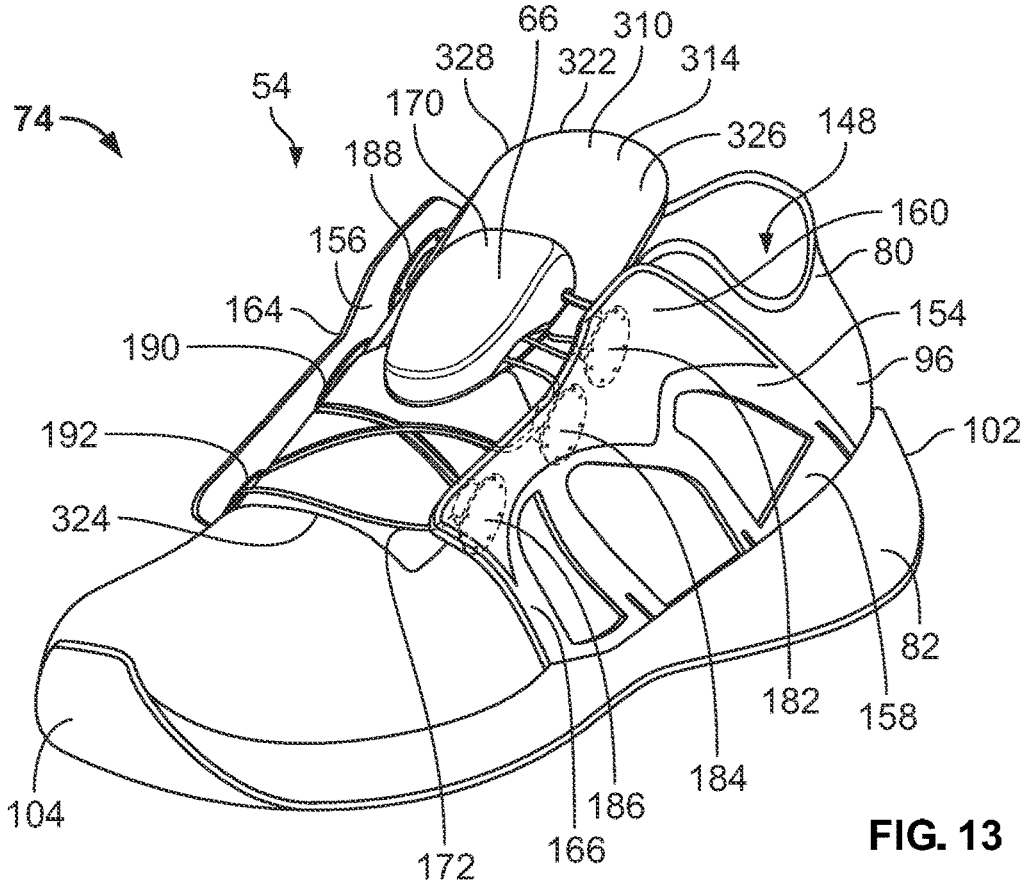
FIG. 13 is a perspective view of the shoe of FIG. 3 with the alternative embodiment of the tongue of FIG. 12.
Figure 14:
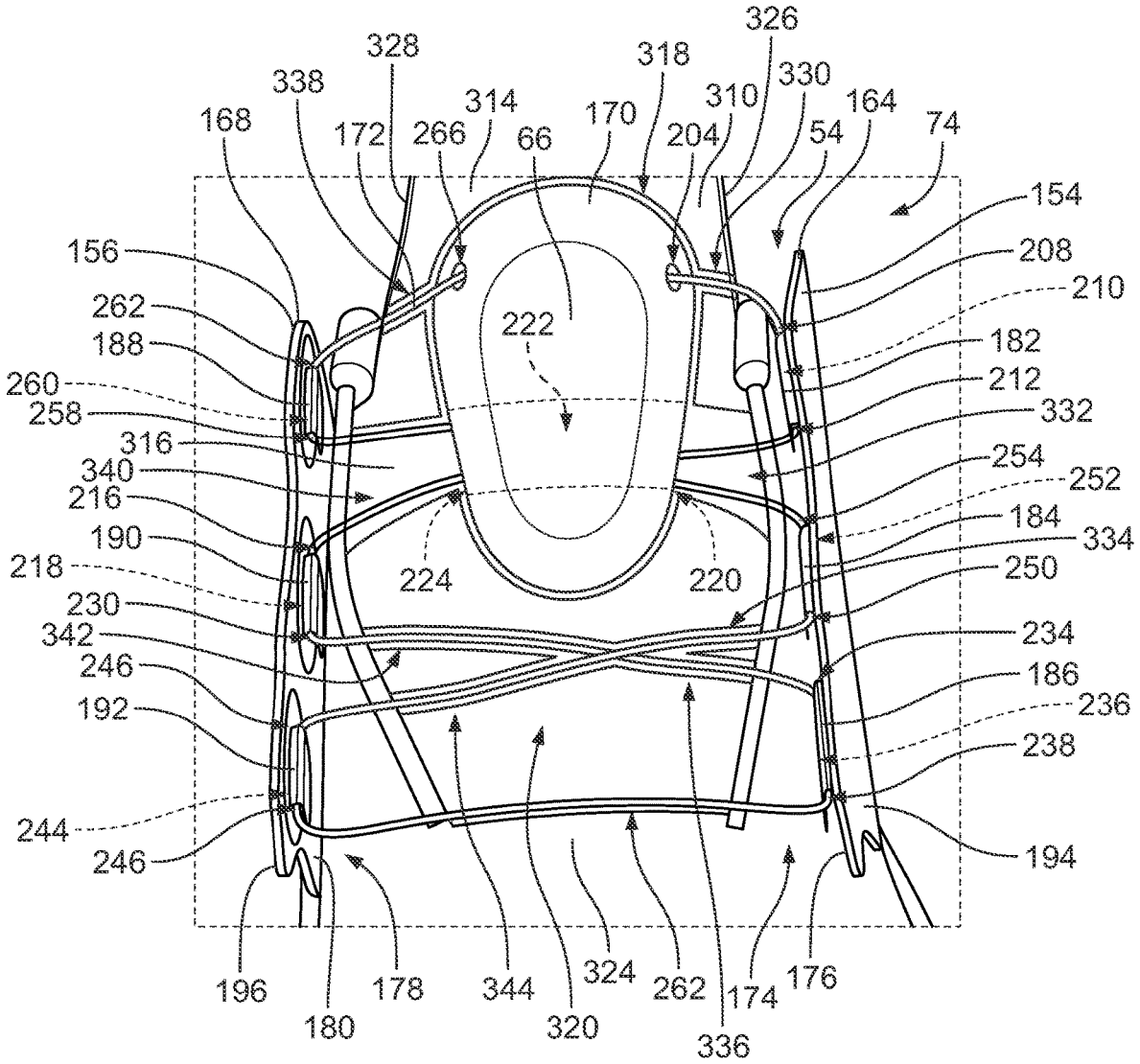
FIG. 14 is a detail view of the automatic lacing system of the shoe of FIG. 13.
Figure 15:
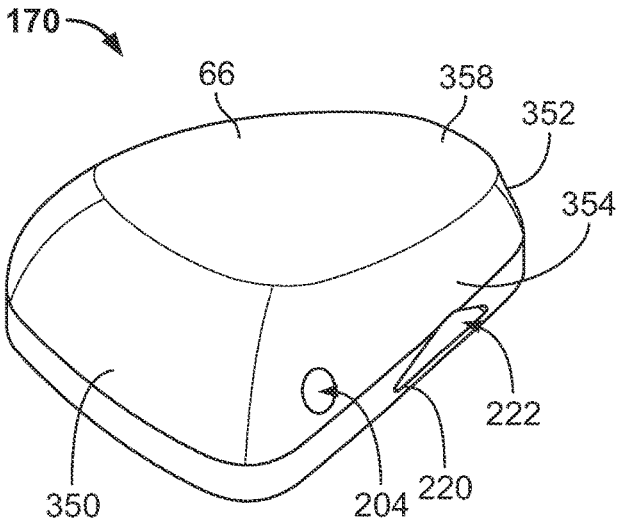
FIG. 15 is an isometric view of the housing of the automatic lacing system of FIG. 3.

Referring now to FIGS. 12-14, an alternative embodiment of the tongue 152 of the article of footwear 74 is shown. Referring to FIG. 12, the article of footwear 74 is shown with the side flaps 154, 156 removed for clarity. A tongue 310 of the upper 80 is disposed in the same location and functions similarly to the tongue 152 of the article of footwear 74 of the embodiment illustrated in FIGS. 3-8, as discussed above. However, the tongue 310 in this embodiment includes a plurality of recesses 312 disposed along or within an outer surface 314 of the tongue 310 and that extend from the outer surface 314 to an intermediate surface 316 of the tongue 310. In the illustrated embodiment, the plurality of recesses 312 includes a housing recess 318 and a plurality of lace channels 320. The housing recess 318 is disposed toward a proximal end 322 of the tongue 310, which is next to the opening 148 of the article of footwear 74. The housing recess 318 is configured to receive the housing 170 (see FIGS. 15-18), such that the housing 170 sits partially below the outer surface 314 of the tongue 310. The plurality of lace channels 320 are disposed next to and below the housing recess 318 toward a distal end 324, and along a lateral side 326 and a medial side 328 of the tongue 310. In some embodiments, the housing recess 318 extends below the intermediate surface 316 toward an inner surface (not shown) of the tongue 310. In some embodiments, the housing recess 318 extends through the inner surface of the tongue 310, such that the housing recess 318 defines a housing opening that extends through the outer surface 314 and the inner surface of the tongue 310.

Still referring to FIGS. 12-14, the plurality of lace channels 320 are configured to receive and guide portions of the lace 172 extending through the plurality of lateral and medial lace retainers 174, 178 in a crisscrossing manner as described above (and as shown in FIGS. 13 and 14). The plurality of lace channels 320 include a first lateral lace channel 330, a second lateral lace channel 332, a third lateral lace channel 334, a fourth lateral lace channel 336, a first medial lace channel 338, a second medial lace channel 340, a third medial lace channel 342, and a fourth medial lace channel 344. The first lateral lace channel 330 extends from the lateral side 326 of the tongue 310 at a distance from the proximal end 322 of the tongue that is aligned with the proximal opening 208 of the aperture 210 of the first lateral lace retainer 182 toward the housing recess 318 at an angle that aligns with the lateral aperture 204 of the housing 170 when the housing 170 is disposed within the housing recess 318 (see FIG. 14).

Likewise, the first medial lace channel 338 extends from the medial side 328 of the tongue 310 at a distance from the proximal end 322 of the tongue that is aligned with the proximal opening 262 of the aperture 260 of the first medial lace retainer 188 to the housing recess 318 at an angle that aligns with the medial aperture 266 of the housing 170 when the housing 170 is disposed within the housing recess 318 (see FIG. 14). The first lateral lace channel 330 and the first medial lace channel 338 each have a width that is the same or larger than a diameter of the lace 172 (see FIGS. 13 and 14). In some embodiments, the first lateral lace channel 330 and the first medial lace channel 338 extend along the tongue 310 toward the housing recess 318 at the same angle. In some embodiments, the first lateral lace channel 330 and the first medial lace channel 338 do not extend toward the housing recess 318 in a straight line at an angle, but are instead shaped in order to distribute tension forces imposed on the housing 170 to the side walls of the channels 330, 338 when the lace 172 is tightened. For example, in some embodiments the first lateral lace channel 330 and the first medial lace channel 338 have an arc shape with a radius or are shaped along a line resembling a sine wave.

Still referring to FIGS. 12-14, the second lateral lace channel 332 is disposed along the tongue 310 below the first lateral lace channel 330 relative to the proximal end 322 of the tongue 310 and extends from the lateral side 326 of the tongue 310 to the housing recess 318. The second lateral lace channel 332 is triangular shaped or tapered, such that the lateral end of the second lateral lace channel 332 that extends from the lateral side 326 of the tongue 310 is wider than the other, lateral end proximate to the housing recess 318. The lateral end of the second lateral lace channel 332 has a width that aligns with both the distal opening 212 of the aperture 210 of the first lateral lace retainer 182 at a proximal side of the lateral end of the second lateral lace channel 332 and the proximal opening 254 of the aperture 252 of the second lateral lace retainer 184 at the other, distal side of the lateral end of the second lateral lace channel 332 (see FIG. 14). The medial end of the first lateral lace channel 330 has a width that is less than the width of the lateral end and is aligned with the lateral opening 220 of the lace channel 222 of the housing 170 when the housing 170 is disposed within the housing recess 318 (see FIG. 14).

Likewise, and still referring to the FIGS. 12-14, the second medial lace channel 340 is disposed along the tongue 310 below the first medial lace channel 338 relative to the proximal end 322 of the tongue 310 and extends from the medial side 328 of the tongue 310 to the housing recess 318. The second medial lace channel 340 has a similar shape to the second lateral lace channel 332 but mirrored, such that the medial end of the second medial lace channel 340 that extends from the medial side 328 of the tongue 310 is wider than the other, lateral end proximate to the housing recess 318. The medial end of the second medial lace channel 340 has a width that aligns with both the distal opening 258 of the aperture 260 of the first medial lace retainer 188 at a proximal side of the medial end of the second medial lace channel 340 and the proximal opening 216 of the aperture 218 of the second medial lace retainer 190 at the distal side of the medial end of the second medial lace channel 340 (see FIG. 14).

The lateral end of the second medial lace channel 340 has a width that is less than the width of the medial end and is aligned with the opening 224 of the lace channel 222 of the housing 170 when the housing 170 is disposed within the housing recess 318 (see FIG. 14). In some embodiments, the second lateral lace channel 332 and the second medial lace channel 340 each comprise two separate lace channels. For example, in some embodiments the second lateral lace channel 332 can comprise a first channel extending from the proximate side of the lateral end of the second lateral lace channel 332 to a proximal side of the lateral opening 220 of the lace channel 222 of the housing 170, and a second channel separate from the first channel that extends from the distal side of the lateral end of the second lateral lace channel 332 to a distal side of the lateral opening 220 of the lace channel 222 of the housing 170.

Still referring to FIGS. 12-14, the third and fourth lateral lace channels 334, 336 are disposed next to the distal opening 250 of the aperture 252 of the second lateral lace retainer 184 and the proximal opening 234 of the aperture 236 of the third lateral lace retainer 186 at one end, respectively, and at an intersection where the lace 172 crosses over itself below the housing 170 at the other ends (see FIG. 14). Likewise, the third and fourth medial lace channels 342, 344 are disposed next to the distal opening 230 of the aperture 218 of the second medial lace retainer 190 and the proximal opening 246 of the aperture 244 of the third medial lace retainer 192 at one end, respectively, and an intersection point 348 where the lace 172 crosses over itself along the tongue 310 (see FIGS. 13 and 14). In some embodiments, the tongue 310 further includes an additional lace channel disposed below the fourth lateral lace channel 336 and the fourth medial lace channel 344 toward the distal end 324 of the tongue 310. For example, the additional lace channel can be disposed next to the distal opening 238 of the aperture 236 of the third lateral lace retainer 186 at one end, and next to the distal opening 242 of the aperture 244 of the third medial lace retainer 192 at the other end (see FIG. 14). In some embodiments, the plurality of lace channels 320 extend within the tongue 310 such that the plurality of lace channels 320 are covered by the upper surface 314 of the tongue 310.

Referring in particular to FIG. 12, the tongue 310, or components thereof, may be formed through additive manufacturing techniques, such as by one or more of the various 3D printing techniques mentioned above. In some embodiments, the tongue 310, or components thereof, may be 3D printed directly upon the instep region 150, or along another region of the foot, such as the midfoot region 88. In some embodiments, the tongue 310, or components thereof, may be 3D printed and separately coupled with a portion of the article of footwear 74.

Referring now to FIGS. 15-18, the housing 170 and the components disposed therein will be described in greater detail. The housing 170 has a first or proximal side 350, a second or distal side 352, a third or lateral side 354 (see FIGS. 15-17), a fourth or medial side 356 (see FIGS. 16-18), a fifth or top side 358, and a sixth or bottom side 360 (see FIGS. 16 and 18). The swipe panel 66 is disposed below the top side 358. The lateral aperture 204 is disposed on the lateral side 354 and toward the proximal side 350 of the housing 170, and the medial aperture 266 is disposed on the medial side 356 and toward the proximal side 350 of the housing 170. The lateral and medial apertures 204, 266 are configured to receive a portion of the lace 172 within the housing 170 (see FIG. 8). The lace channel 222 extends through the lateral and medial sides 354, 356 of the housing 170, and includes the lateral opening 220 and the medial opening 224 of the lace channel 222. The lace channel 222 is configured to receive portions of the lace 172 extending from the lateral and medial lace retainers 174, 178 when the housing 170 is disposed on the tongue 152 of the upper 80 of the article of footwear 74 (see FIG. 8).

Figure 16:
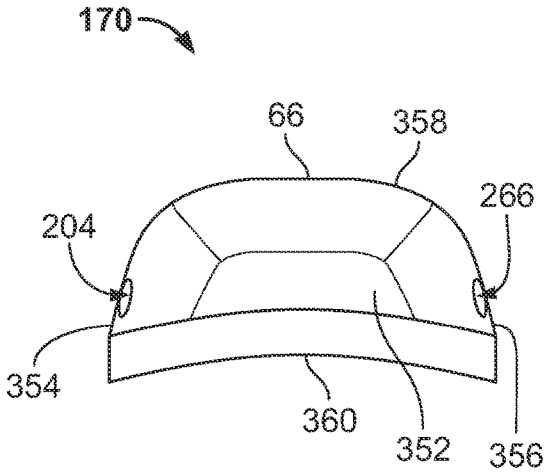
FIG. 16 is a bottom view of the housing of the automatic lacing system of FIG. 15.
Figure 17:
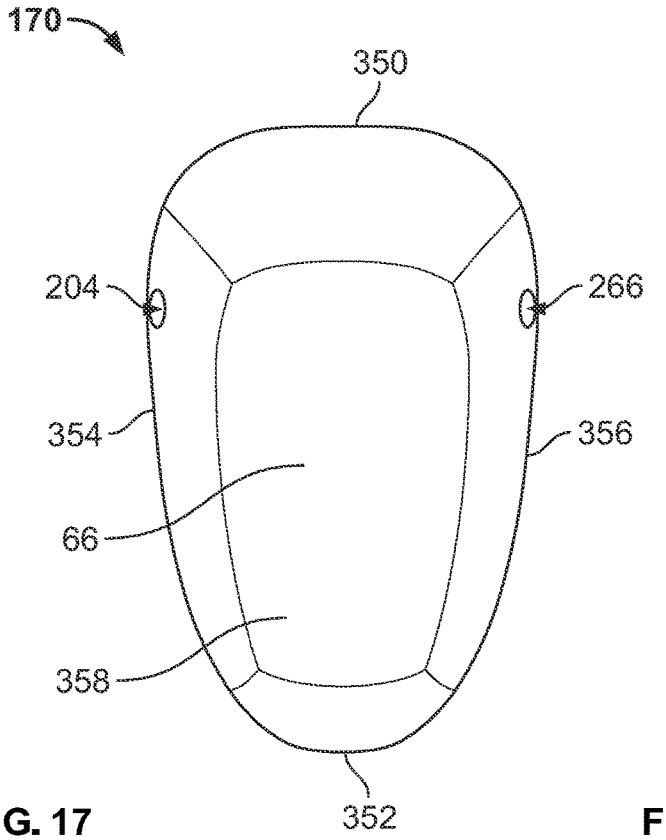
FIG. 17 is a front view of the housing of the automatic lacing system of FIG. 15.
Figure 18:
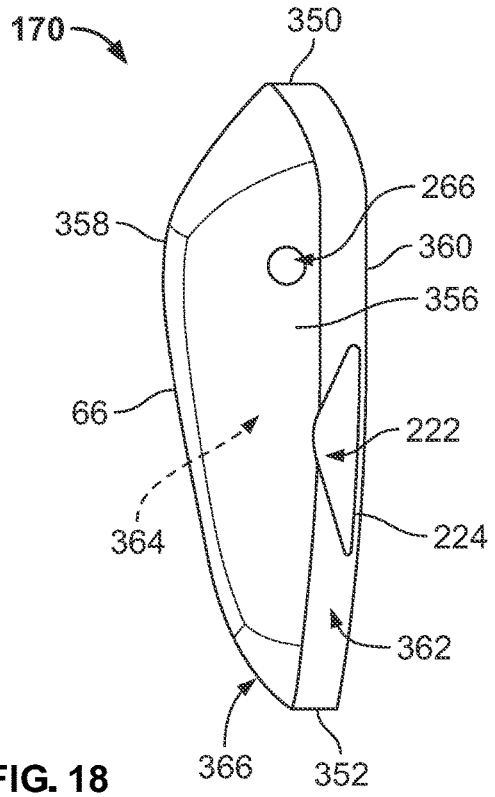
FIG. 18 is a first or right side view of the housing of the automatic lacing system of FIG. 15.

Referring to FIG. 16, the bottom side 360 of the housing 170 is concavely-shaped between the lateral and medial sides 354, 356. The concavely-shaped bottom side 360 of the housing 170 provides a more ergonomic alignment with a top surface of a user's foot 110 when the housing 170 is disposed on the tongue 152 of the upper 80 of the article of footwear 74. In other embodiments, the bottom side 360 of the housing 170 can be convexly-shaped or can be flat, for example, if the housing 170 is disposed within the housing recess 318 of the tongue 310 (see FIGS. 12 and 13). Referring to FIG. 18, as discussed in greater detail below, the housing comprises a housing base 362, a housing base cover 364 (see FIGS. 19-25) attached to a top surface of the housing base 362, and a housing top cover 366 attached to an outer surface of the housing base 362 and above the housing base cover 364. The housing 170, or components thereof, may be formed through additive manufacturing techniques, such as by one or more of the various 3D printing techniques mentioned above. In some embodiments, the housing 170, or components thereof, may be 3D printed directly upon the instep region 150, or along another region of the foot, such as the forefoot region 86, the midfoot region 88, or the heel region 90. In some embodiments, the housing 170, or components thereof, may be 3D printed and then separately coupled with a portion of the article of footwear 74.

Figure 19:
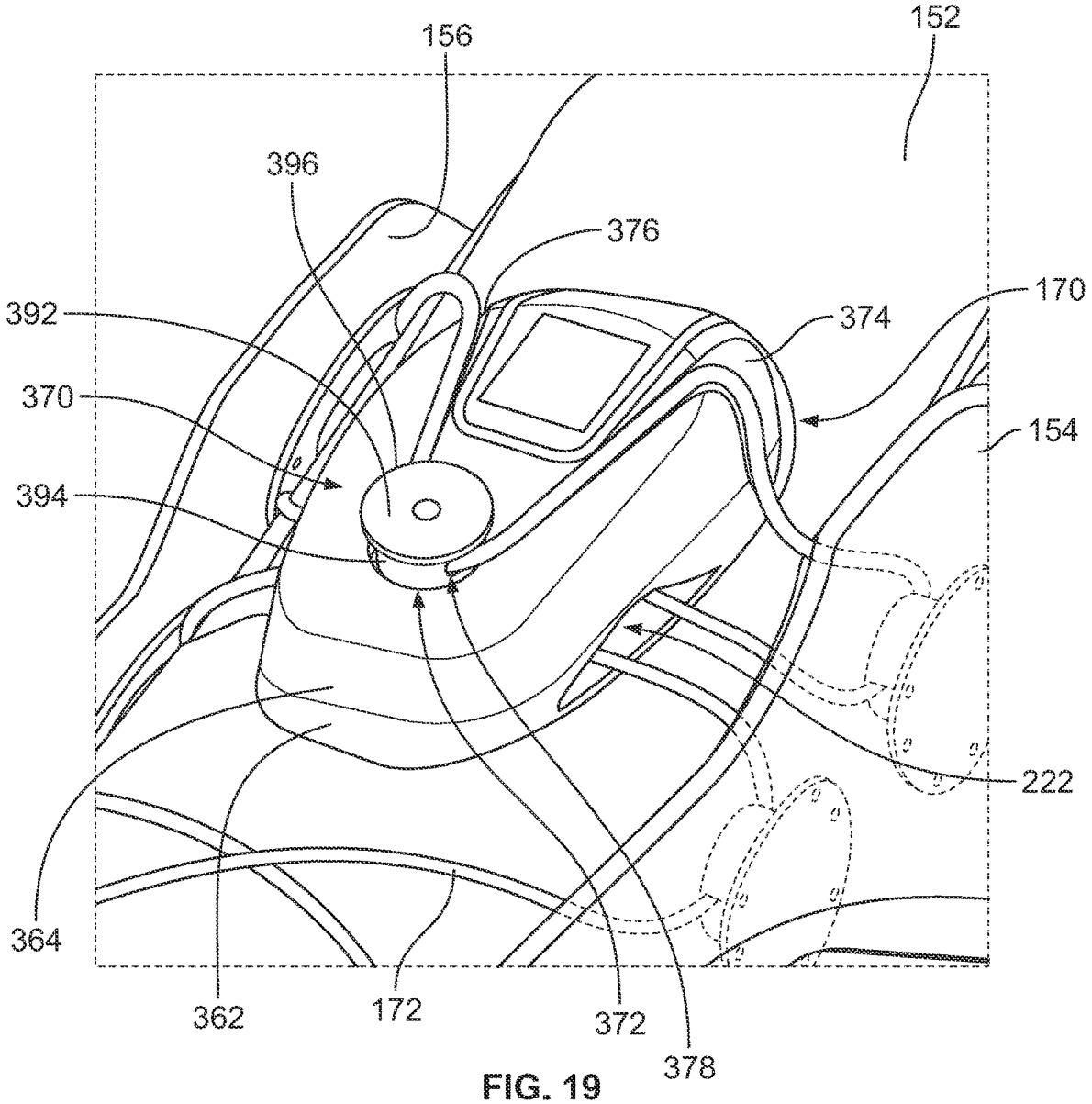
FIG. 19 is a detail, perspective, phantom view of some internal components of the automatic lacing system of FIG. 3 with a top cover of the housing removed and the automatic lacing system shown in a loosened configuration.
Figure 20:
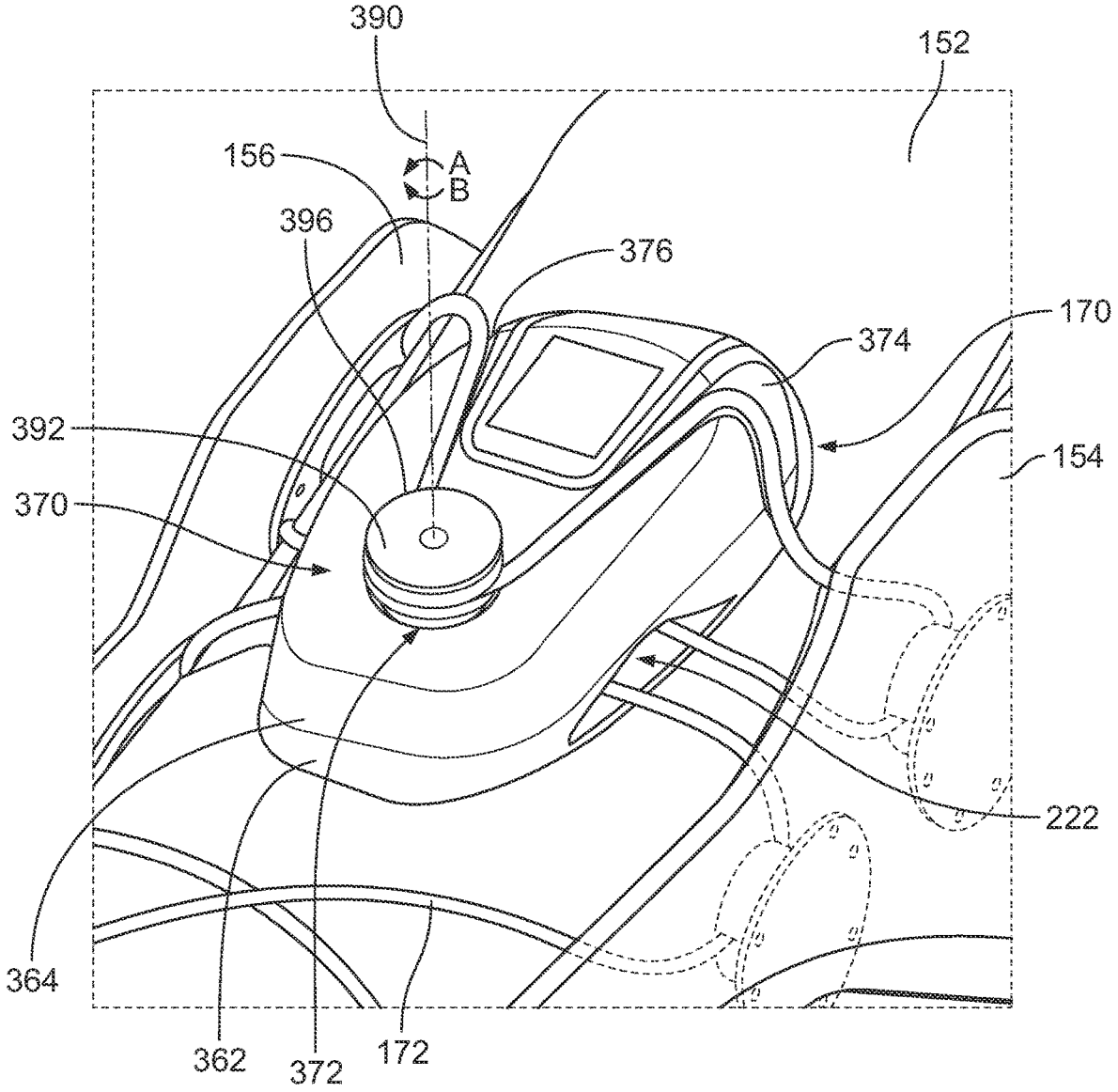
FIG. 20 is a detail, perspective, phantom view of some internal components of the automatic lacing system of FIG. 3 with the top cover of the housing removed and the automatic lacing system shown in a tightened configuration.

Referring now to FIGS. 19-25, the automatic lacing system 54 will now be described in greater detail. Referring to FIGS. 19 and 20, ghost views of some internal components of the housing 170 of the automatic lacing system 54 illustrate an upper wheel gear assembly 370 disposed within an upper wheel gear recess 372 of the housing base cover 364. Portions of the housing 170, including the housing top cover 366 (see FIGS. 21-25), are removed for clarity. The housing base cover 364 includes a lateral lace channel 374 and a medial lace channel 376 having first ends configured to align with the lateral and medial apertures 204, 266 of the housing top cover 366 (see FIGS. 8 and 15-18), respectively, and second ends extending through the upper wheel gear recess 372. The lateral and medial lace channels 374, 376 are configured to receive lateral and medial portions of the section of lace 172 disposed within the housing 170, guiding the portions of the lace 172 to the upper wheel gear assembly 370 where the lace 172 is received in an aperture 378 of the upper wheel gear assembly 370.

Still referring to FIGS. 19 and 20, the upper wheel gear assembly 370 includes an upper extension component 392 having a cylindrical body 394 (FIG. 19) with the lace aperture 378 disposed therethrough and a flange 396 disposed on a top portion of the cylindrical body 394. In the illustrated embodiment, the lace 172 passes into the housing 170 along the lateral and medial channels 374, 376 of the housing base cover 364, and is received through the lace aperture 378 of the cylindrical body 394 of the upper extension component 392. This configuration allows the lace 172 to be drawn inward, around the wheel gear axis 390 in a direction of arrows A or B (see FIG. 20), depending upon whether the automatic lacing system 54 is being used to tighten or loosen the lace 172.

In the illustrated embodiment, from an initial or loose configuration (shown in FIG. 19), rotation of the upper wheel gear assembly 370 by about 90 degrees results in a first level of tightness, rotation of the upper wheel gear assembly 370 by about 180 degrees results in a second level of tightness, rotation of the upper wheel gear assembly 370 by about 270 degrees results in a third level of tightness, etc. In some embodiments, rotation of the upper wheel gear assembly 370 in increments of about 60 degrees results in a first level of tightness, second level of tightness, third level of tightness, etc. In some embodiments, rotation of the upper wheel gear assembly 370 by increments of about 45 degrees results in a first level of tightness, second level of tightness, third level of tightness, etc. In some embodiments, rotation of the upper wheel gear assembly 370 in increments of about 30 degrees results in a first level of tightness, second level of tightness, third level of tightness, etc. In some embodiments, rotation of the upper wheel gear assembly 370 by increments of about 15 degrees results in a first level of tightness, second level of tightness, third level of tightness, etc.

Figure 21:
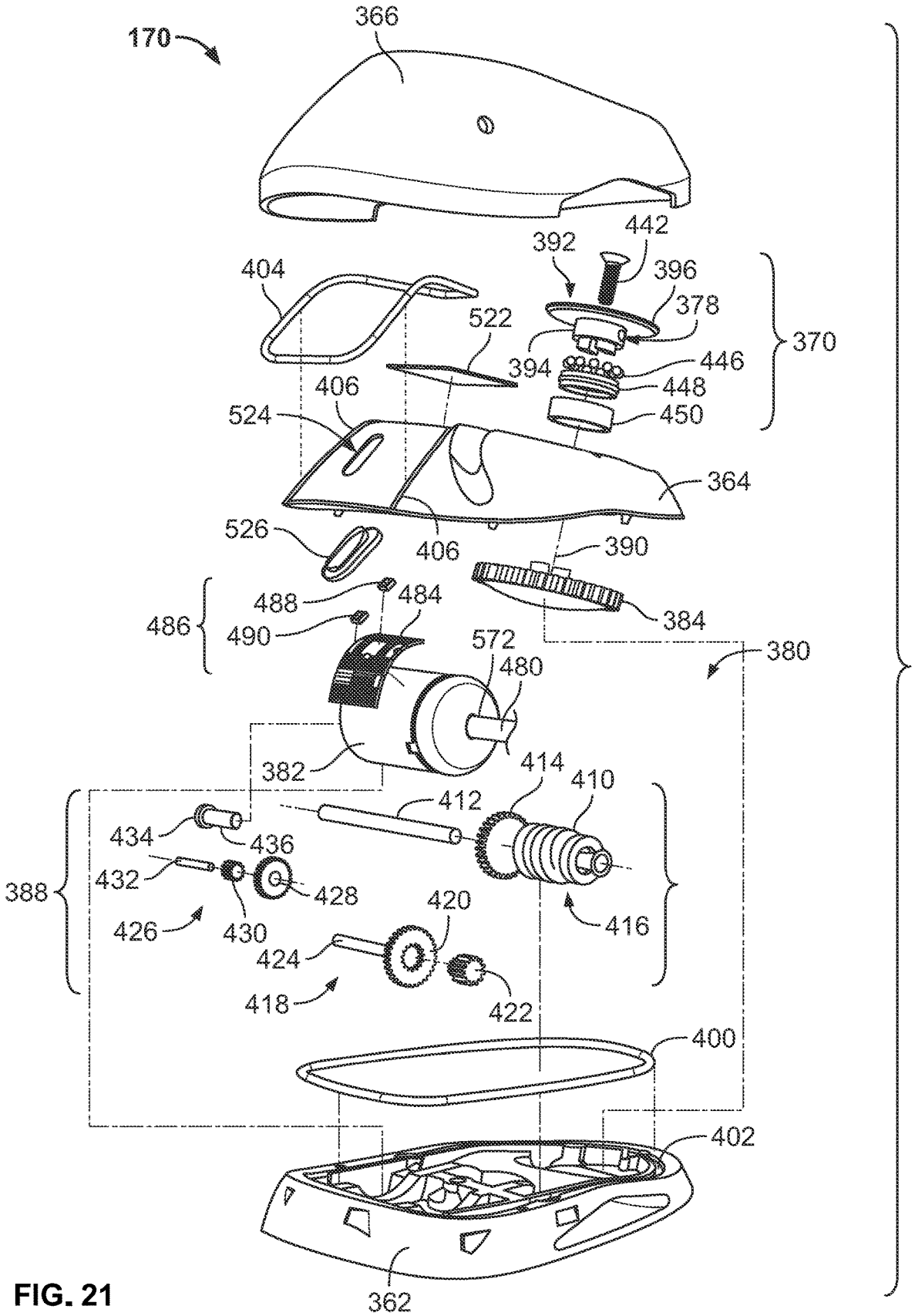
FIG. 21 is an exploded, perspective view of various components disposed within the housing of the automatic lacing system of FIG. 3.
Figure 22:
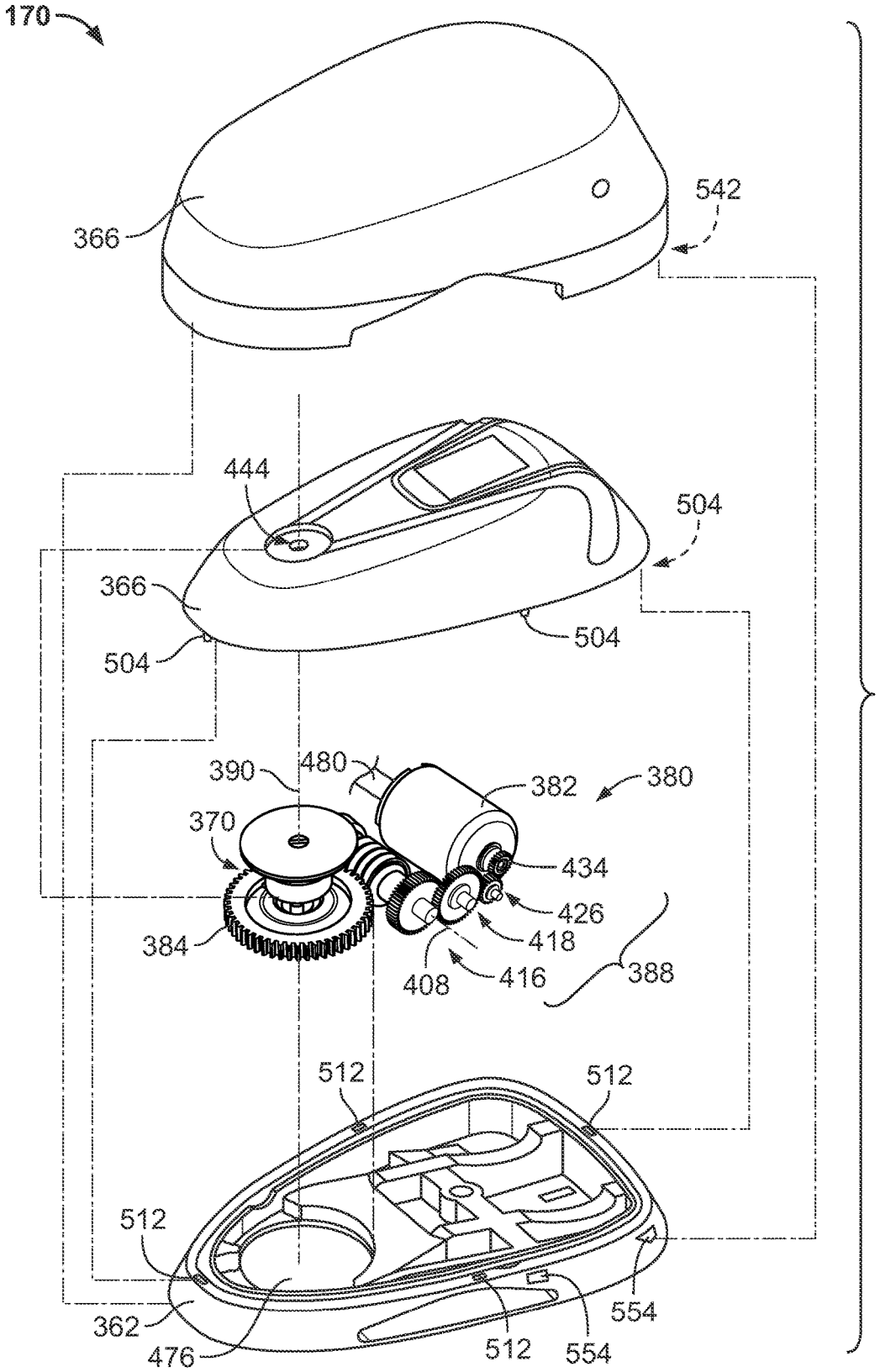
FIG. 22 is an exploded, perspective view of some components disposed within the housing of FIG. 21.

Referring now to FIGS. 21-25, elements of the automatic lacing system 54 are depicted in an exploded configuration. Referring specifically to FIGS. 21 and 22, a powertrain assembly 380 that includes a motor 382, a wheel gear 384, and a gear train 388, is disposed within the housing base 362 and the housing base cover 364. The wheel gear 384 of the powertrain assembly 380 is in mechanical connection with the upper wheel gear assembly 370, which is disposed on the housing base cover 364 (see FIGS. 19-21). The specific gear configuration will be discussed below, but the motor 382 is operable to rotate the upper wheel gear assembly 370 (via rotation of the wheel gear 384 via rotation of the gear train 388) about the wheel gear axis 390, which allows the lace 172 to rotate and spool around the cylindrical body 394 of the upper wheel gear assembly 370 (see FIG. 20). As the upper wheel gear assembly 370 turns and draws the lace 172 about the wheel gear axis 390, the lace 172 is either tightened or loosened, depending on the direction of rotation (see arrows A and B in FIG. 20) of the upper wheel gear assembly 370 (and by extension, the wheel gear 384, the gear train 388, and the motor 382).

Referring now to FIG. 21, an exploded perspective view is shown of some of the components that are disposed within the housing 170 of the automatic lacing system 54. The components include the housing base 362, a lower gasket 400 disposed within a lower gasket channel 402 of the housing base 362, the housing base cover 364, an upper gasket 404 disposed within an upper gasket channel 406 of the housing base cover 364, and the housing top cover 366. The powertrain assembly 380 is disposed within the housing base 362 and the housing base cover 364, and includes the motor 382, the gear train 388, and the wheel gear 384. A worm gear 410 is provided about a first shaft 412, and a first gear 414 is disposed at an end of the first shaft 412 (see FIG. 21). The worm gear 410, the first shaft 412, and the first gear 414 comprise the first gear assembly 416 of the gear train 388. The first gear assembly 416 has a rotational axis 408 that is perpendicular to the wheel gear axis 390 (see FIG. 22). A second gear assembly 418 of the gear train 388 includes a second gear 420 and a third gear 422 that are disposed along a second shaft 424. The second gear 420 and the third gear 422 are fixedly coupled to one another, thus, when the second gear 420 is rotated, the third gear 422 is also rotated. A third gear assembly 426 of the gear train 388 is also provided, the third gear assembly 426 including a fourth gear 428 and a fifth gear 430 (see FIG. 21). The fourth gear 428 and the fifth gear 430 are fixedly coupled to one another and are disposed along a third shaft 432. A motor gear 434 of the gear train 388 is also shown extending from the motor 382, the motor gear 434 being disposed along a motor shaft 436 (see FIG. 21).

The first gear 414, second gear 420, third gear 422, fourth gear 428, and fifth gear 430 may be spur or cylindrical gears. Spur gears or straight-cut gears include a cylinder or disk with teeth projecting radially. Though the teeth are not straight-sided, the edge of each tooth is straight and aligned parallel to the axis of rotation. When two of the gears mesh, e.g., the first gear 414 and the third gear 422, if one gear is bigger than the other (the first gear 414 has a diameter that is larger than third gear 422), then a mechanical advantage is produced, with the rotational speeds and the torques of the two gears differing in proportion to their diameters. Since the larger gear is rotating less quickly, its torque is proportionally greater, and in the present example, the torque of the third gear 422 is proportionally greater than the torque of the first gear 414.

Still referring to FIGS. 21-25, the first gear assembly 416 includes the worm gear 410, which is in communication with the wheel gear 384. A worm gear is a species of helical gear, but its helix angle is usually somewhat large (close to 90 degrees) and its body is usually fairly long in the axial direction. As one of ordinary skill in the art would appreciate, use of the worm gear 410 results in a simple and compact way to achieve a high torque, low speed gear ratio between the worm gear 410 and the wheel gear 384. In the present embodiment, the worm gear 410 can always drive the wheel gear 384, but the opposite is not always true. The combination of the worm gear 410 and the wheel gear 384 results in a self-locking system, thus, an advantage is achieved, i.e., when a particular tightness level is desired, the worm gear 410 can be easily used to hold that position. The worm gear 410 can be right or left-handed. For purposes of this disclosure, as noted above, the first gear assembly 416 includes the worm gear 410, the first shaft 412, and the first gear 414. The worm gear 410, the first shaft 412, and the first gear 414, may comprise a single material, or may comprise different materials.

Referring specifically to FIGS. 21 and 22, the first gear assembly 416 is in communication with the second gear assembly 418, which is in communication with the third gear assembly 426, which is in communication with the motor gear 434. As a result, when the motor shaft 436 is rotated by the motor 382, the motor gear 434 spins in a clockwise or counterclockwise direction, depending upon whether the wheel gear 384 is intended to be spun clockwise or counterclockwise, i.e., to tighten or loosen the lace 172. The motor gear 434 is in communication with the fifth gear 430 (see FIG. 21), rotation of which causes the third shaft 432 (see FIG. 21) and the fourth gear 428 (see FIG. 21) to rotate. The fourth gear 428 (see FIG. 21) is in communication with the second gear 420 (see FIG. 21), which is fixedly coupled with the third gear 422 (see FIG. 21). As noted above, the second gear 420, the third gear 422, and the second shaft 424 (see FIG. 21) comprise the second gear assembly 418.

Still referring to FIGS. 21 and 22, the second gear assembly 418 is thereby caused to rotate when the third gear assembly 426 is caused to rotate by the motor gear 434. The third gear 422 of the second gear assembly 418 is in communication with the first gear 414, thus, rotation of the third gear 422 causes rotation of the first gear 414. When the first gear 414 (see FIG. 21) is caused to rotate by the second gear assembly 418, the first gear 414 causes the first shaft 412 (see FIG. 21) to rotate, and the first shaft 412 is fixedly coupled with the worm gear 410. The worm gear 410 is thereby caused to rotate when the first gear 414 (see FIG. 21) is caused to rotate. As illustrated in FIGS. 22-25, the wheel gear 384 is in mechanical connection with the worm gear 410, thus the wheel gear 384 is also caused to rotate when the first gear assembly 416 is caused to rotate.

As illustrated in FIGS. 22-25, the upper wheel gear assembly 370 is fixedly attached to the wheel gear 384, thus when the wheel gear 384 rotates the upper wheel gear assembly 370 is caused to rotate, and the lace 172 is drawn into the housing 170, about the wheel gear axis 390 (as shown in FIGS. 19 and 20). As noted above, the first gear assembly 416 includes the first gear 414 (see FIG. 21), the first shaft 412 (see FIG. 21), and the worm gear 410. To that end, when the motor gear 434 rotates, the third gear assembly 426 is caused to rotate, which causes the second gear assembly 418 to rotate, which causes the first gear assembly 416 to rotate, which causes the wheel gear 384 to rotate.

Referring now to FIG. 21, the upper wheel gear assembly 370 includes the upper extension component 392 that is coupled to the wheel gear 384 via a fastener 442. As noted with reference to FIGS. 19 and 20, the upper extension component 392 includes the cylindrical body 394 with the lace aperture 378 disposed through it and the flange 396. The fastener 442 is disposed through the cylindrical body 394 of the upper extension component 392 and a fastener hole 444 (see FIG. 22) in the cylindrical upper wheel gear recess 372 of the housing base cover 364. The fastener 442 is fixedly received in a center of the wheel gear 384, as shown in FIGS. 22-25. Thus, the upper wheel gear assembly 370 and the wheel gear 384 have the same rotational axis 390, as shown in FIGS. 21, 22, and 25.

As noted above, in the illustrated embodiment, the upper wheel gear assembly 370 is coupled to the wheel gear 384 and holds the lace 172 in the tightened configuration (see FIG. 20), in the illustrated embodiment. As such, the connection between the upper wheel gear assembly 370 and the wheel gear 384 may be subject to rotational friction as the lace 172 is tightened and also to radial and axial loads from the tightened lace 172. As shown in FIG. 21, in order to support radial and axial loads and to reduce rotational friction, the upper wheel gear assembly 370 includes ball bearings 446, a bearing holding collar 448 configured to hold the ball bearings 446 in contact with a bottom portion of the upper extension component 392, and an outer retaining ring 450 configured to axially retain the bearing holding collar 448 with the upper extension component 392. In some embodiments, other components or methods may be used to support radial and axial loads and to reduce rotational friction imposed on the upper wheel gear assembly 370 that is coupled to the wheel gear 384 in operation.

Figure 23:
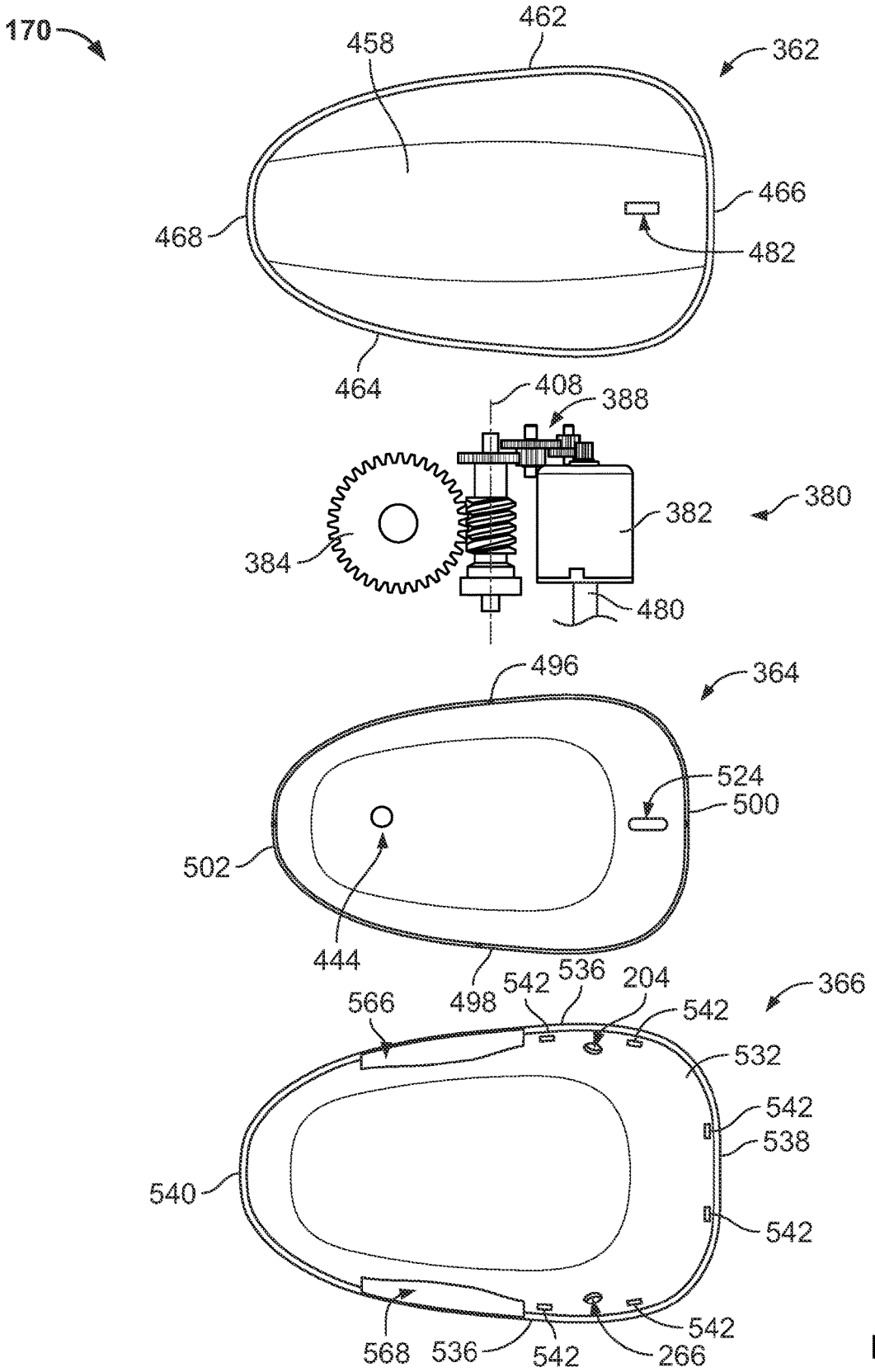
FIG. 23 is an exploded, bottom view of a housing base, a housing base cover, a housing top cover, and a powertrain of the housing of FIG. 21.
Figure 24:
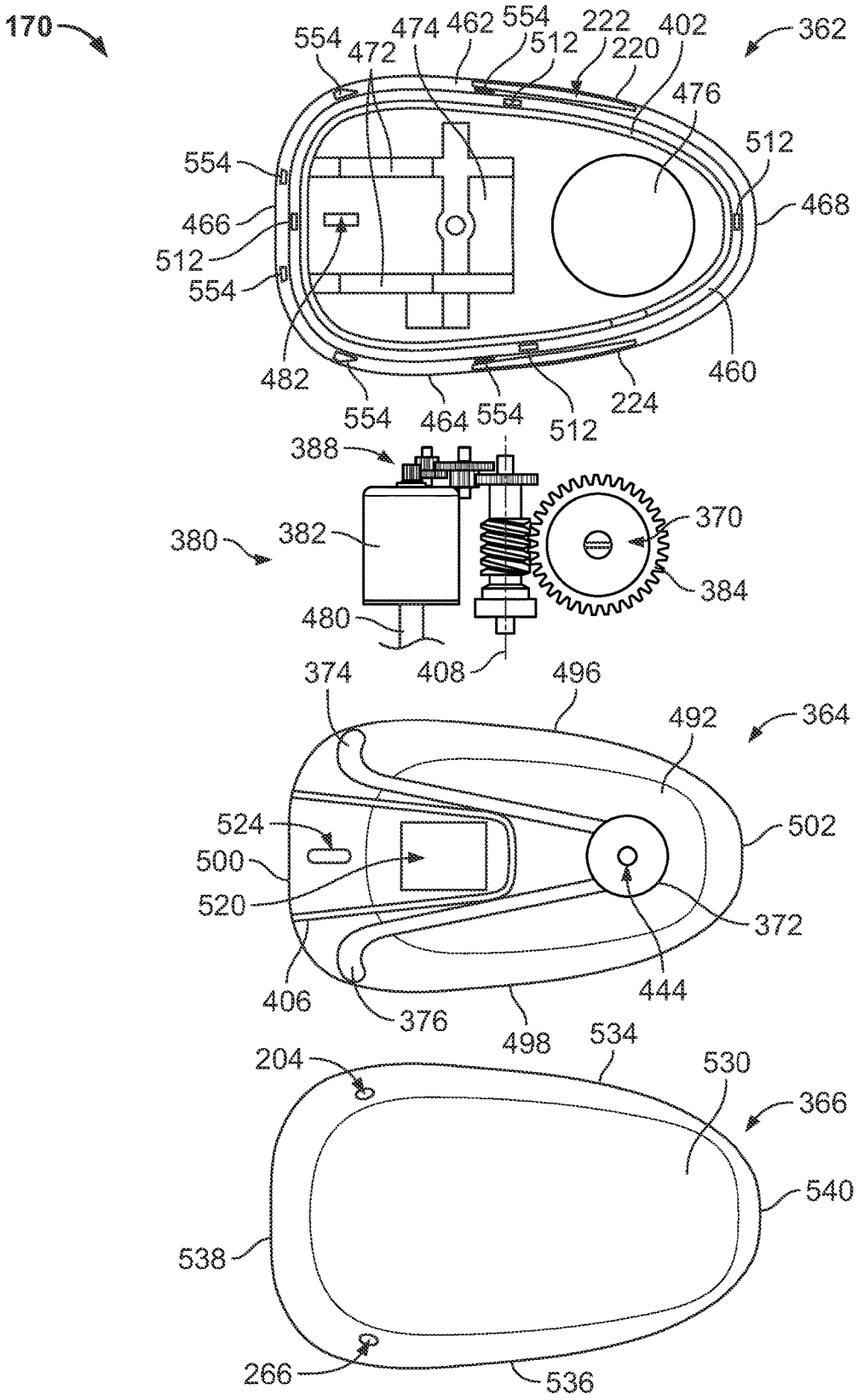
FIG. 24 is an exploded, top view of the components of the housing of FIG. 23.
Figure 25:
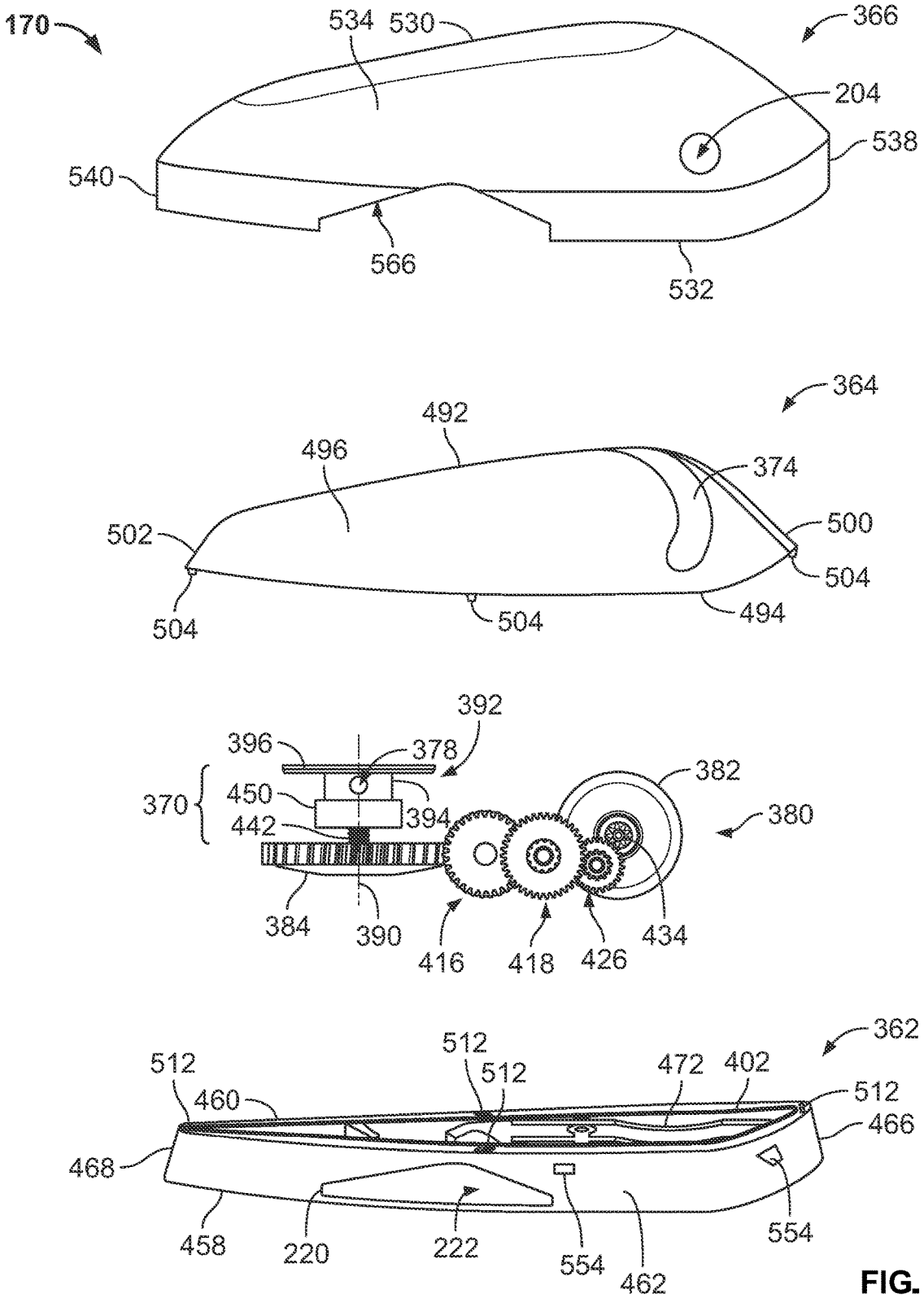
FIG. 25 is an exploded, side view of some components disposed within the housing of FIG. 22.

Referring now to FIGS. 23-25, the housing base 362 is shown in greater detail. The housing base 362 includes a bottom side 458, a top side 460, a first or lateral side 462, a second or medial side 464 (see FIGS. 23 and 24), a third or proximal side 466, and a fourth or distal side 468. When the housing 170 is assembled, the bottom side 458 of the housing base 362 is the bottom side 360 of the housing 170, as shown in FIGS. 15-18. The powertrain 380 (including the motor 382, the gear train 388, and the wheel gear 384) is disposed on the top side 460 of the housing base 362 and within the lower gasket channel 402 (see FIGS. 24 and 25).

Specifically, the motor 382 is contained within a motor compartment 472 (see FIGS. 24 and 25), the worm gear 410 is contained within a worm gear compartment 474 (see FIG. 24), and the wheel gear 384 is contained within a wheel gear compartment 476 (see FIGS. 22 and 24). The wheel gear compartment 476 (see FIG. 24) is configured to receive the wheel gear 384, such that the wheel gear 384 can freely rotate within the wheel gear compartment 476 when caused to rotate via the gear train 388. The wheel gear 384 may be coupled to the housing base 362 via a protrusion or shaft (not shown) extending from the housing base 362. A motor wire 480 (partially shown in FIGS. 21-24) of the motor 382 extends from an end of the motor 382 opposite the motor gear 434 and out the bottom side 458 of the housing base 362 via a wire hole 482 (see FIGS. 23 and 24). Referring to FIG. 21, a flexible circuit 484 is disposed on the motor 382 and in electrical connection with the motor wire 480. A lighting system 486 including a first lighting element or light emitting diode (LED) 488 and a second lighting element or LED 490 is also disposed on the flexible circuit 484.

Referring to FIGS. 23-25, the housing base cover 364 is shown in greater detail. The housing base cover 364 includes a top side 492 (see FIG. 24), a first or bottom side 494 (see FIG. 25), a second or lateral side 496, a third or medial side 498 (see FIGS. 23 and 24), a fourth or proximal side 500, and a fifth or distal side 502. The housing base cover 364 is formed to be seated over the housing base 362. The housing base cover 364 is secured to the housing base 362 via a plurality of projections 504 (see FIG. 25) included on the bottom side 494 of the housing base cover 364 that are configured to mate with a plurality of recesses 512 included on the top side 460 of the housing base 362. The housing base cover 364 can also be securable to the housing base 362 via other methods of coupling. The sides 492, 496, 498, 500, 502 of the housing base cover 364 are formed to completely cover the powertrain assembly 380 of the automatic lacing system 54, including the flexible circuit 484 disposed on the motor 382 (see FIGS. 21 and 22). A swipe sensor recess 520 (see FIG. 24) is disposed on the top side 492 of the housing base cover 364 and is configured to receive a swipe sensor 522 (see FIG. 21) in connection with the flexible circuit 484. A lighting system cover hole 524 (see FIGS. 23 and 24) is included on the proximal side 500 of the housing base cover 364 and is configured to receive a lighting system cover 526 (see FIG. 21) that encloses the lighting system 486 disposed on the flexible circuit 484 (shown in FIGS. 21 and 22).

Still referring to FIGS. 23-25, the housing top cover 366 is shown in greater detail. The housing top cover 366 includes a first or top side 530, a second or bottom side 532, a third or lateral side 534, a fourth or medial side 536 (see FIGS. 23 and 24), a fifth or proximal side 538, and a sixth or distal side 540. The housing top cover 366 is formed to be seated over the housing base 362 and the housing base cover 364, and is attached to the housing base 362 via a plurality of projections 542 (see FIG. 23) included on the bottom side 532 of the housing top cover 366, and a plurality of recesses 554 (see FIGS. 24 and 25) included on the proximal, lateral, and medial sides 462, 464, and 466 of the housing base 362. The housing top cover 366 may also be securable to the housing base 362 or the housing base cover 364 via other methods of coupling. The top side 530 of the housing top cover 366 defines the panel 66 of the automatic lacing system 54, which is in contact with the swipe sensor 522 disposed on the housing base cover 364 (see FIGS. 21 and 22) on the bottom side 532 of the housing top cover 366. As noted above, the top, lateral, medial, proximal, and distal sides 530, 534, 536, 538, 540 of the housing top cover 366 are intended to completely cover the housing base 362 and the housing base cover 364, including the swipe sensor 522 (see FIG. 21) disposed within the swipe sensor recess 520 of the housing base cover 364 and the lighting system cover 526 (see FIG. 21) disposed within the lighting system cover hole 524 of the housing base cover 364.

Thus, when the housing 170 is assembled, the top, lateral, medial, proximal, and distal sides 530, 534, 536, 538, 540 of the housing top cover 366 are the top, lateral, medial, proximal, and distal sides 358, 354, 356, 350, 352 of the housing 170 (see FIGS. 15-18). The housing top cover 366 includes a lateral lace channel cutout 566 (see FIGS. 23 and 25) and a medial lace channel cutout 568 (see FIG. 23) disposed on the lateral and medial sides 534, 536 of the top cover 366, and is configured to provide clearance to the lateral and medial openings 220, 224 of the lace channel 222 of the housing base 362 when the housing 170 is assembled. While the top cover 366 may be any color, including the color black, light can be seen through the top cover 366 when one or more light sources are activated within the housing 170.

As noted above with reference to FIG. 21, the flexible circuit 484 may be disposed between the housing base 362 and the housing base cover 364. The flexible circuit 484 includes the swipe sensor 522 disposed on the housing base cover 364, which, in some embodiments, may also be caused to flash or light up in response to a signal sent by one or more controllers discussed below. In some embodiments, additional LEDs may be provided along another portion of the housing 170. When the housing 170 of the automatic lacing system 54 is assembled, the swipe sensor 522 of the flexible circuit 484 is disposed beneath the panel 66 of the housing top cover 366 of the housing 170, and the first and second LEDs 488, 490 of the lighting system 486 are disposed beneath the proximal and top sides 538, 530 of the top cover 366 through the lighting system cover 526 disposed within the lighting system cover hole 524 of the housing base cover 364. While the top cover 366 may be any color, including the color black, light can be seen through the top cover 366 when the lighting system 486 is activated within the housing 170. In some embodiments, the top cover 366 may have portions that are transparent or translucent to allow the light emitted from the lighting system 486 to project light through the top cover 366. The lighting system 486 can provide light-based feedback to a user. In particular, the lighting system 486 provides visual cues that indicate a tightness level of the lace 172 and/or an energy level of a battery (not shown) of a controller 570 (see FIGS. 28-32), e.g., a low power warning, as well as visual cues that indicate when the battery is being charged.

Conventional articles of footwear, including articles of footwear with automatic lacing systems, are commonly exposed to outdoor conditions, such as dust and water, when worn by a user. The presence of dust and/or water within the automatic lacing system can damage the electronics and mechanical components commonly utilized in conventional articles of footwear with automatic lacing systems. In addition, in conventional articles of footwear with automatic lacing systems, the automatic lacing systems may generate noise/sound during operation thereof. For example, each time the automatic lacing system is activated, e.g., during tightening or loosening of the lace, the components within the automatic lacing system may generate sound that is undesirable from a user-experience perspective.

As such, in some embodiments of the present disclosure, the housing 170 of the automatic lacing system 54 of the article of footwear 74 may include ingress protection means, i.e., resistance to water or dust entering the housing 170, and/or operational sound damping means. In the embodiment of the housing 170 illustrated in FIGS. 23-25, and as noted above, the powertrain assembly 380, the flexible circuit 484, and the lighting system 486 are contained within the housing base cover 364. Furthermore, the swipe sensor 522 is disposed within the swipe sensor recess 520 disposed on the top surface 492 of the housing base cover 364 and the lighting system cover 526 is disposed within the lighting system cover hole 524 of the housing base cover 364. In order to provide ingress protection to the electronics mentioned above and to the powertrain assembly 380 disposed within the housing 170 and/or to reduce noise from outside the housing 170 during the operation of the powertrain assembly 380, the housing 170 is configured to provide one or more seals between the housing base 362, the housing base cover 364, and/or the housing top cover 366.

For example, in the illustrated embodiment with reference to FIG. 21, the housing base cover 364 is configured to provide an ingress protecting and/or noise reducing seal with the housing base 362 via the lower gasket 400 disposed within the lower gasket channel 402 of the housing base 362 when the housing base cover 364 is attached to the housing base 362. Similarly, the housing top cover 366 is configured to provide an ingress protecting and/or noise reducing seal with the housing base cover 364 over the swipe sensor 522 and the lighting system cover 526, via the upper gasket 404 disposed within the upper gasket channel 406 of the housing base cover 364 when the housing top cover 366 is attached to the housing base cover 364. In some embodiments, the housing 170 is configured to provide an ingress protection rating, under codes established in international standard IEC 60529 or European standard EN 60529, in a range between IP-31 to IP-68. In some embodiments, other operational sound damping means may be included, such as electronic-based sound damping.

Figure 26:
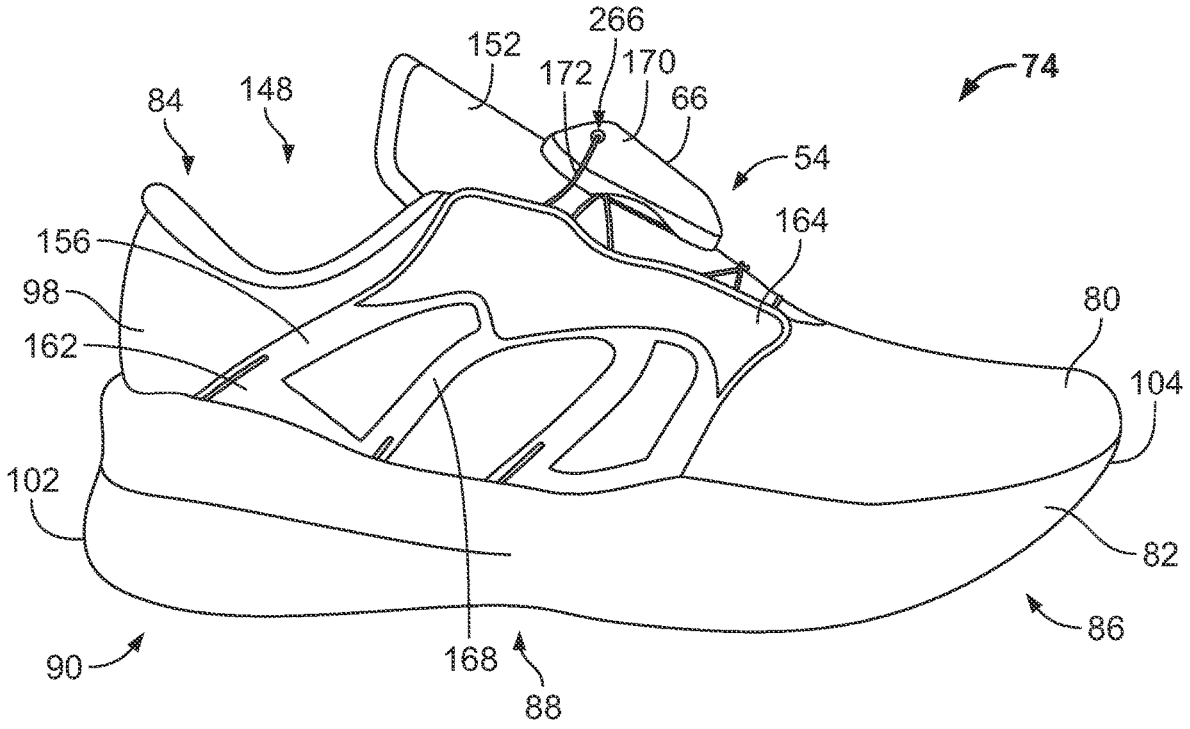
FIG. 26 is a side elevation view of one of the shoes of FIG. 2 shown in a loosened configuration.
Figure 27:
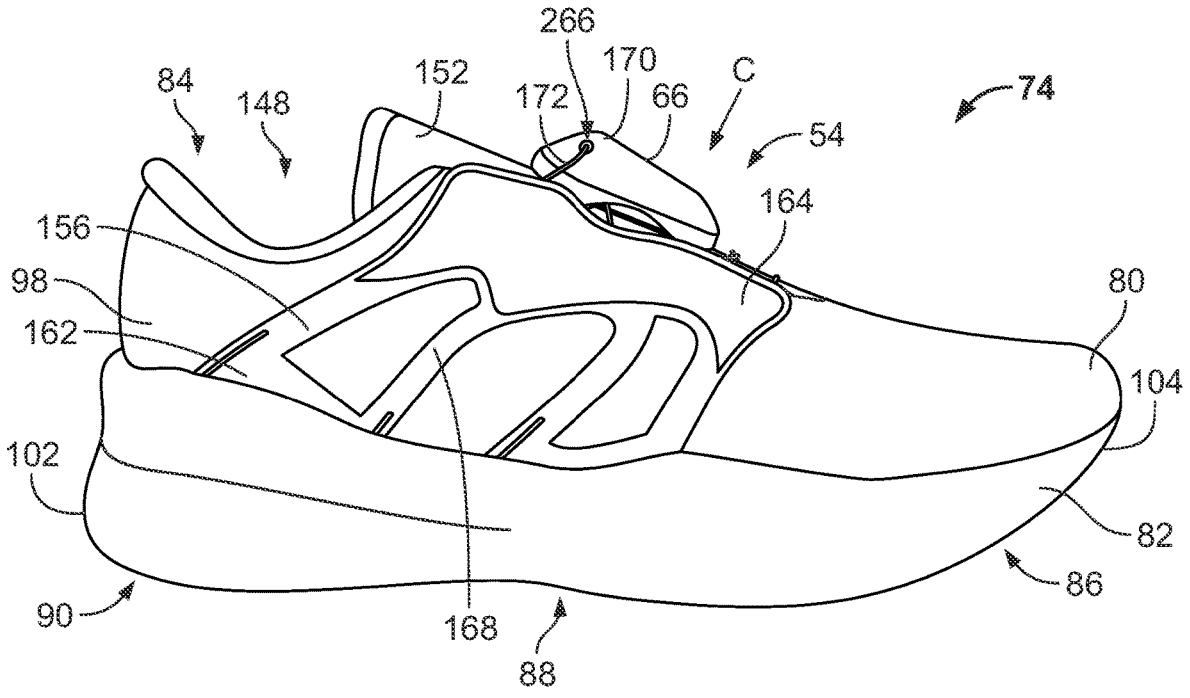
FIG. 27 is a side elevation view of one of the shoes of FIG. 2 shown in a tightened configuration.

Referring now to FIGS. 26 and 27, side views of the article of footwear 74 are shown in a loosened configuration, and a tightened configuration, respectively. Referring specifically to FIG. 26, in the loosened configuration, the lace 172 is not taut, but is laced in a crisscrossing manner through each of the lateral and medial lace retainers 174, 178, respectively (see FIG. 8). As such, the upper ends 160, 164 of the lateral and medial side flaps 154, 156 may be free to pivot away from the tongue 152 and the upper 80 about the fixed lower ends 158, 162 of the side flaps 154, 156, respectively, because the lace 172 does not pull and maintain the lateral and medial lace retainers 174, 178 toward the tongue 152 in the loosened configuration. In some embodiments, the lace 172 has a slight amount of pre-tensioning to ensure a more comfortable instep if the shoe is in the loosened configuration. To that end, the article of footwear 74 as shown in FIG. 26 achieves a more comfortable instep position, which may be utilized by a user in certain circumstances when the article of footwear 74 is being worn. Referring back to FIG. 19, in the loosened configuration, the lace 172 may be disposed as shown in this detail view, where the upper wheel gear assembly 370 is not rotated in such a way as to cause the lace 172 to be tightened. While the upper wheel gear assembly 370 may be disposed in alternative configurations in the loosened configuration, the upper wheel gear assembly 370 is preferably disposed in a similar fashion as shown in FIG. 19 in the loosened configuration.

Referring now to FIG. 27, when the automatic lacing system 54 is commanded to tighten the lace 172, the tongue 152, and, therefore, the housing 170 are drawn downward in a direction of the arrow C, and the upper ends 160, 164 of the side flaps 154, 156 are drawn inward toward the tongue 152 while the bodies 166, 168 of the side flaps 154, 156 are drawn inward around the upper 80 of the article of footwear 74, thereby achieving a first tightened configuration. There may be any number of tightened configurations, based on levels of tightness that can be achieved based on user inputs or pre-set settings of the automatic lacing system 54. The first tightened configuration may have a first level of tightness, and a second tightened configuration may have a second level of tightness that is greater than the first level of tightness. Referring again to FIG. 20, the first level of tightness may be achieved when the wheel gear 384 (coupled with the upper wheel gear assembly 370) is rotated by about 15 degrees, or about 30 degrees, or about 45 degrees, or about 60 degrees, or about 90 degrees. Each subsequent level of tightness may be achieved by rotating the wheel gear 384 by another amount, which may be about 15 degrees, or about 30 degrees, or about 45 degrees, or about 60 degrees, or about 90 degrees.

Once the article of footwear 74 has achieved the first tightened configuration, the article of footwear 74 may be returned to the loosened configuration by rotating the wheel gear 384 in a reverse direction, i.e., if the wheel gear 384 is tightened by rotating in the direction of arrow A (see FIG. 20), then the wheel gear 384 is loosened by being rotated in the direction of arrow B. To that end, the article of footwear 74 shown in FIG. 26, which is shown in a loosened configuration, may be adjusted into the tightened configuration as shown in FIG. 27, and may subsequently be returned to the original, loosened configuration shown in FIG. 26. The lace 172 of the article of footwear 74 may be tightened or loosened any number of times and in any number of increments. Certain tightening/loosening sequences are described in the present application, however, the present disclosure is not intended to be limiting.

As previously noted, the automatic lacing system 54 may be manipulated by a user using two methods: (1) physical contact with the panel 66 of the housing 170, i.e., user interaction with the swipe sensor 522 disposed within the housing 170; and (2) using the electronic device 64 (shown in FIG. 1). The first method of manipulation, i.e., physical adjustment, will be discussed. To that end, the automatic lacing system 54 can have predetermined levels of tightness, which includes the loosened or open configuration of FIG. 26, wherein the lace 172 is loosened to a predetermined tightness, and the tightened or closed configuration of FIG. 27, wherein the lace 172 is tightened to a predetermined tightness. In practice, a user may be able to swipe down on or tap a distal end of the panel 66 to tighten the lace 172 to the predetermined tightness of the closed configuration, or swipe up on or tap a proximal end of the panel 66 to loosen the lace 172 to the predetermined tightness of the open configuration. The second method of manipulation, i.e., wireless adjustment, is provided in that the automatic lacing system 54 can also be controlled using the electronic device 64, which can be paired with or connected to the lacing system 54 via Bluetooth® or another wireless signal, the details of which will be discussed below with reference to FIG. 40.

Figure 28:
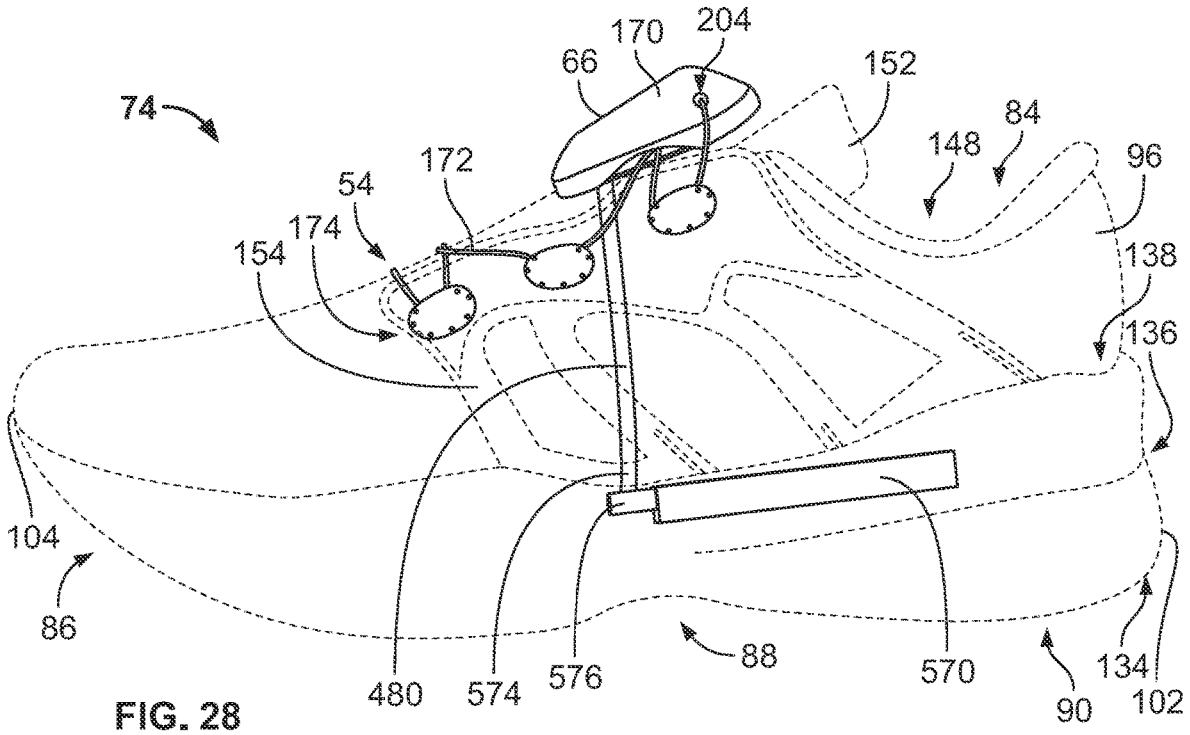
FIG. 28 is a side view of the housing of the automatic lacing system of FIG. 3 and a controller of the automatic lacing system in connection with the housing with the shoe of FIG. 3 shown in broken lines.
Figure 29:
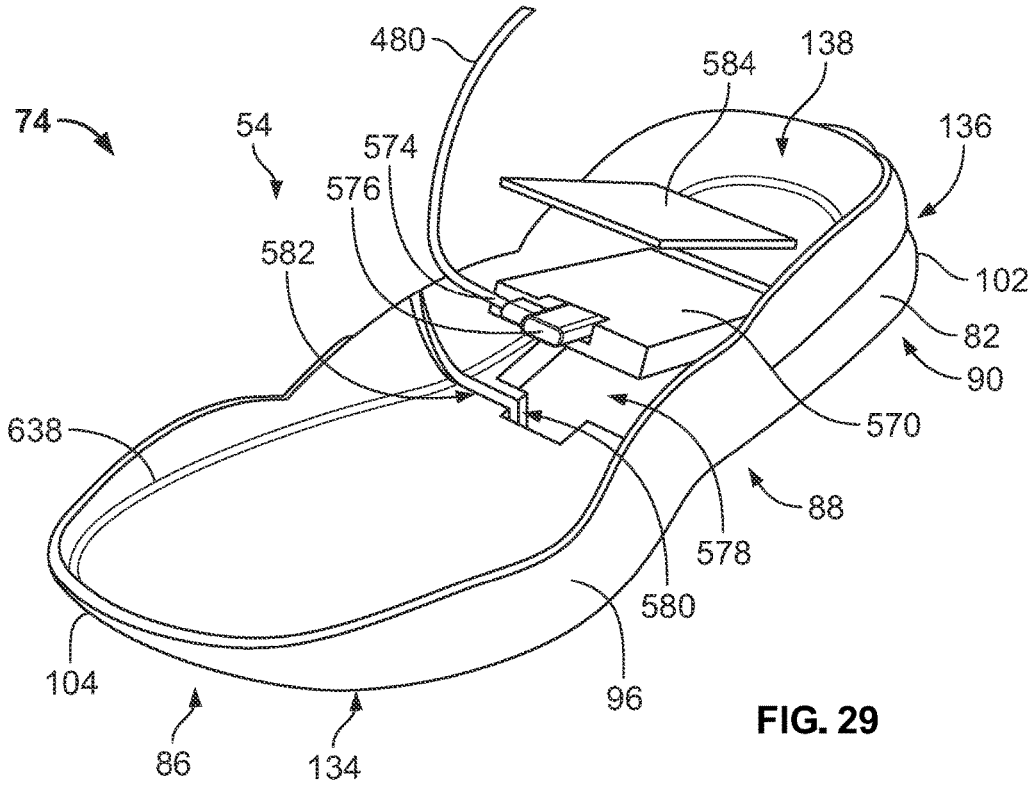
FIG. 29 is a perspective view of the controller of the automatic lacing system of FIG. 28 shown separated from the sole structure of the shoe of FIG. 3 with an upper of the shoe removed.

Referring now to FIGS. 28-31, a controller 570 of the automatic lacing system 54 is shown in greater detail. The controller 570 of the automatic lacing system 54 is shown in FIG. 28 and is disposed within the sole structure 82 of the article of footwear 74. Specifically, the controller 570 is disposed within the insole region 138 of the sole structure 82 that is within the interior cavity 84 of the article of footwear 74. The controller 570 is in electrical connection with the motor 382 of the housing 170 via the motor wire 480 extending from the controller 570 to the housing 170 within the upper 80 of the article of footwear 74. The motor wire 480 has a first end 572 in connection with the motor 382 (see FIGS. 21-25) and a second end 574 having a controller connector 576. The controller 570 is configured to power and control the motor 382 of the automatic lacing system 54.

In some embodiments, the controller 570 is permanently installed within the sole structure 82 of the article of footwear 74. In some embodiments, the controller 570 is removable from the sole structure 82. For example, referring now to FIG. 29, the sole structure 82 of the article of footwear 74 is shown with the upper 80 removed for clarity. In the illustrated embodiment, the controller 570 is removably contained within a controller recess 578 disposed on the insole region 138 of the sole structure 82 and within the heel region 90 and the midfoot region 88 of the article of footwear 74. In some embodiments, the controller recess 570 may be disposed entirely within the heel region 90 of the article of footwear 74. In some embodiments, the controller recess 570 may be disposed within the heel region 90, the midfoot region 88, and/or the forefoot region 86 of the article of footwear 74. The controller recess 578 is configured to receive the controller 570 and includes a controller connector recess 580 and a motor wire recess 582. The motor wire recess 582 is configured to receive the motor wire 480, and the controller connector recess 580 is configured to receive the controller connector 576 of the second end 574 of the motor wire 480 when the motor wire 480 is connected to the controller 570. A controller recess cover 584 (see FIG. 29) is configured to cover the controller recess 578 and provide a continuous surface of the insole region 138 of the sole structure 82, such that the insole 106 (see FIG. 6) may be disposed within the insole region 138 and on top of the recess cover 584. The controller 570 is removable from the controller recess 578 when the controller recess cover 584 is removed or otherwise opened, and is accessible to a user through the opening 148 into the interior cavity 84 of the upper 80 of the article of footwear 74 (see FIG. 28).

Figure 30:
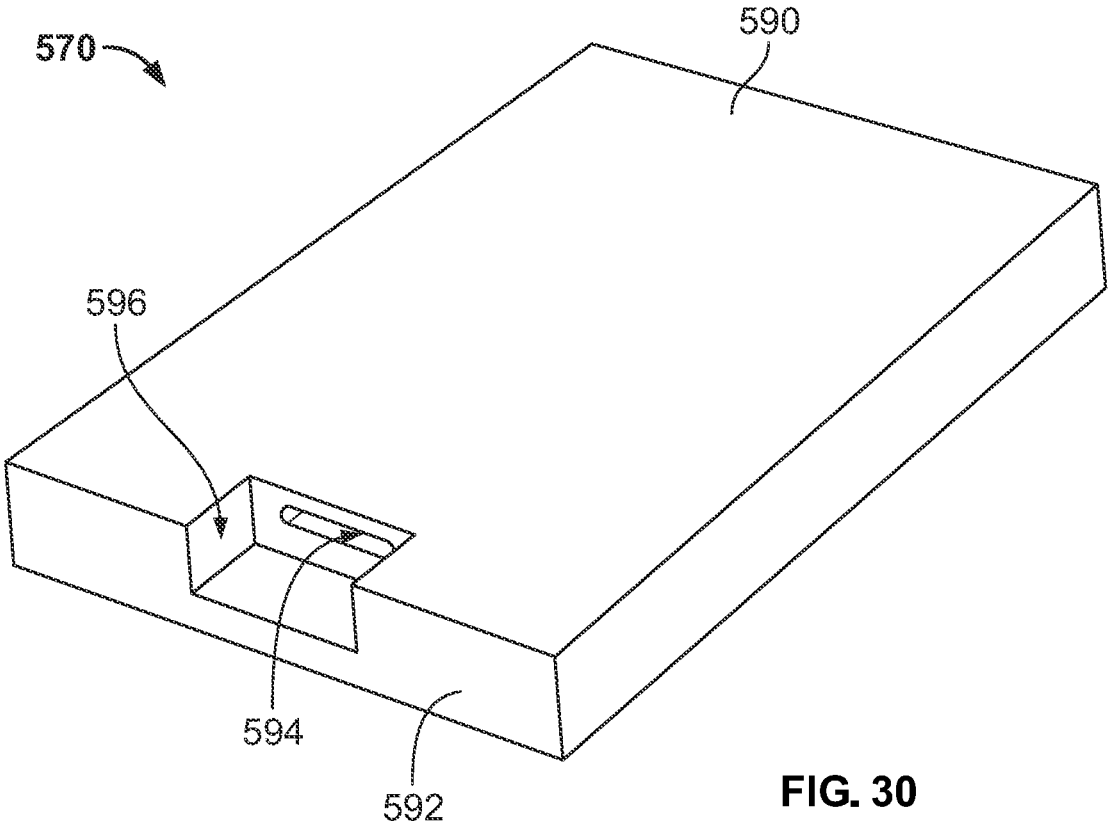
FIG. 30 is an isometric view of the controller of the automatic lacing system of FIG. 28.
Figure 31:
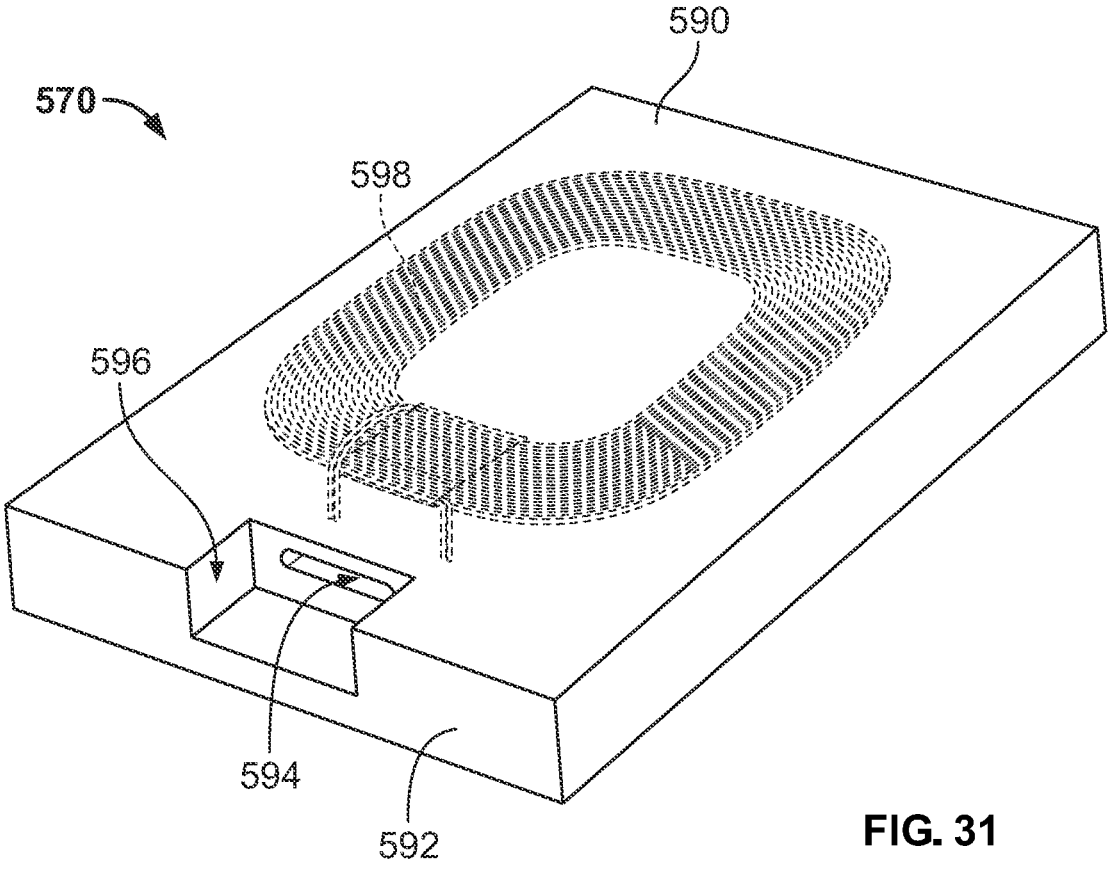
FIG. 31 is an isometric view of the controller of FIG. 30 showing a charging coil in phantom lines disposed below a top surface of the controller.

Referring to FIG. 30, the controller 570 has a first or top side 590 and a second or distal side 592. A controller connection port 594 is disposed within a port recess 596 that is disposed on the top and distal sides 590, 592 of the controller 570, and is configured to receive the controller connector 576 at the second end 574 of the motor wire 480. Referring to FIG. 31, inductive coils 598 are disposed below the top side 590 of the controller 570, such that the charging coils 598 face upward from insole region 138 of the sole structure 82 when the controller 570 is disposed within the controller recess 578 (as shown in FIG. 28). The charging coils 598 are configured to provide wireless charging to a battery 600 (see FIG. 41) of the controller 570 via one of the dual charging pucks 56 (shown in FIG. 1).

Figure 32:
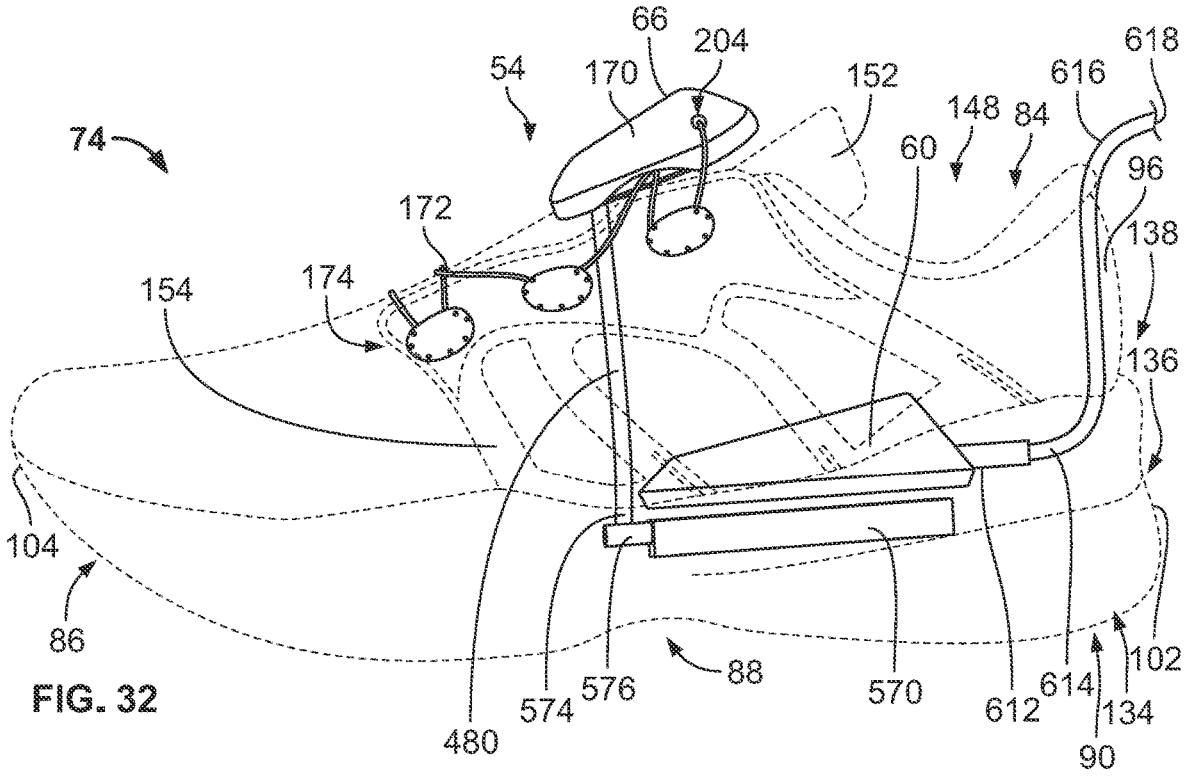
FIG. 32 is a side view of the housing and controller of FIG. 28 and one of the charging pucks of the automatic lacing system of FIG. 1 in a wireless charging configuration above the controller, with the shoe of FIG. 3 shown in broken lines.
Figure 33:
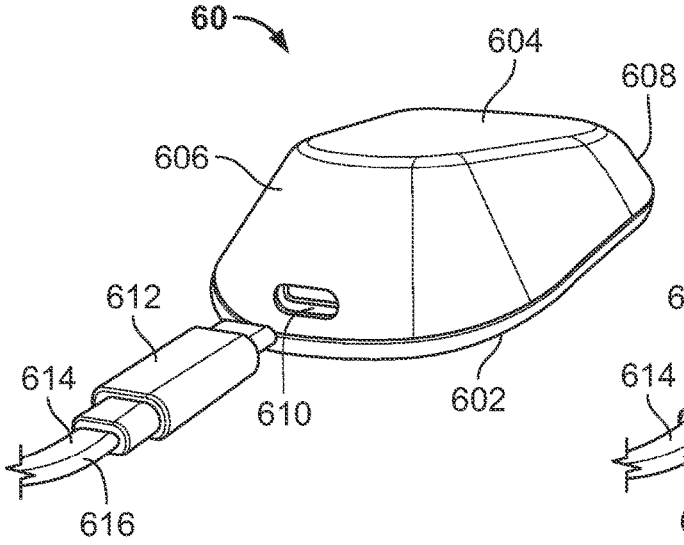
FIG. 33 is a perspective view of the charging puck of FIG. 32 shown with a cable removed from the charging puck.
Figure 34:
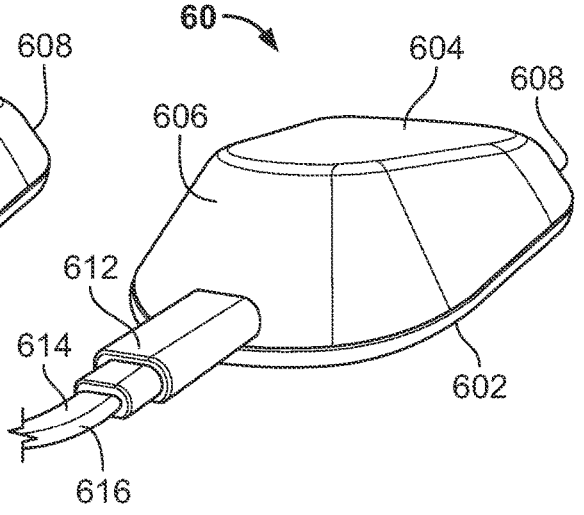
FIG. 34 is a perspective view of the charging puck of FIG. 32 shown with the cable inserted into the charging puck.
Figure 36:
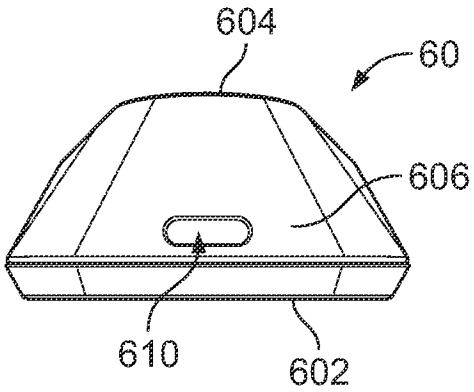
FIG. 36 is a top view of the charging puck of FIG. 35.

Now referring to FIGS. 32-38, the first charging puck 60 of the dual charging pucks 56 (shown in FIG. 1) of the automatic lacing system 54 is shown in detail and in various configurations. For purposes of ease of disclosure, FIGS. 32-37 refer to the first charging puck 60, which is identical to the second charging puck 62, of the dual charging pucks 56. Referring to FIG. 32, the first charging puck 60 is shown in a charging configuration and is disposed on the insole region 138 of the sole structure 82 above the top side 590 (see FIGS. 30 and 31) of the controller 570, which is disposed within the controller recess 578. The first charging puck 60 is configured to wirelessly charge the battery 600 (see FIG. 41) of the controller 570 via inductive coils (not shown) disposed on a bottom side 602 (see FIGS. 33-37) of the first charging puck 60 that are in an inductive connection with the charging coils 598 of the controller 570 when the first charging puck 60 is in the charging configuration shown in FIG. 32.

Referring to FIGS. 33-37, the first charging puck 60 includes the first or bottom side 602, a second or top side 604, a third or proximal side 606, and a fourth or distal side 608, opposite the proximal side 606. An electrical connector port 610 is disposed on the proximal side 606 of the charging puck 60, the electrical connector port 610 is configured to receive an electrical connector 612 disposed on a first end 614 of a charging cable 616. A second end 618 of the charging cable 616 can include a USB connector, or other type of electrical connector, to provide an electrical connection to an external power source. The electrical connector port 610 of the charging puck 60 can be of the same electrical connector type as the controller connection port 594 of the controller 570, such as a Mini USB or a USB-C connector. Thus, as an alternative to the wireless charging configuration shown in FIG. 32, the charging cable 616 can be utilized to directly charge the battery 600 of the controller 570 via the controller connection port 594 of the controller 570 when the controller 570 is removed from the controller recess 578 of the sole structure 82 of the article of footwear 74.

Figure 38:
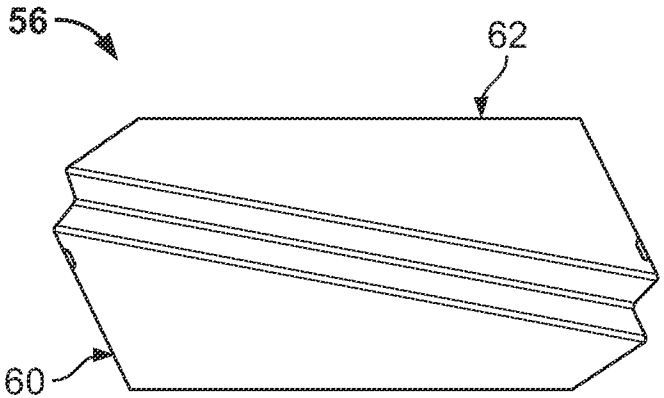
FIG. 38 is a side view of the charging pucks of the automatic lacing system of FIG. 1 in a mated configuration.
Figure 35:
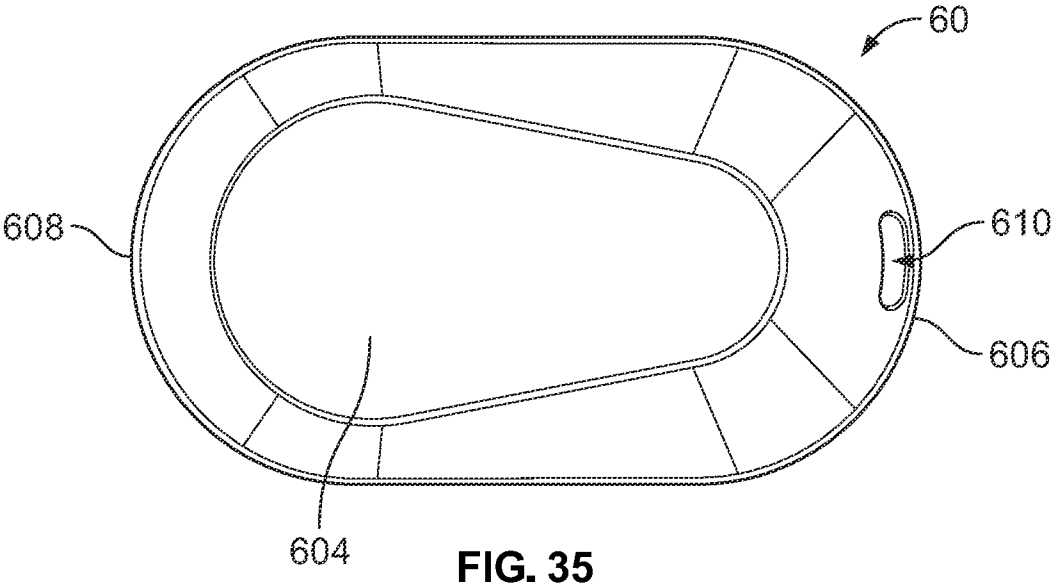
FIG. 35 is a front view of the charging puck of FIG. 33.
Figure 37:
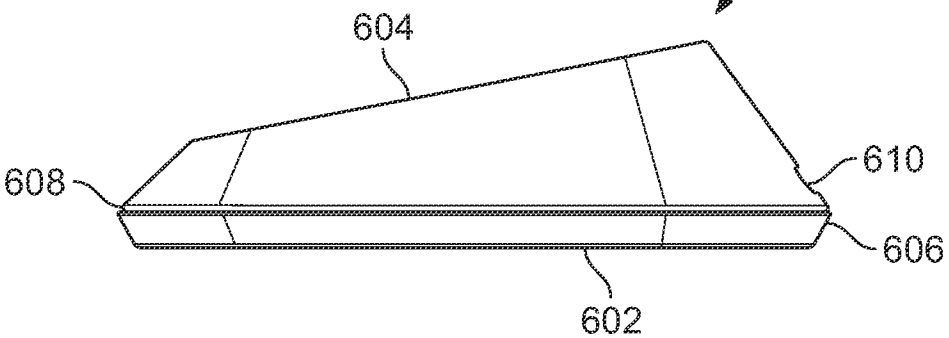
FIG. 37 is a first or right side view of the charging puck of FIG. 35.

Referring to FIG. 38, as noted above, the first charging puck 60 is identical to the second charging puck 62, and each of the dual charging pucks 56 can wirelessly charge either of the left shoe 70 or the right shoe 72. The charging pucks 56 are configured to mate with one another in a mating configuration (as shown in FIG. 38) for ease of storage and transport when the charging pucks 56 are not in use. Specifically, each of the top sides 604 of the charging pucks 56 are angled downward from the proximal ends 606 relative to the bottom surfaces 602 (see FIG. 37). Thus, when the bottom surfaces 602 of the charging pucks 56 are mated, the top sides 604 of the charging pucks 56 are parallel to one another. Furthermore, a first magnetic component (not shown) can be included within the bottom surfaces 602 of the charging pucks 56 that is configured to releasably hold the charging pucks 56 in the mated configuration shown in FIG. 38. Similarly, a second magnetic component (not shown) can be included within the top surface 590 of the controller 570 that is configured to releasably hold one of the charging pucks 60, 62 in position on the insole region 138 of the sole structure 82 and over the inductive coils 598 of the controller 570 in the wireless charging configuration shown in FIG. 32.

Figure 39:
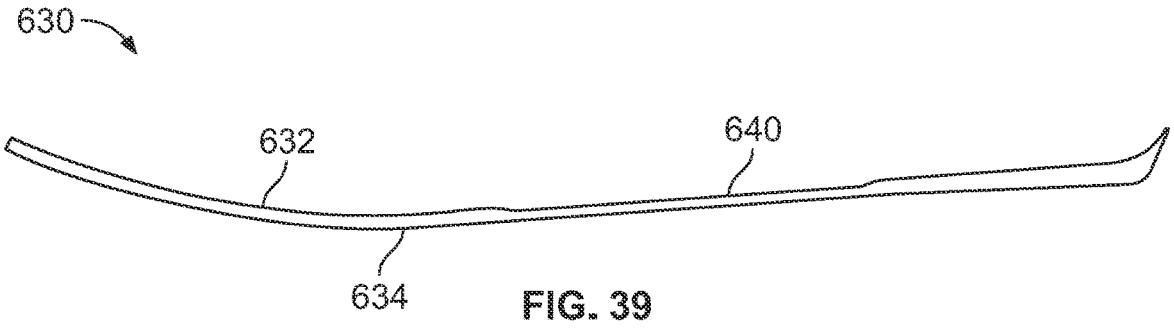
FIG. 39 is a side view of another embodiment of the insole of the shoe of FIG. 6.
Figure 40:
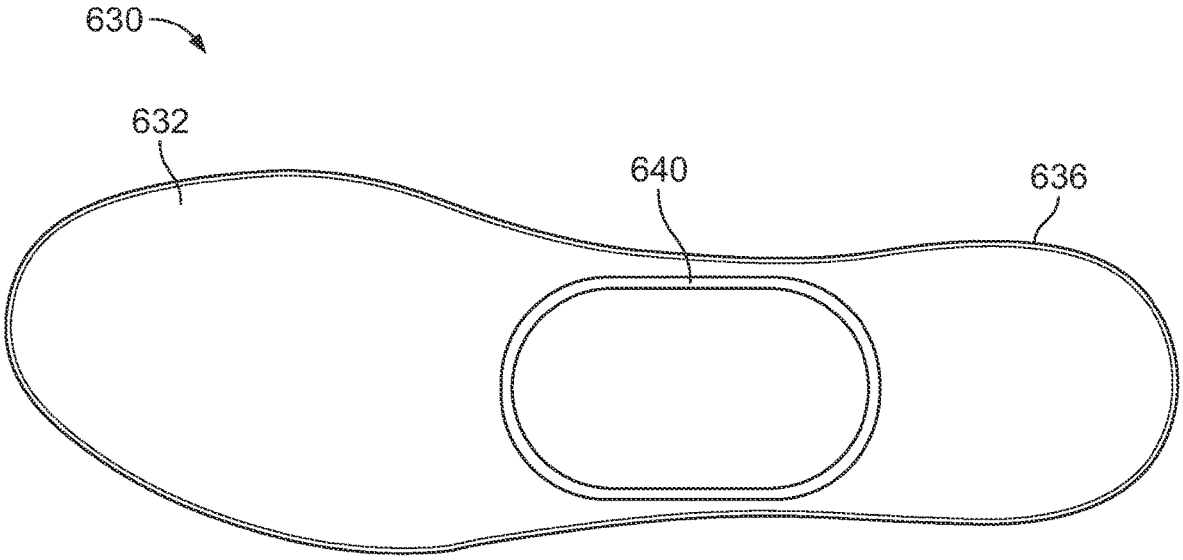
FIG. 40 is a top plan view of the insole of FIG. 39.

Referring now to FIGS. 39 and 40, an alternative embodiment of the insole 106 of the article of footwear 74 is shown (see FIG. 6). An insole 630 is configured to be disposed in the same location and function similar to the insole 106 disposed in the insole region 138 of the article of footwear 74 in the embodiment illustrated in FIGS. 4-7. However, the insole 630 in this illustrated embodiment is configured to align the bottom surface 602 of the charging pucks 56 with the inductive coils 598 of the controller 570 disposed within the controller recess 578 of the sole structure 82 when one of the charging pucks 56 are in the charging configuration shown in FIG. 32. For example, the insole 630 has a first or top surface 632, a second or bottom surface 634, and an outer profile 636 configured to contact an inner profile 638 (see FIG. 29) of the insole region 138 (see FIG. 29) of the sole structure 82 of the article of footwear 74. A charging puck recess 640 is disposed on the top surface 632 of the insole 630. The charging puck recess 640 is configured to align with the inductive coils 598 of the controller 570 when the controller 570 is disposed within the controller recess 578 of the sole structure 82 and the insole 630 is inserted into the insole region 138 of the sole structure 82. In some embodiments, the insole 630 may be an insert that is entirely removable from the insole region 138. In some embodiments, a first portion of the insole 630 may be stitched or otherwise fixedly attached to the insole region 138 near the toe end 122 of the article of footwear 74 and a second portion of the insole 630 may be configured to be rotatable, or otherwise movable, within the insole region 138 in order for a user to access the controller recess cover 584 disposed on the insole region 138.

Figure 41:
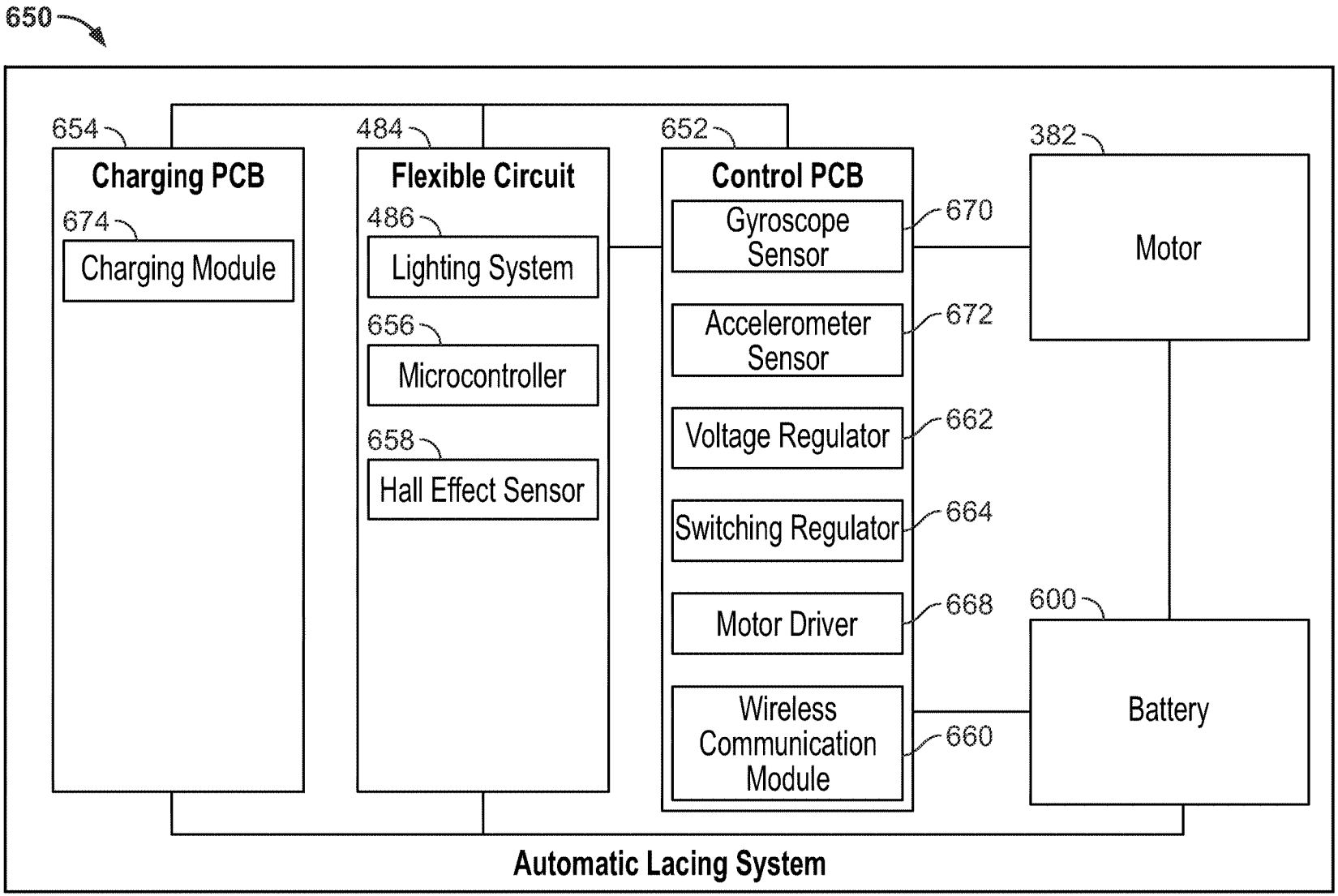
FIG. 41 is a block diagram of various electrical components of the automatic lacing system of FIG. 1.

Referring now to FIG. 41, a block diagram 650 is illustrated, the block diagram 650 including the various electrical components described above within the automatic lacing system 54. The automatic lacing system 54 broadly includes at least a control printed circuit board (PCB) 652, a charging PCB 654, the motor 382, the flexible circuit 484, and the battery 600. In the illustrated embodiment, the lighting system 486, a microcontroller 656, and a Hall Effect sensor 658 are provided along the flexible circuit 484. In the illustrated embodiment, the control PCB 652 includes a wireless communication module 660, a voltage regulator 662, a switching regulator 664, a motor driver 668, a gyroscope sensor 670, and an accelerometer sensor 672. The motor 382 is in electrical communication with the control PCB 652 of the controller 570 via the motor wire 480 (see FIG. 28). The flexible circuit 484 is also in electrical communication with the control PCB 652 of the controller via the motor wire 480 (see FIG. 28). The charging PCB 654 includes a charging module 674. The battery 600 is in electrical communication with all of the electrical components and is directly coupled with the control PCB 652 of the controller 570. In the embodiment of the controller 570 illustrated in FIGS. 28-32, the battery 600 is included within the controller 570. In some embodiments, the battery 600 may be separate from the controller 570 and removably connected to the controller 570 by an electrical wire or other means. Additional electrical components not specifically addressed herein may also be included along one of the control PCB 652 or the flexible circuit 484.

Still referring to FIG. 41, a plurality of resistors, capacitors, and other electrical components are also disposed along the control PCB 652 but are not specifically referenced herein. The wireless communication module 660 supports Bluetooth® Low Energy (BLE) wireless communication. In an embodiment, the wireless communication module 660 includes onboard crystal oscillators, chip antenna, and passive components. The wireless communication module 660 may support a number of peripheral functions, e.g., ADC, timers, counters, PWM, and serial communication protocols, e.g., I2C, UART, SPI, through its programmable architecture. The wireless communication module 660 may include a processor, a flash memory, a timer, and additional components not specifically noted herein.

Still referring to FIG. 41, the motor driver 668 is also provided along the control PCB 652. The motor driver 668 may be a dual brushed DC motor driver that works with 3 V to 5 V logic levels, supports ultrasonic (up to 20 kHz) pulse width modulation (PWM), and features current feedback, under-voltage protection, over-current protection, and over-temperature protection. The motor driver 668 can supply up to or above 3 Amps of continuous current per channel to the motor 382, and supports ultrasonic (up to 20 kHz) PWM of a motor output voltage, which helps to reduce audible switching sounds caused by PWM speed control.

Still referring to FIG. 41, the voltage regulator 662 may also be provided. The voltage regulator 662 may comprise a fixed output voltage low dropout linear regulator. The voltage regulator 662 may include built-in output current-limiting. The switching regulator 664 is also included on the control PCB 652. The switching regulator 664 may be a monolithic nonsynchronous switching regulator with integrated 5-A, 24-V power switch. The switching regulator 664 may regulate output voltage with current mode PWM control and may include an internal oscillator. The switching frequency of PWM may be set by an external resistor or by synchronizing to an external clock signal. The switching regulator 664 may include an internal 5-A, 24-V Low-Side MOSFET Switch, 2.9-V to 16-V Input Voltage Range, a fixed-Frequency-Current-Mode PWM Control, and/or a frequency hat that is adjustable from about 100 kHz to about 1.2 MHz.

Still referring to FIG. 41, the microcontroller 656 is shown disposed along the flexible circuit 484. The microcontroller 656 enables and controls a capacitive, touch sensing user interface along the panel 66 of the housing 170. The microcontroller 656 may be able to support a plurality of capacitive sensing inputs, and allows for capacitive buttons, sliders, and/or proximity sensors to be electrically coupled thereto, some or all of which may be incorporated along the flexible circuit 484. The microcontroller 656 can include an analog sensing channel and delivers a signal-to-noise ratio (SNR) of greater than 100:1 to ensure touch accuracy even in noisy environments. The microcontroller 656 may be programmed to dynamically monitor and maintain optimal sensor performance in all environmental conditions. Advanced features, such as LED brightness control, proximity sensing, and system diagnostics, may be programmable. The microcontroller 656 may be operable to enable liquid-tolerant designs by eliminating false touches due to mist, water droplets, or streaming water.

The Hall effect sensor 658 may be provided (shown disposed along the flexible circuit 484 in FIG. 41), which may be operable to detect a switch in a magnetic field adjacent the motor 382 from N to S, or vice versa, and maintain its detection result on the output until the next switch. Output is pulled low for S-pole fields and high for N-pole fields. The Hall effect sensor 658 may be operable to provide feedback regarding a direction of the motor 382. Additional sensors may be provided, and varying types of sensors may be provided along the flexible circuit 484 or along portions of the article of footwear 74. The Hall effect sensor 658 therefore may operate to detect rotation, position, open/closed configuration, current detection, and/or various other aspects of the motor 382. As noted above, the Hall effect sensor 658 is electrically coupled with the microcontroller 656.

The gyroscope sensor 670 may be provided (shown disposed along the control PCB 652 in FIG. 41), which may be operable to detect angular deviations in X, Y, and/or Z axes relative to the position of the housing 170 and/or the controller 570 of the automatic lacing system 54 of the article of footwear 74. The gyroscope sensor 670 therefore may operate to detect angular rotation of the shoes 52 in the X, Y, and/or Z axes while a user performs various activities, such as running. The gyroscope sensor 670 may alternatively be provided along the flexible circuit 484 or along portions of the article of footwear 74.

The accelerometer sensor 672 may also be provided (shown disposed along the control PCB 652 in FIG. 41), which may be operable to detect linear acceleration in the X, Y, and/or Z axes of the housing 170 and/or the controller 570 of the automatic lacing system 54 of the article of footwear 74. The accelerometer sensor 672 therefore may operate to detect velocity and acceleration of the shoes 52 in the X, Y, and/or Z axes while a user performs various activities, such as running. The accelerometer sensor 672 may alternatively be provided along the flexible circuit 484 or along portions of the article of footwear 74.

Still referring to FIG. 41, the charging module 674 may be provided (shown disposed along the charging PCB 654, which may be housed within the controller 570. The charging module 674 comprises a variety of capacitors, diodes, and rectifiers, and may have a number of alternative configurations. The charging module 674 is configured to allow for charging of the battery 600 via the connection port 594 or the inductive coils 598 of the controller 570.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear, comprising:

a sole structure;

an upper attached to the sole structure, the upper comprising a lateral side, a medial side, and a tongue;

a lacing system comprising:

a housing disposed on the tongue;

a lateral side flap extending from the sole structure and along the lateral side of the upper toward the tongue, such that an upper end of the lateral side flap is next to a lateral side of the tongue and is pivotably moveable relative to the lateral side of the upper;

a medial side flap extending from the sole structure and along the medial side of the upper toward the tongue, such that an upper end of the medial side flap is next to a medial side of the tongue and is pivotably moveable relative to the medial side of the upper;

a plurality of lateral lace retainers disposed along the upper end of the lateral side flap, and a plurality of medial lace retainers disposed along the upper end of the medial side flap; and a lace that extends from the housing through the pluralities of lateral and medial lace retainers in a crisscrossing manner across the tongue, wherein the housing is configured to draw the lace into the housing;

a motor and a gear train including a wheel gear disposed within a base of the housing; and an upper extension of the wheel gear disposed on a base cover of the housing, the upper extension of the wheel gear configured to receive a portion of the lace received through a lateral aperture and a medial aperture that are defined by a top cover of the housing, wherein when the motor drives the gear train, the lace is drawn into the housing.

2. The article of footwear of claim 1, wherein the housing defines a lateral aperture and a medial aperture, and wherein the lace extends through the lateral aperture, the medial aperture, the plurality of lateral lace retainers, and the plurality of medial lace retainers.

3. The article of footwear of claim 2, wherein the plurality of lateral lace retainers includes a first lateral lace retainer, a second lateral lace retainer, and a third lateral lace retainer, wherein the plurality of medial lace retainers includes a first medial lace retainer, a second medial lace retainer, and a third medial lace retainer, and wherein the lace extends from the housing through the lateral aperture of the housing, through the first lateral lace retainer, across the tongue and through the second medial lace retainer, across the tongue again and through the third lateral lace retainer, across the tongue again and through the third medial lace retainer, across the tongue again and through the second lateral lace retainer, across the tongue again and through the first medial lace retainer, and back into the housing through the medial aperture of the housing.

4. The article of footwear of claim 3, wherein the tongue defines a plurality of lace channels and a housing recess that is configured to receive the housing, and wherein the plurality of lace channels is configured to receive portions of the lace extending from the lateral and medial apertures of the housing and the plurality of lateral lace retainers and the plurality of medial lace retainers.

5. The article of footwear of claim 3, wherein the plurality of lateral lace retainers and the plurality of medial lace retainers include an elongated lace aperture configured to retain portions of the lace extending through the lateral and medial lace retainers at an angle relative to the portions of the lace extending from the lateral and medial lace retainers across the tongue.

6. The article of footwear of claim 1, wherein, when the lace is drawn into the housing, the upper end of the lateral side flap is pulled inward toward the tongue by the plurality of lateral lace retainers, the upper end of the medial side flap is pulled inward toward the tongue by the plurality of medial lace retainers, and the tongue is pulled downward toward the sole structure.

7. The article of footwear of claim 1, wherein the lacing system further comprises a controller disposed within the sole structure, the controller including a battery, and wherein the controller is electrically connected to the housing and powers the motor.

8. The article of footwear of claim 7, wherein the lacing system further comprises a swipe sensor disposed on the base cover of the housing and along a panel of the top cover of the housing, the swipe sensor being powered by the battery of the controller and operable to receive user inputs.

9. The article of footwear of claim 7, wherein the controller is removable from the sole structure via an opening in the upper of the article of footwear.

10. An article of footwear, comprising:

a sole structure;

an upper attached to the sole structure, the upper comprising a tongue; and a lacing system comprising:

a housing disposed on the tongue and next to an instep region of the upper;

a plurality of lateral lace retainers disposed on the upper along a lateral side of the tongue, and a plurality of medial lace retainers disposed on the upper along a medial side of the tongue; and a lace that extends from the housing through a lateral aperture and a medial aperture of the housing and through the pluralities of lateral and medial lace retainers in a crisscrossing manner across the tongue, the housing being configured to draw the lace into the housing, wherein the tongue defines a housing recess configured to receive the housing and a plurality of tongue lace channels configured to receive portions of the lace extending though the pluralities of lateral and medial lace retainers, wherein the housing recess and the plurality of tongue lace channels extend from an outer surface of the tongue to an intermediate surface of the tongue, wherein the housing defines a housing lace channel configured to receive two or more portions of the lace extending between the pluralities of lateral and medial lace retainers, wherein the lacing system further comprises a controller disposed within the sole structure, the controller being electrically connected to the housing, wherein the lacing system further comprises:

a motor electrically connected to and powered by a battery of the controller; and a gear train including a wheel gear, the wheel gear including an upper extension, wherein the motor and the gear train are disposed within a base of the housing, and the upper extension of the wheel gear is disposed on a base cover of the housing, wherein the upper extension of the wheel gear includes an aperture configured to receive a portion of the lace that is received through a lateral aperture and a medial aperture defined by a top cover of the housing, and wherein, when the motor drives the gear train, the lace is drawn into the housing.

11. The article of footwear of claim 10, wherein when the lace is drawn into the housing, the tongue is pulled downward, toward the sole structure.

12. The article of footwear of claim 10, wherein the plurality of tongue lace channels is configured to receive portions of the lace extending from the pluralities of lateral and medial lace retainers and the housing lace channel.

13. The article of footwear of claim 10, wherein the lace is a closed loop lace.

14. An article of footwear, comprising:

a sole structure, including an insole, a midsole, and an outsole;

an upper attached to the sole structure; and a lacing system, comprising:

a housing disposed on the upper and next to an instep region of the upper;

a lateral side flap extending from the sole structure and along a lateral side of the upper toward the housing, such that an upper end of the lateral side flap is next to a lateral side of the instep region of the upper;

a medial side flap extending from the sole structure and along a medial side of the upper toward the housing, such that an upper end of the medial side flap is next to a medial side of the instep region of the upper;

a plurality of lateral lace retainers disposed along the upper end of the lateral side flap, and a plurality of medial lace retainers disposed along the upper end of the medial side flap; and a lace that extends from the housing through the plurality of lateral lace retainers and the plurality of medial lace retainers in a crisscrossing manner across the instep region of the upper, wherein a motor and a gear train are disposed within a base of the housing, the gear train including a wheel gear having an upper extension that is disposed on a base cover of the housing, the upper extension being configured to receive a portion of the lace received through a top cover of the housing, and wherein when the motor drives the gear train, the lace is drawn into the housing.

15. The article of footwear of claim 14, wherein, when the lace is drawn into the housing, the upper end of the lateral side flap is pulled inward toward the instep region of the upper by the plurality of lateral lace retainers, and the upper end of the medial side flap is pulled inward toward the instep region of the upper by the plurality of medial lace retainers.

16. The article of footwear of claim 15, wherein the plurality of lateral lace retainers includes a first lateral lace retainer, a second lateral lace retainer, and a third lateral lace retainer, wherein the plurality of medial lace retainers includes a first medial lace retainer, a second medial lace retainer, and a third medial lace retainer, and wherein the lace extends from a lateral side of the housing and through the first lateral lace retainer, across the upper and through the second medial lace retainer, across the upper again and through the third lateral lace retainer, across the upper again and through the third medial lace retainer, across the upper again and through the second lateral lace retainer, across the upper again and through the first medial lace retainer, and to a medial side of the housing.

17. The article of footwear of claim 14, wherein the lacing system further comprises a controller disposed within the sole structure and in a heel region of the article of footwear, the controller being removably received within a controller recess formed in an insole region of the sole structure and removable from the sole structure via an opening of the upper of the article of footwear, and wherein the controller is electrically connected to the housing and controls the motor.

* * * * *